US007454892B2

(12) United States Patent
Lieuwen et al.

(10) Patent No.: US 7,454,892 B2
(45) **Date of Patent: *Nov. 25, 2008**

(54) SYSTEMS AND METHODS FOR DETECTION AND CONTROL OF BLOWOUT PRECURSORS IN COMBUSTORS USING ACOUSTICAL AND OPTICAL SENSING

(75) Inventors: Tim C. Lieuwen, Atlanta, GA (US); Suraj Nair, Atlanta, GA (US); Muruganandam Thiruchengode, Atlanta, GA (US); Ben T. Zinn, Atlanta, GA (US); Yediddia Neumeier, Dunwoody, GA (US); Jerry Seitzman, Atlanta, GA (US); David Scarborough, Locust Grove, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 896 days.

This patent is subject to a terminal disclaimer.

(21) Appl. No.: 10/696,860

(22) Filed: Oct. 30, 2003

(65) Prior Publication Data

US 2005/0056024 A1 Mar. 17, 2005

Related U.S. Application Data

(63) Continuation-in-part of application No. 10/603,039, filed on Jun. 24, 2003, now Pat. No. 7,089,746.

(60) Provisional application No. 60/422,385, filed on Oct. 30, 2002.

(51) Int. Cl.
*F02C 9/28* (2006.01)

(52) U.S. Cl. ..... 60/39.091; 60/39.281; 701/100

(58) Field of Classification Search ..... 60/39.091, 60/772, 776, 778, 39.24, 39.281; 701/100; 431/114
See application file for complete search history.

(56) References Cited

U.S. PATENT DOCUMENTS 4,147,222 A 4/1979 Patten et al. ..... 175/9

(Continued)

FOREIGN PATENT DOCUMENTS

EP 0 774 573 B1 2/2002

(Continued)

OTHER PUBLICATIONS

Muruganandam et al, "Optical and Acoustic Sensing of Lean Blowout Precursors", AIAA 2002-3732, 38th AIAA/ASME/SAE/ASEE Joint Propulsion Conference & Exhibit, Jul. 7-10, 2002.*

*Primary Examiner*—Charles G Freay
(74) *Attorney, Agent, or Firm*—Sutherland Absill & Brennan LLP

(57) ABSTRACT

The present invention comprises methods for detecting and controlling flame blowout in combustors. The blowout precursor detection system comprises a combustor, a blowout precursor detection unit, a pressure measuring device and/or an optical measuring device. The methods of the present invention comprise receiving optical data measured by an optical measuring device, performing one or a combination of raw data analysis, spectral analysis, statistical analysis, and wavelet analysis on received optical data, and determining the existence of a blowout precursor based on such analyses. The present invention further comprises closed-loop control methods for controlling a combustor to prevent blowout.

16 Claims, 45 Drawing Sheets

U.S. PATENT DOCUMENTS

| | | | | | |
|---|---|---|---|---|---|
| 5,145,355 | A | | 9/1992 | Poinsot et al. | 431/1 |
| 5,170,621 | A | * | 12/1992 | Barnum et al. | 60/39.091 |
| 5,235,802 | A | * | 8/1993 | Barnum et al. | 60/779 |
| 5,544,478 | A | * | 8/1996 | Shu et al. | 60/773 |
| 5,581,995 | A | | 12/1996 | Lucenko et al. | 60/39.02 |
| 5,591,995 | A | * | 1/1997 | Shaw | 257/206 |
| 5,706,643 | A | | 1/1998 | Snyder et al. | 60/39.06 |
| 5,752,379 | A | | 5/1998 | Schafer et al. | 60/39.24 |
| 5,828,797 | A | * | 10/1998 | Minott et al. | 385/12 |
| 6,705,857 | B2 | * | 3/2004 | Paschereit et al. | 431/350 |
| 7,089,746 | B2 | * | 8/2006 | Lieuwen et al. | 60/779 |
| 2002/0094267 | A1 | | 7/2002 | Kim et al. | 415/118 |

FOREIGN PATENT DOCUMENTS

| | | | | |
|---|---|---|---|---|
| JP | 358033025 | A | * | 2/1983 |

* cited by examiner

SYSTEMS AND METHODS FOR DETECTION AND CONTROL OF BLOWOUT PRECURSORS IN COMBUSTORS USING ACOUSTICAL AND OPTICAL SENSING

RELATED APPLICATION DATA

The present application is a continuation-in-part of U.S. application Ser. No. 10/603,039 entitled "Systems and Methods for Detection of Blowout Precursors in Combustors" filed on Jun. 24, 2003 now U.S. Pat. No. 7,089,746, which is incorporated herein by reference in its entirety. The present application also claims priority to U.S. Provisional Application No. 60/422,385 entitled "Detection and Active Control of Blowout," filed on Oct. 30, 2002, which is incorporated herein by reference in its entirety.

TECHNICAL FIELD

This invention relates to combustors in gas turbine engines, afterburners, industrial processing devices, and other combustor devices and more particularly, to detection and control of blowout precursors in such combustors.

BACKGROUND OF THE INVENTION

Combustors have long been used to burn a fuel/air mixture that is ultimately used to generate thrust, produce power, supply heat for some industrial process, or other applications. In these systems, an important performance metric is for the flame to remain stably in the combustor over a range of flow rates, pressures, and fuel/air ratios. At certain conditions, however, the flame may "blow out" of the combustor, so that no flame exists. The problem of blowout has long limited the allowable flow velocities through engines, particularly in systems such as gas turbines and afterburners which must operate at high flow rates and/or low pressures. The problem of blowout, however, has become increasingly more severe in a range of combustion devices, as they are required to meet stringent emissions legislation, severe operability constraints, and achieve better performance.

The problem of flame blowout can occur in combustors of land-based turbine engines, aeronautical turbine engines, afterburners, industrial processing devices, or any other combustor device. With respect to land-based turbine engines, operators of such engines attempt to run the engine near flame blowout conditions, known as the lean blowout line. An advantage of operating so close to the blowout line is that nitrous oxide emissions are significantly lowered. The trade-off, however, is an increased likelihood of blowing out of the flame. In the land-based systems, a blow out event requires a potentially lengthy system shut down and restart, resulting in economic consequences to the power plant owner when blowout is encountered.

In the aeronautical setting, blowout is a particular concern during fast engine transients, such as when rapid acceleration or deceleration of the engine is attempted. If the flame blows out in a commercial airplane, then there are obvious safety concerns for the passengers, though most engines can be re-ignited in-flight. However, because of the magnitude of the possible consequences, engine designers include substantial safety margins into the engines to avoid these events, often at the cost of reduced performance in other areas.

The need to avoid blowout in combustors often causes designers to sacrifice performance in other areas. In particular, because there is always some uncertainty in the exact conditions under which blowout may occur, extra margin must be built into the design. In such systems, performance could be improved and blowout better avoided if a method existed to monitor the proximity of the system to blowout.

A method designed to predict blowout conditions is U.S. Pat. No. 5,706,643 to Snyder et al. The Snyder patent discloses a method for predicting blowout conditions to minimize nitrous oxide emissions in land-based turbine engines. Snyder uses pressure measurements in the combustor to predict the onset of blowout conditions by analyzing pressure oscillations. The methods consist of monitoring the magnitude of the pressure, certain spectral components of the pressure, or the dominant frequency of the pressure. However, the methods rely on monitoring absolute magnitudes of the pressure signal, which may change on other engines, at different power settings, or due to inherent variability in pressure, temperature, or humidity of the air. As such, the methods reported by Snyder are designed to operate upon a particular engine at a particular operating condition. In addition, the dominant frequency may also change with engine type or operating conditions. Thus, the methods employed by Snyder are not robust and seemingly are operable only on the particular type of combustor tested and only under certain operating conditions. The methods taught by Snyder are not expansive to different combustor types operating in a wide array of environmental conditions.

Thus, there exists a need in the industry for a system and method for accurately predicting flame blowout conditions on different types of combustors operating in different environments.

Once flame blowout conditions are accurately predicted the combustor needs to be controlled to prevent flame blowout. Current systems in the industry have preset operating inputs, such as fuel flow and air flow, for specific load conditions. But no system or method exists in the industry that implements a closed-loop control system to actively change parameters in the combustor on a real time basis to prevent flame blowout based upon knowledge of the flame's stability characteristics.

SUMMARY OF THE INVENTION

The present invention comprises systems and methods for predicting and detecting flame blowout precursors in combustors. One embodiment of the present invention is a system for optical detection of blowout precursors. The system provides a combustor, an optical measuring device in communication with the combustor, and a blowout precursor detection unit that receives the optical signals and performs at least one of a raw data analysis, spectral analysis, statistical analysis, and wavelet analysis to identify a blowout precursor. Another aspect of the present invention may combine a combustor controller with the system for optical detection of blowout precursors, which controls operation of the combustor based at least in part on detection of blowout precursor by the blowout precursor detection unit.

Another embodiment of the present invention is a method for detecting blowout precursors in combustors. The method provides for receiving optical data measured by an optical measuring device associated with the combustor, performing raw data analysis on the optical data, performing spectral analysis on the optical data using Fourier transform analysis, performing statistical analysis on the optical data using statistical moments, performing wavelet analysis on the optical data using wavelet transform analysis, and determining the existence of a blowout precursor based on one or more of the raw data analysis, spectral analysis, statistical analysis, and wavelet analysis techniques.

Yet another embodiment of the present invention is a method for detecting blowout precursors in combustors that provides for receiving optical data measured by an optical measuring device associated with a combustor, performing raw data analysis on the optical data normalized by the mean of the optical data, and determining the existence of a blowout precursor based on the normalized optical data. The existence of a blowout precursor may be detected by monitoring a predefined change in the magnitude of the normalized optical data. A similar aspect of the present invention may divide the normalized optical data into a plurality of time segments and define a normalized optical data threshold. The existence of a blowout precursor may be detected by monitoring the number of instances in a given time segment that the normalized optical data exceeds the normalized optical data threshold. The existence of a blowout precursor also may be detected based on the total time in a given time segment that the normalized optical data exceeds the normalized optical data threshold.

Yet another embodiment of the present invention is a method for detecting blowout precursors in combustors that provides for receiving optical data measured by an optical device associated with a combustor, performing spectral analysis on the optical data using Fourier transform analysis, and determining the existence of a blowout precursor based on the spectral analysis. One aspect of the present invention provides for calculating a Fourier transform of at least part of the optical data, and calculating a power ratio of power in a frequency range normalized by total spectral power. The existence of a blowout precursor may be detected by monitoring a predefined change in the power ratio. A similar aspect of the present invention may calculate a ratio of power at a specific frequency normalized by total spectral power. The existence of a blowout precursor may be detected by monitoring a predefined change in that power ratio as well.

Another embodiment of the present invention includes a method for determining blowout precursors in combustors based on receiving optical data measured by an optical sensor in a combustor, performing statistical analysis on the optical data using statistical moments, and determining the existence of a blowout precursor based on the statistical analysis. The statistical analysis can also be performed on at least a part of the optical data. Another aspect of the method includes determining the existence of a blowout precursor based on a predefined change in a magnitude of the statistical moment. Yet another aspect of the method provides for calculating a variance of the statistical moment of the optical data. The variance may be monitored for predefined changes to determine blowout precursors. Another aspect of this method provides for dividing the statistical moment optical data into a plurality of time segments and defining a statistical moment threshold. The existence of a blowout precursor may be detected based on a number of instances in a given time segment that the statistical moment exceeds the statistical moment threshold and also based on a total time in a given time segment that the statistical moment exceeds the statistical moment threshold.

Yet another embodiment of the present invention provides for a method of determining blowout precursors in combustors based on receiving optical data measured by an optical device associated with the combustor, performing wavelet analysis on the optical data, and determining the existence of a blowout precursor from the results of the wavelet analysis. The method further provides defining a root mean square of the wavelet transform and calculating a ratio of the root mean square of the wavelet transform of the optical data to the mean of the optical data. Determination of the existence of a blowout precursor may be based on a predefined change in the ratio.

Further aspects of the method may include determining the existence of a blowout precursor based on a number of instances in a given time segment that the wavelet transform of the optical data exceeds a threshold or based on a total time in a given time segment that the wavelet transform of the optical data exceeds the wavelet transform threshold.

This method may further include computing statistical moment data from the wavelet transform of the optical data. Determination of the existence of blowout precursors may be based on a predefined change in magnitude of the statistical moment data.

The method also may include dividing the optical data into time segments and calculating a variance of the statistical moment of each segment. A predefined change in the variance may indicate blowout conditions.

Another aspect of the present invention is a method for detecting blowout precursors in combustors including the steps of receiving optical data measured by an optical measuring device associated with the combustor, performing raw data analysis on the optical data normalized by the mean of the optical data, performing spectral analysis on the optical data using Fourier transform analysis, performing statistical analysis on the optical data using statistical moments, performing wavelet analysis on the optical data using wavelet transform analysis, receiving pressure data measured by an acoustic pressure device associated with the combustor, performing spectral analysis on the pressure data using Fourier transform analysis, performing statistical analysis on the pressure data using statistical moments, performing wavelet analysis on the pressure data using wavelet transform analysis, and determining the existence of a blowout precursor based on one or more of the raw data analysis of the optical data, spectral analysis of the optical data, statistical analysis of the optical data, wavelet analysis of the optical data, spectral analysis of the pressure data, statistical analysis of the pressure data, and wavelet analysis of the pressure data.

Yet another embodiment of the present invention is a method of controlling a combustor based on at least one combustor condition including the steps of acquiring at least one combustion condition from the combustor, wherein the combustor includes a fuel-air intake, determining the existence of a blowout precursor event based on the at least one combustor condition; and increasing the fuel flow in the fuel-air intake of the combustor in response to the identification of the existence of a blowout precursor event. The method may use combustor conditions including an acoustic pressure signal, an optical signal, or both. The method may further decrease the fuel flow in the fuel-air intake of the combustor in response to not identifying the existence of a blowout precursor event.

Another method of controlling a combustor based on at least one combustor condition includes the steps of acquiring the at least one combustor condition from the combustor, wherein the combustor includes a fuel-air intake and a pilot fuel intake, determining the existence of a blowout precursor event based on the at least one combustor condition increasing a fuel flow in the pilot fuel intake of the combustor in response to the identification of the existence of a blowout precursor event, and decreasing the fuel flow in the fuel-air intake equal to the increase in the fuel flow in the pilot fuel intake. The method may use combustor conditions including an acoustic pressure signal, an optical signal, or both. The method of may further include the steps of decreasing the fuel flow in the pilot fuel intake of the combustor in response to not identifying the existence of a blowout precursor event, and increasing the fuel flow in the fuel-air intake equal to the decrease in the fuel flow in the pilot fuel intake.

Yet another method for detecting blowout precursors in combustors includes the steps of receiving combustion data measured by a combustor measuring device associated with the combustor, wherein the combustion data is used to indicate flame blowout conditions, performing analysis on the combustion data from the group of analysis techniques consisting of raw data analysis on the combustion data normalized by the mean of the combustion data, spectral analysis on the combustion data using Fourier transform analysis, statistical analysis on the combustion data using statistical moments, wavelet analysis on the optical data using wavelet transform analysis, and determining the existence of a blowout precursor based on one or more of the raw data analysis, spectral analysis, statistical analysis, and wavelet analysis.

BRIEF DESCRIPTION OF DRAWINGS

Figure 1:
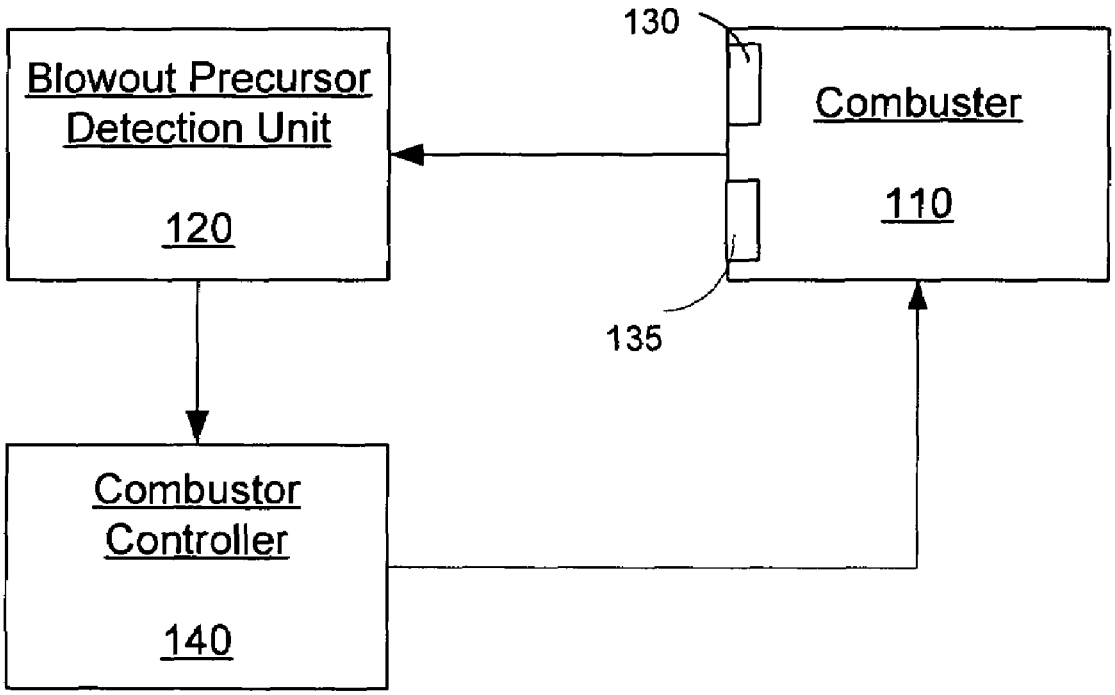

Having thus described the invention in general terms, reference will now be made to the accompanying drawings, which are not necessarily drawn to scale, and wherein:

FIG. 1 is a block diagram illustrating the basic components of the blowout precursor detection and active control system.

Figure 2:
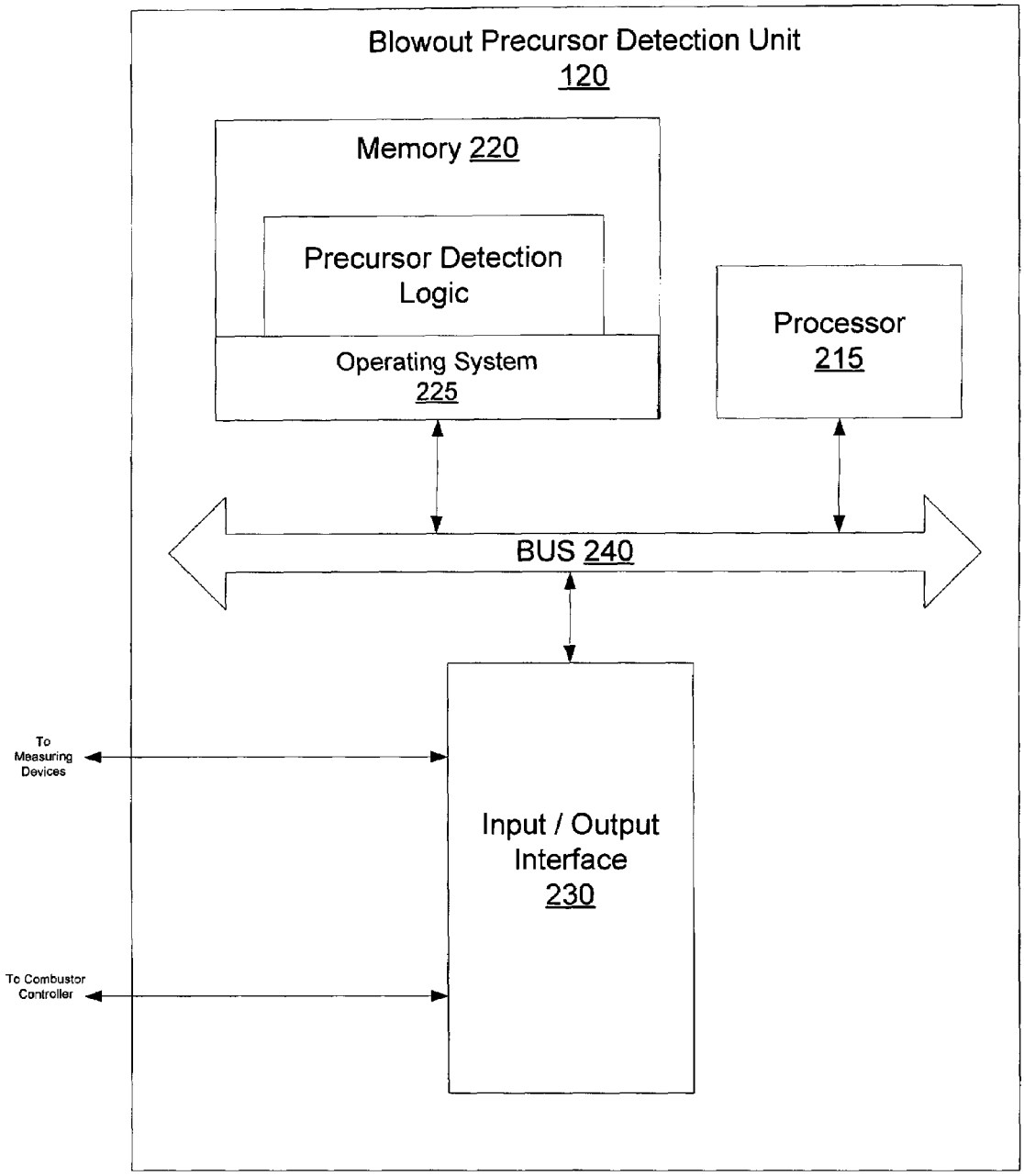

FIG. 2 is a block diagram illustrating the basic components of the blowout precursor detection unit.

Figure 3:
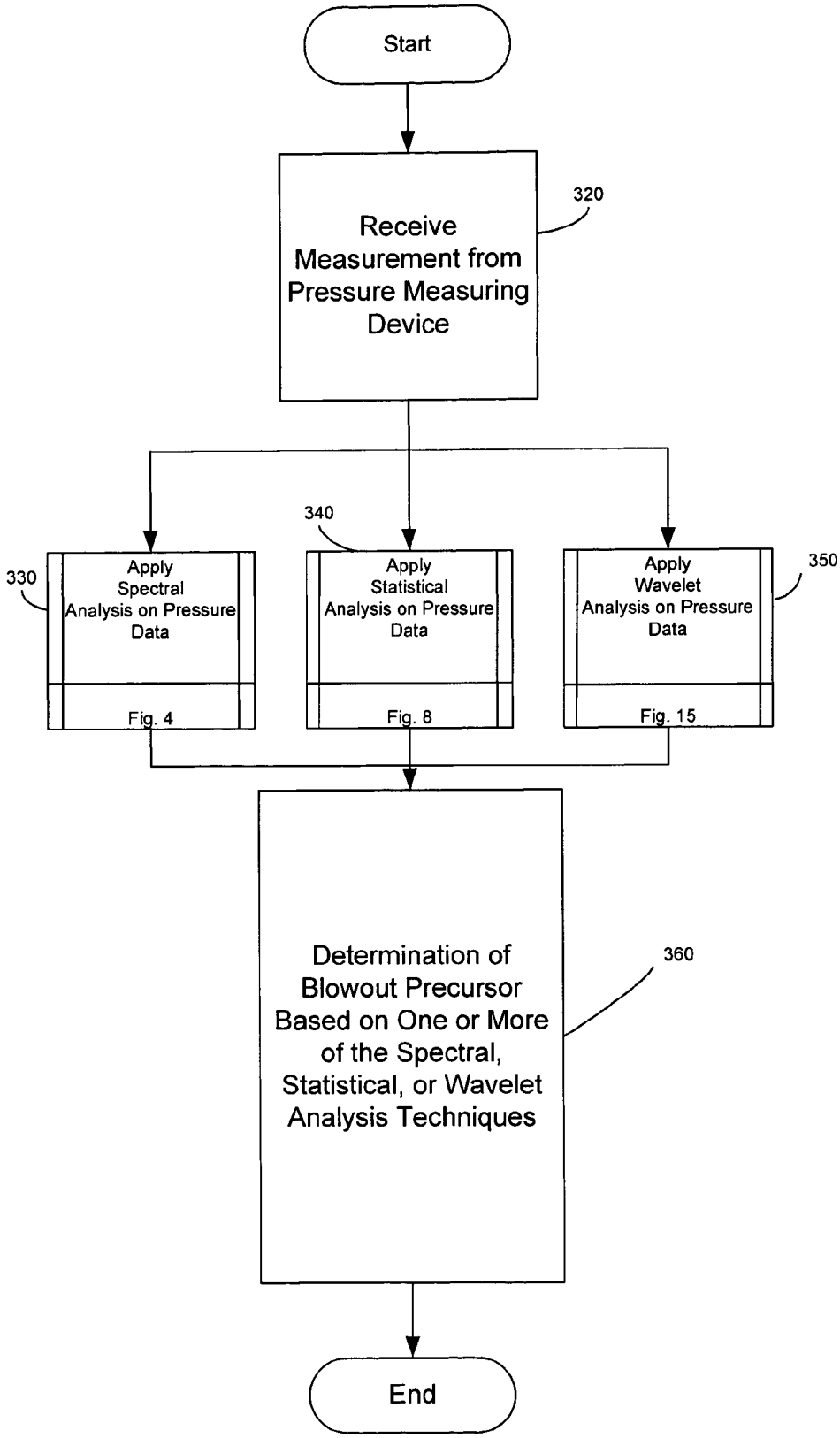

FIG. 3 is a block diagram of a method of detecting blowout precursors, according to one aspect of the present invention.

Figure 4:
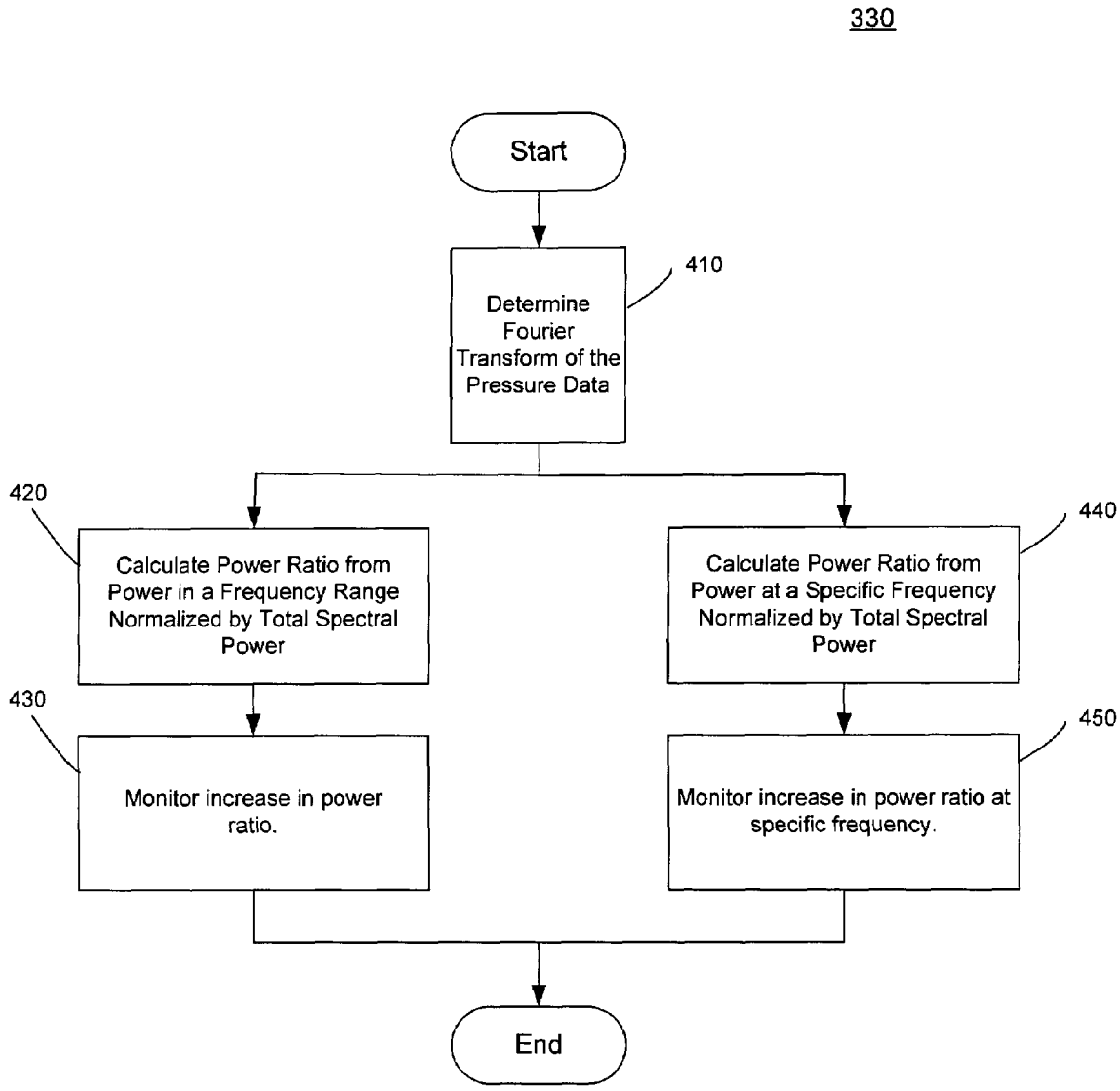

FIG. 4 is a block diagram of a method of detecting blowout precursors using spectral analysis, according to one aspect of the present invention.

Figure 5:
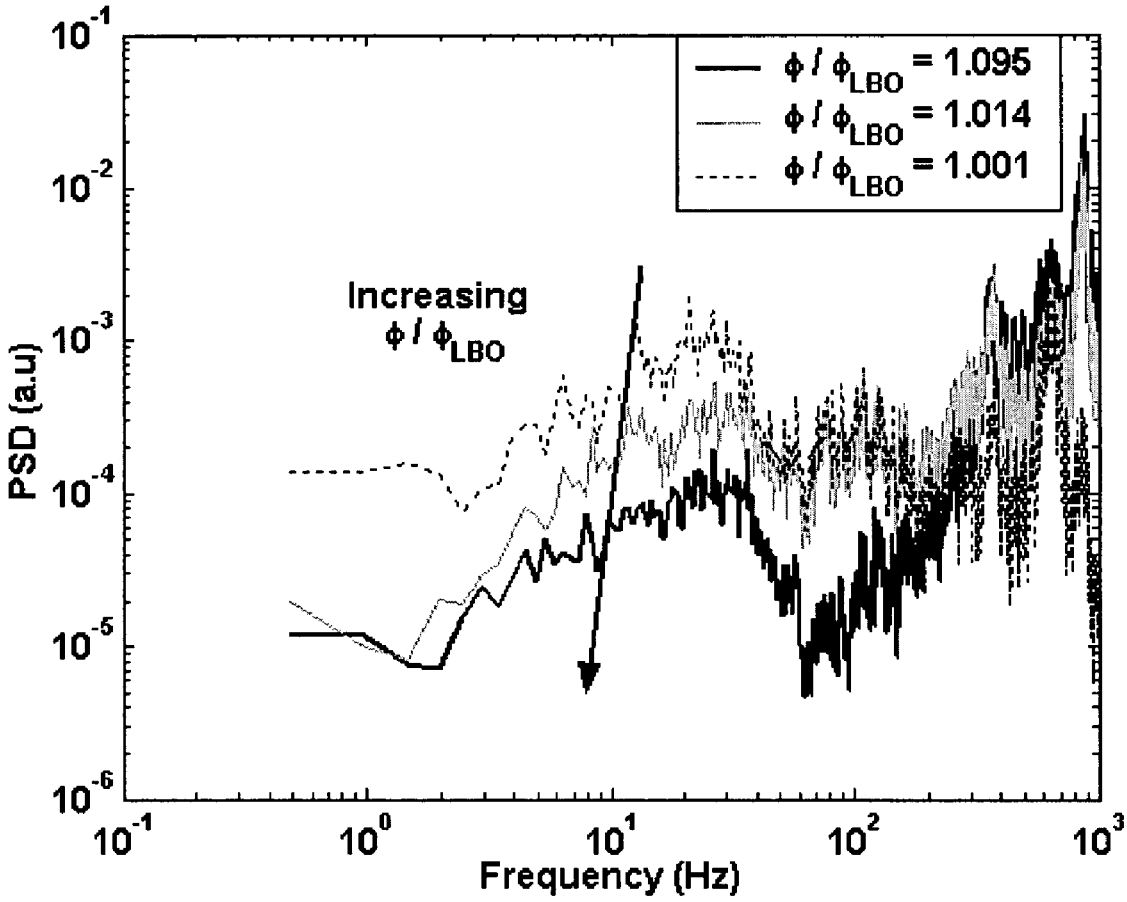

FIG. 5 is a plot of Fourier Transformed pressure data.

Figure 6:
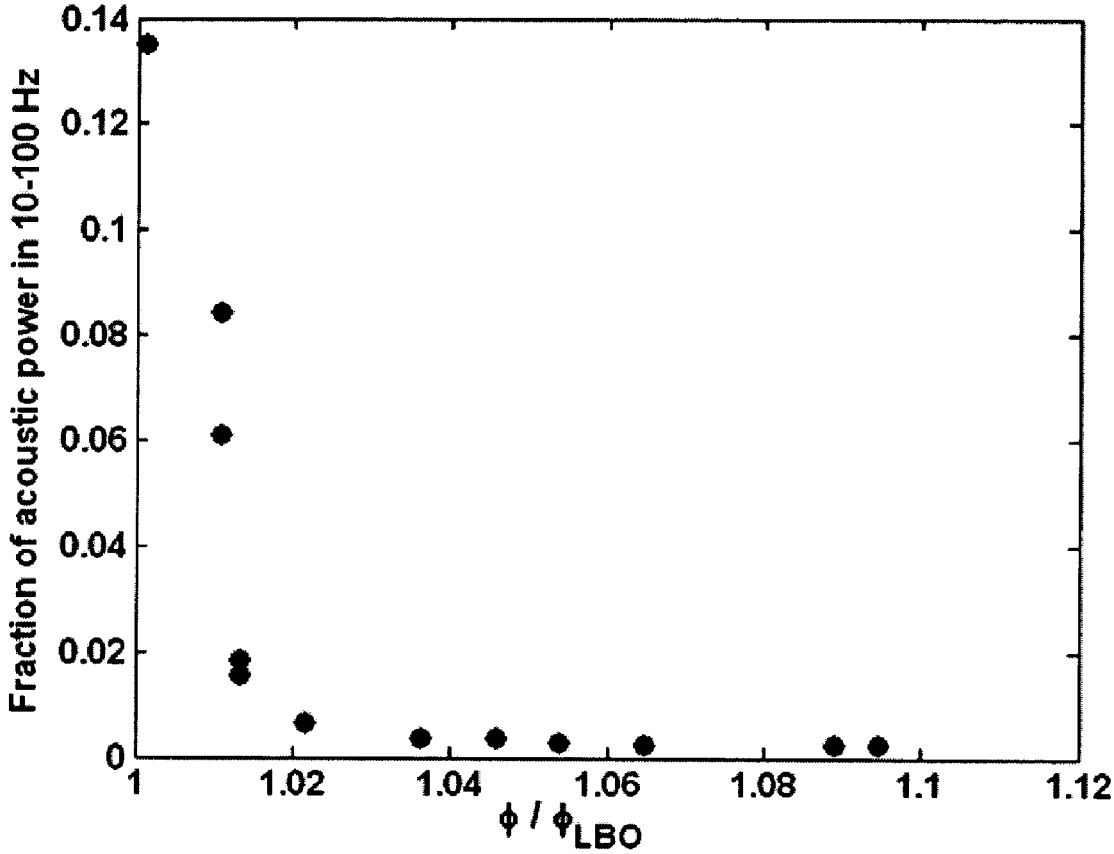

FIG. 6 is a plot of Fourier Transformed pressure data as analyzed in the first sub-method of the spectral analysis.

Figure 7:
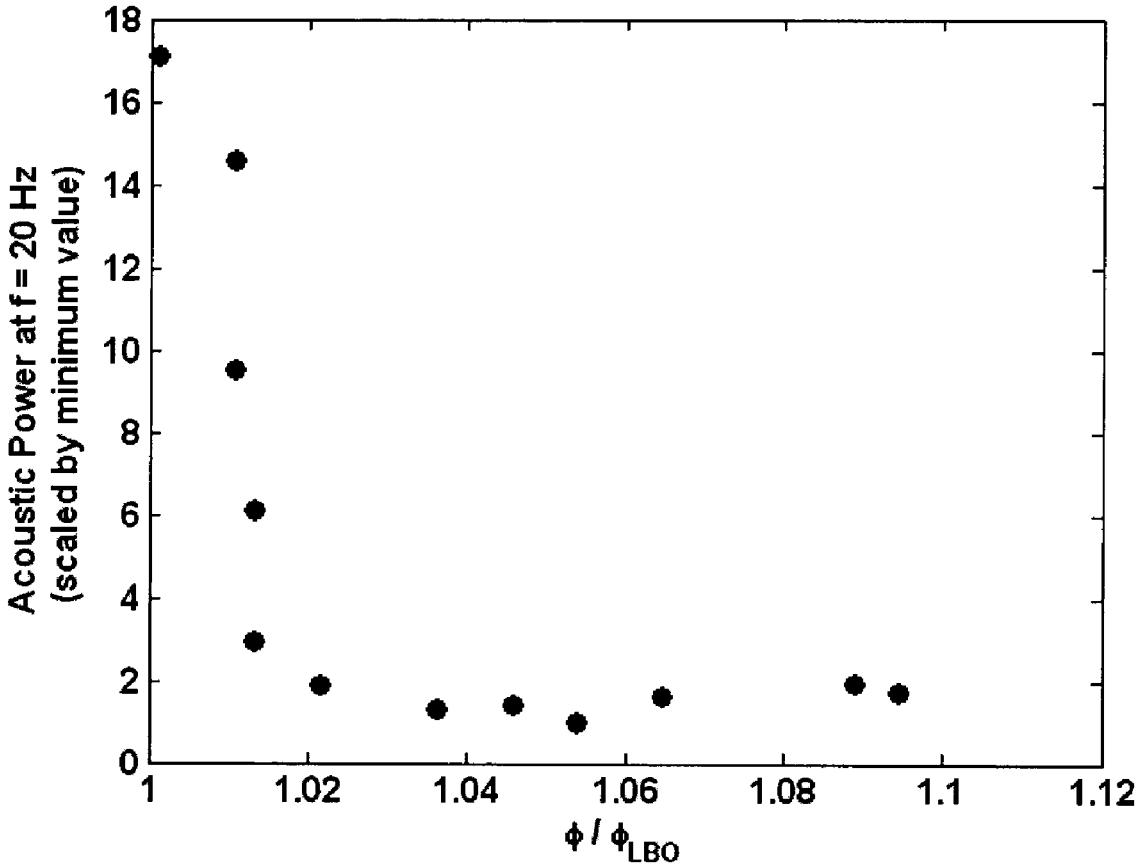

FIG. 7 is a plot of Fourier Transformed pressure data as analyzed in the second sub-method of the spectral analysis.

Figure 8:
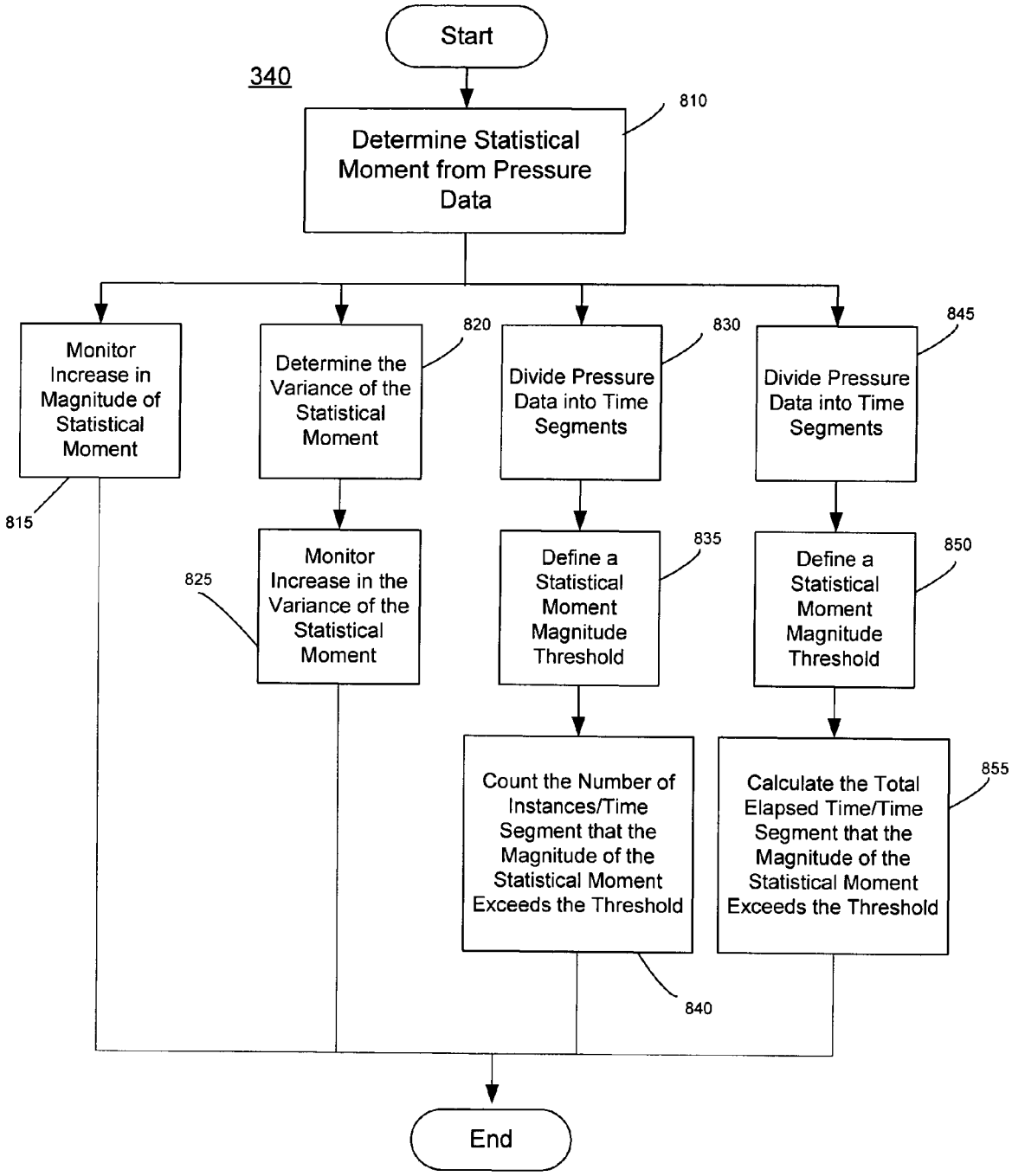

FIG. 8 is a block diagram of a method of detecting blowout precursors using statistical analysis, according to one aspect of the present invention.

Figure 9:
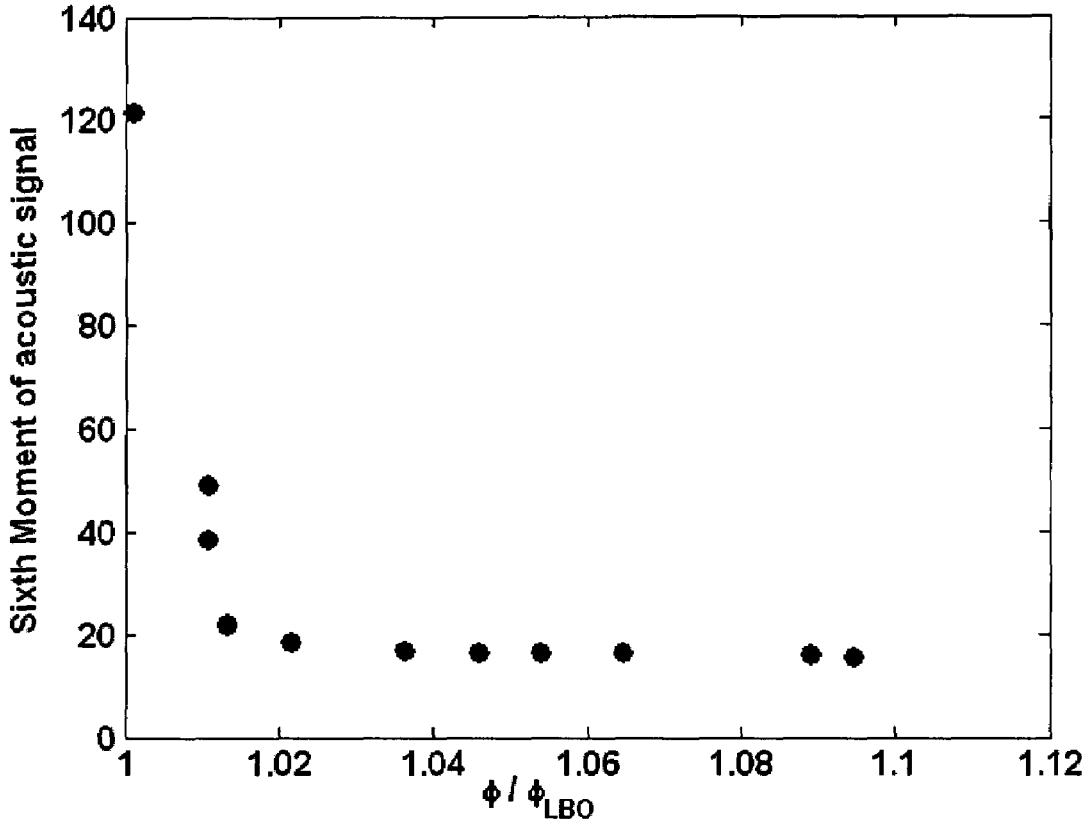

FIG. 9 is a plot of the $6^{th}$ statistical moment of the pressure data.

Figure 10:
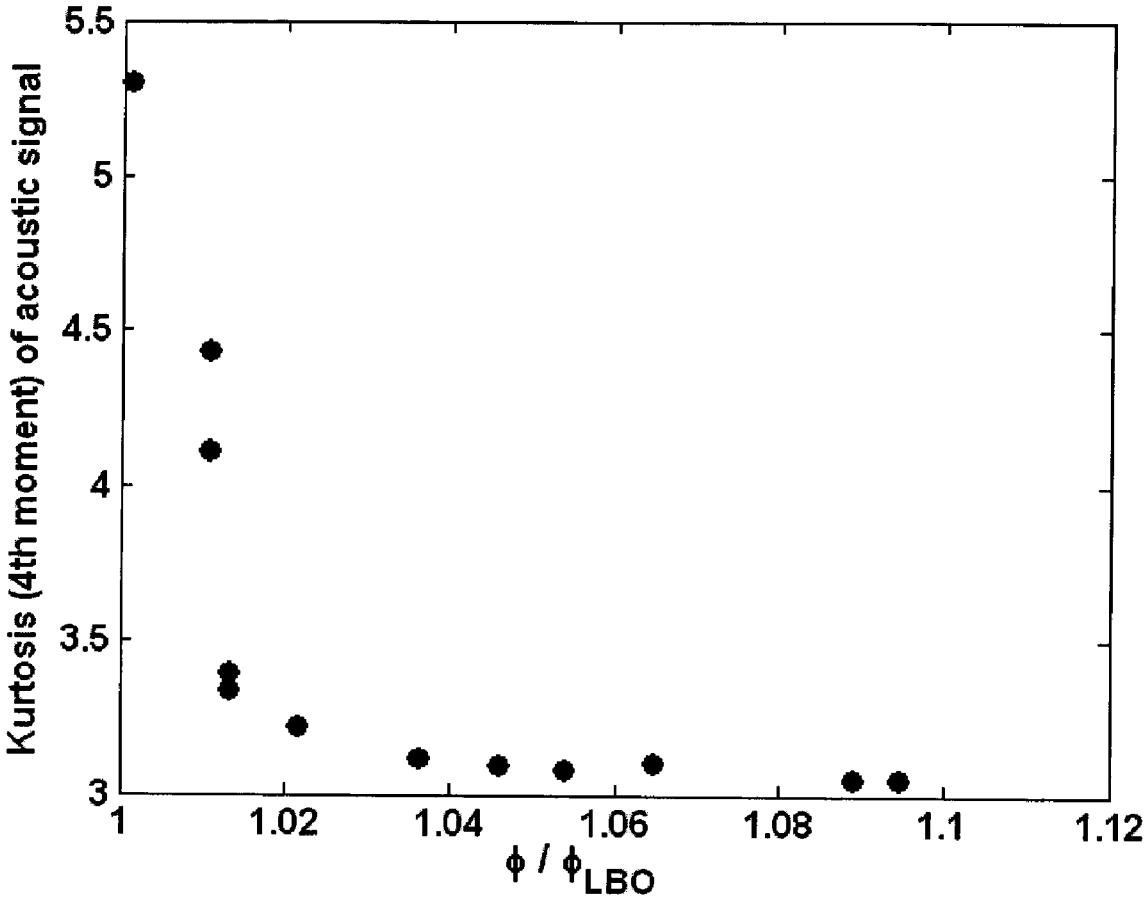

FIG. 10 is a plot of the statistical moment of the pressure data as analyzed in the first sub-method of the statistical analysis.

Figure 11:
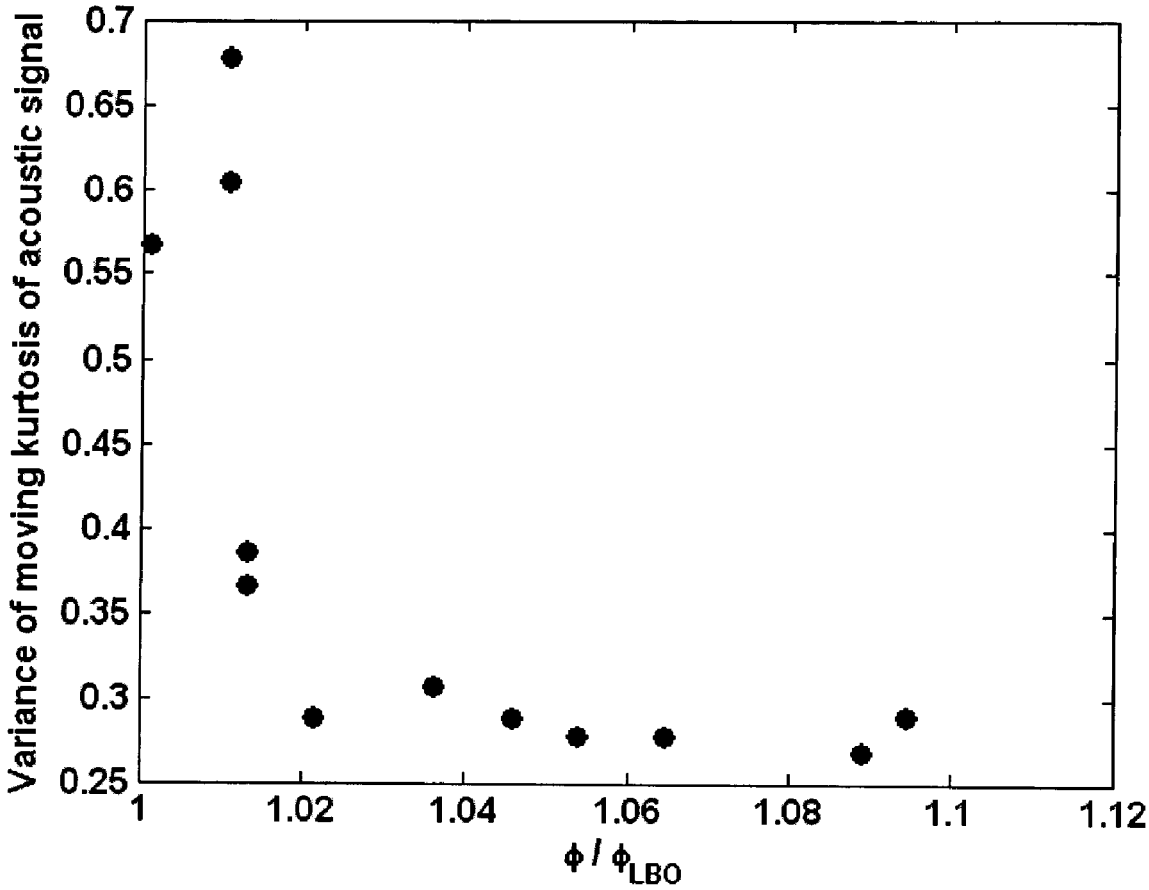

FIG. 11 is a plot of the statistical moment of the pressure data as analyzed in the second sub-method of the statistical analysis.

Figure 12:
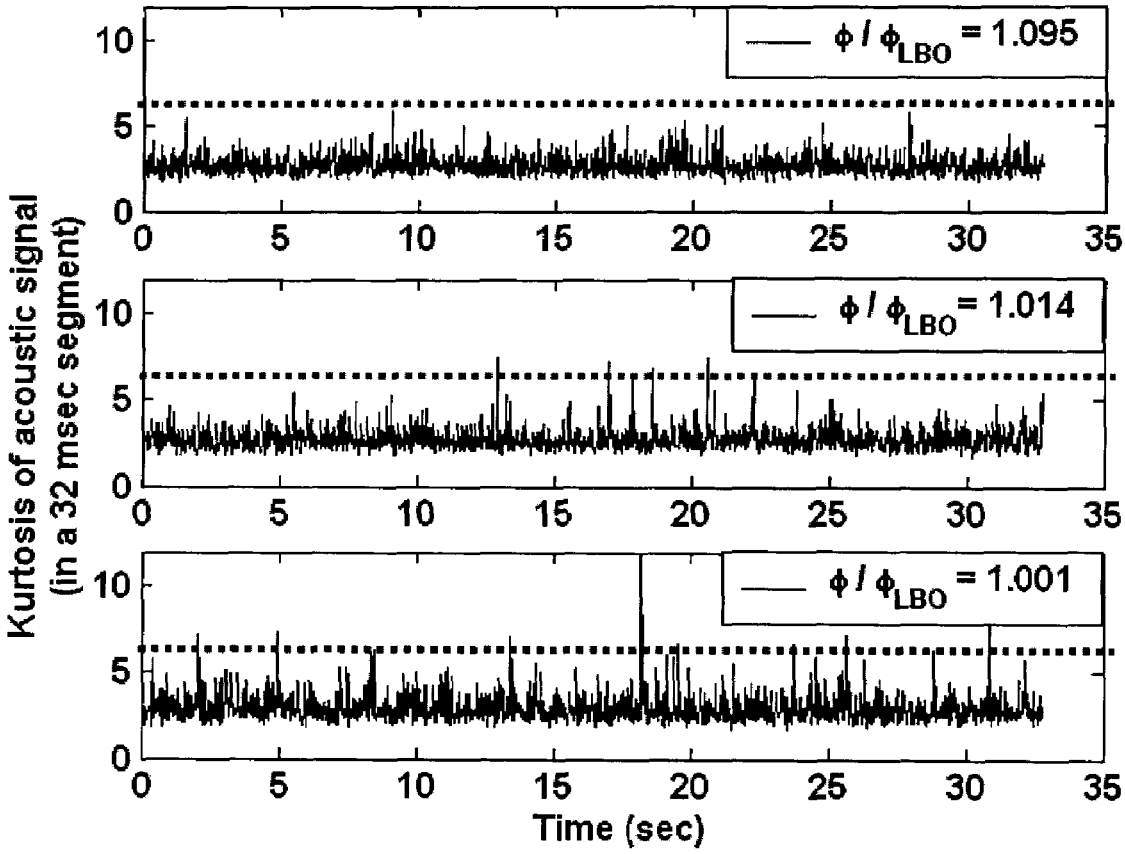

FIG. 12 is a plot of the statistical moment of the pressure data as analyzed in the third sub-method of the statistical analysis.

Figure 13:
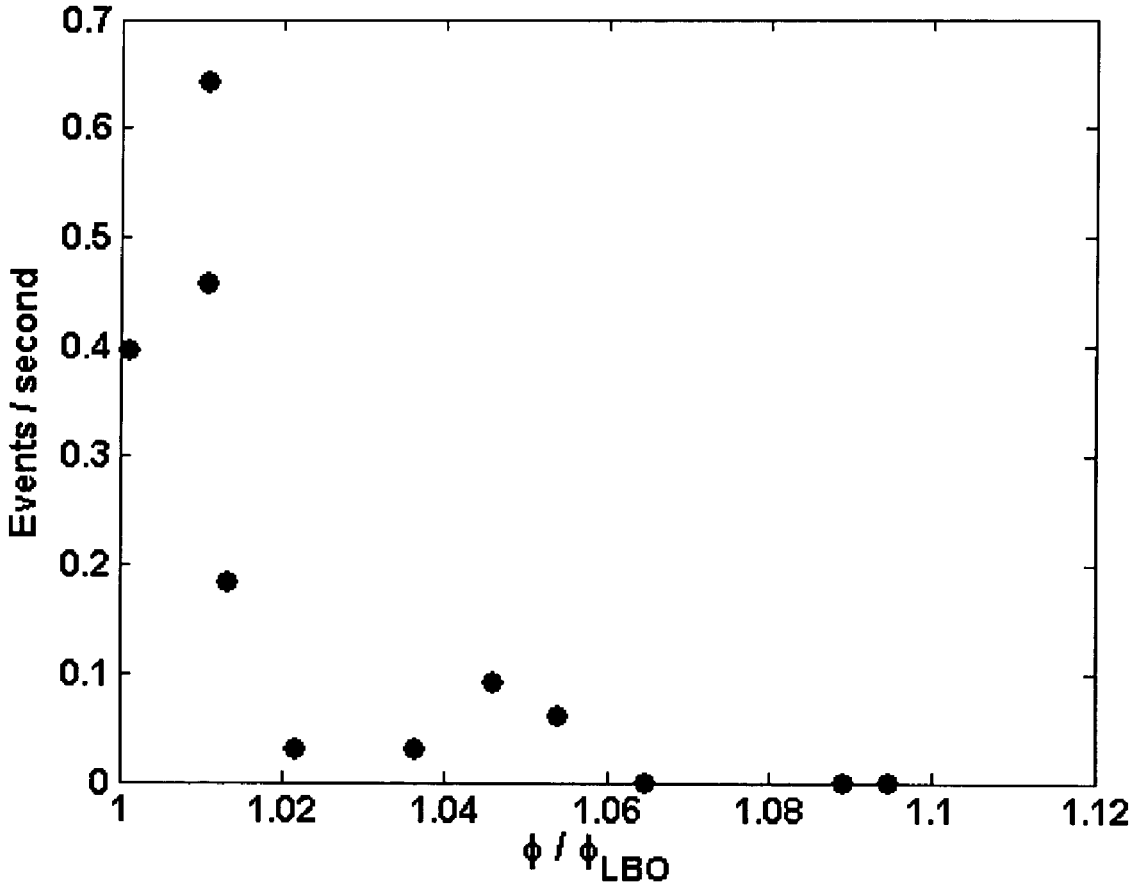

FIG. 13 is a plot of the statistical moment of the pressure data as analyzed in the third sub-method of the statistical analysis.

Figure 14:
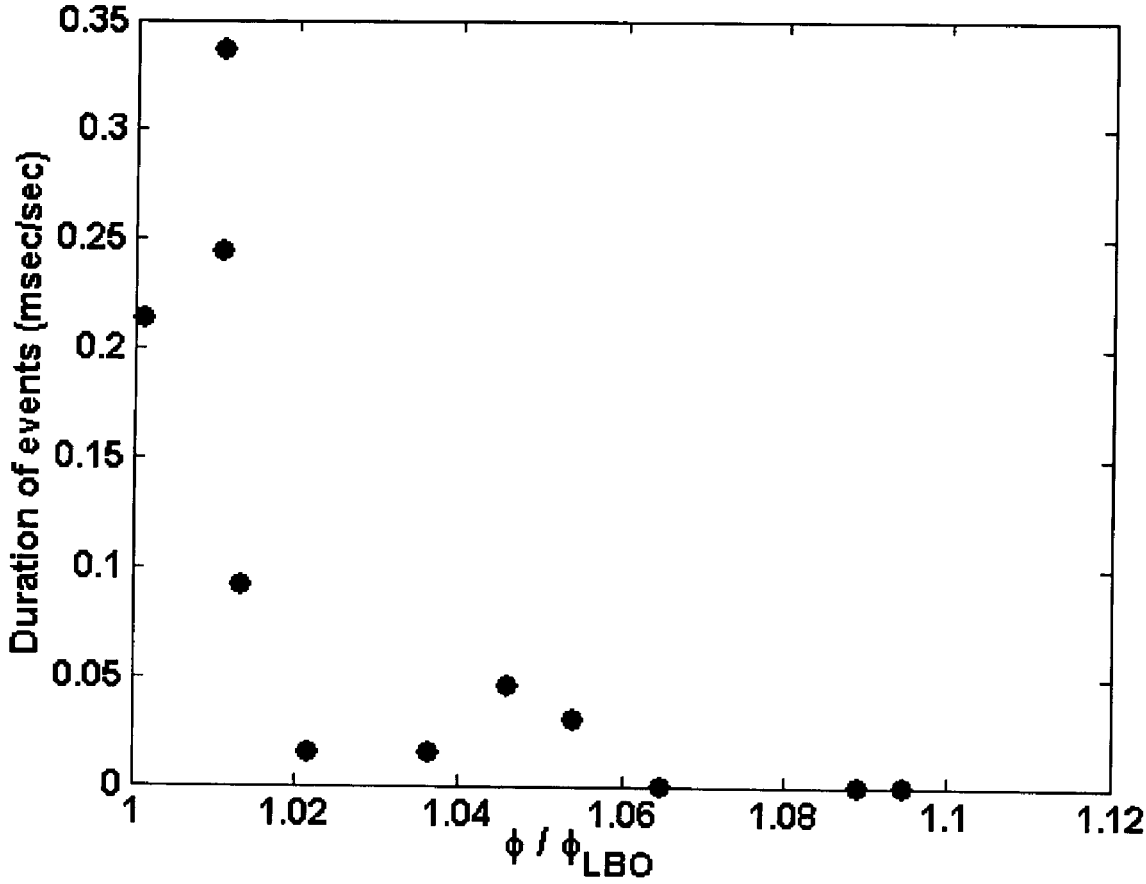

FIG. 14 is a plot of the statistical moment of the pressure data as analyzed in the fourth sub-method of the statistical analysis.

Figure 15:
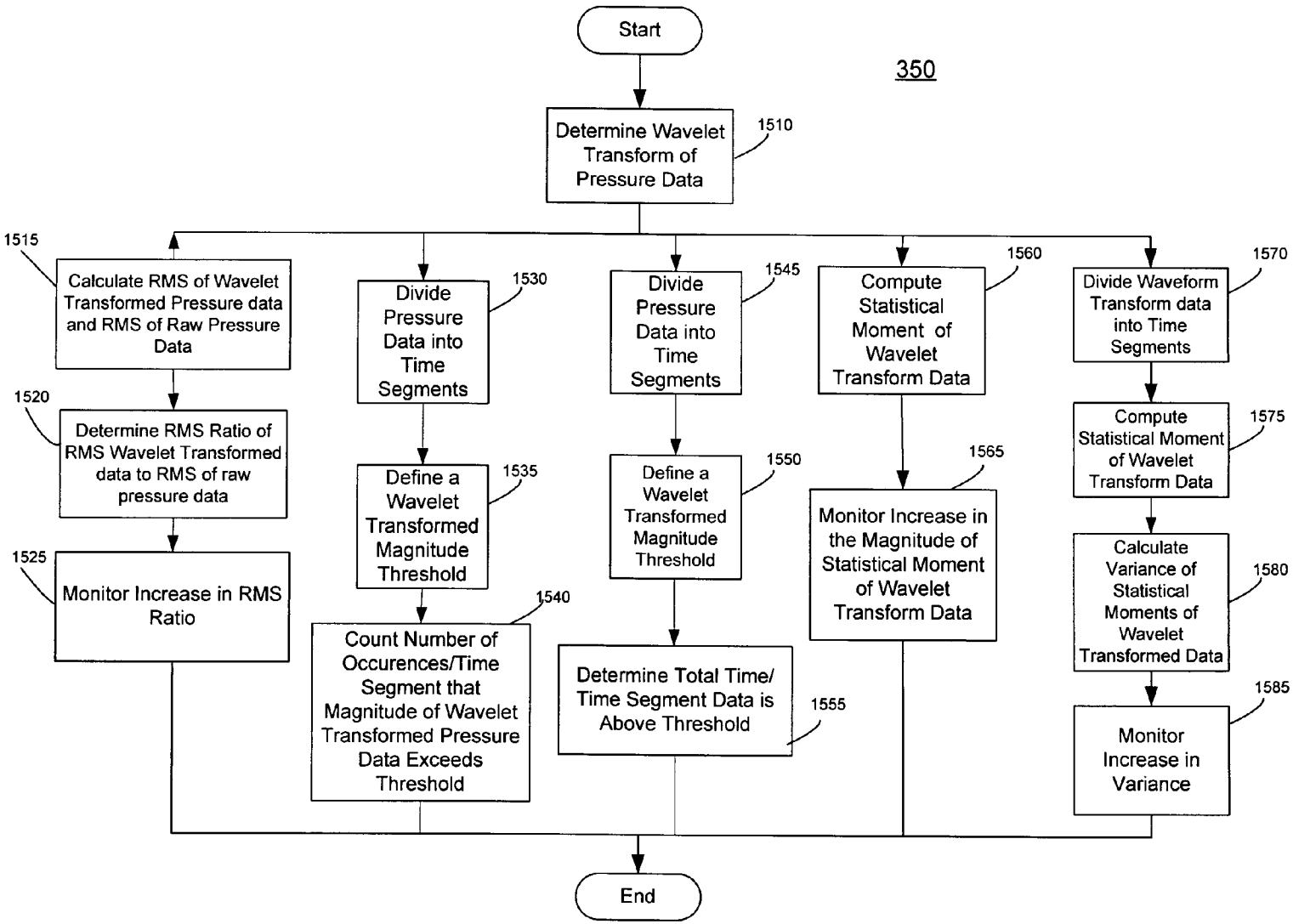

FIG. 15 is a block diagram of a method of detecting blowout precursors using wavelet analysis, according to one aspect of the present invention.

Figure 16:
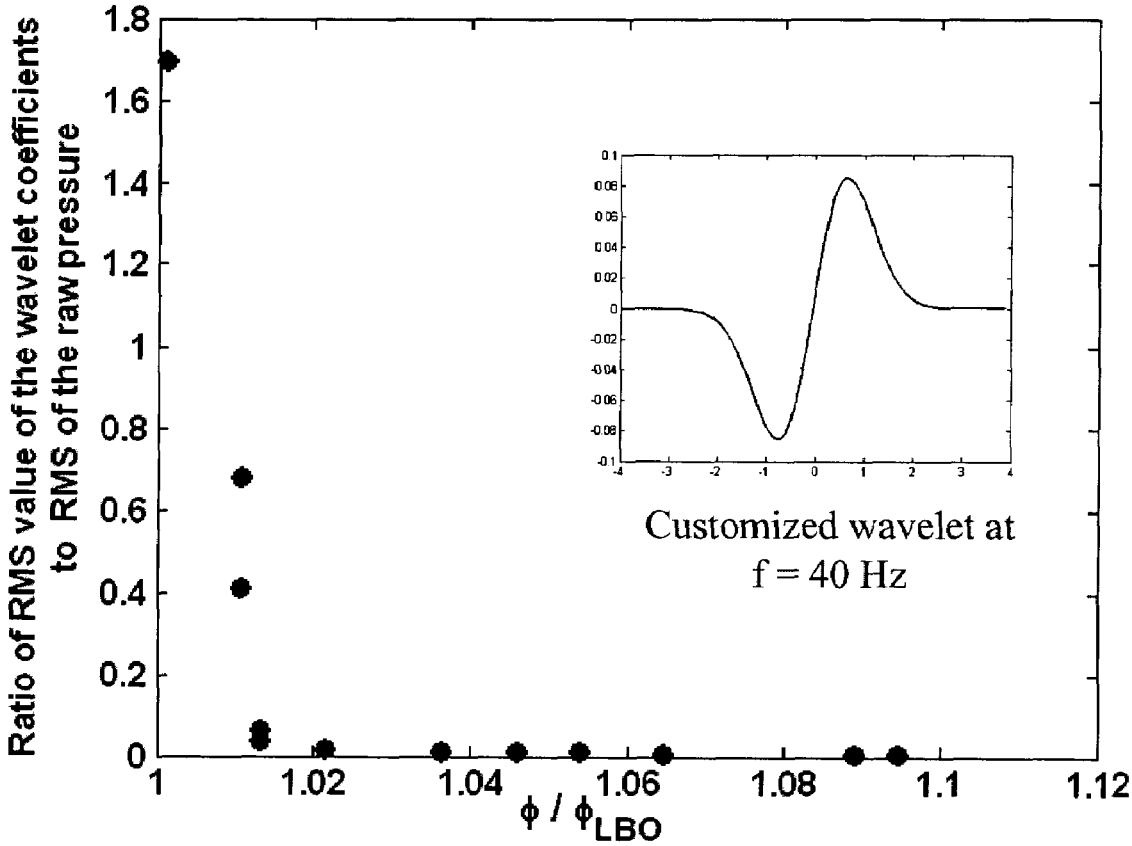

FIG. 16 is a plot of the RMS ratio of the pressure data as analyzed in the first sub-method of the wavelet analysis, according to one aspect of the present invention.

Figure 17:
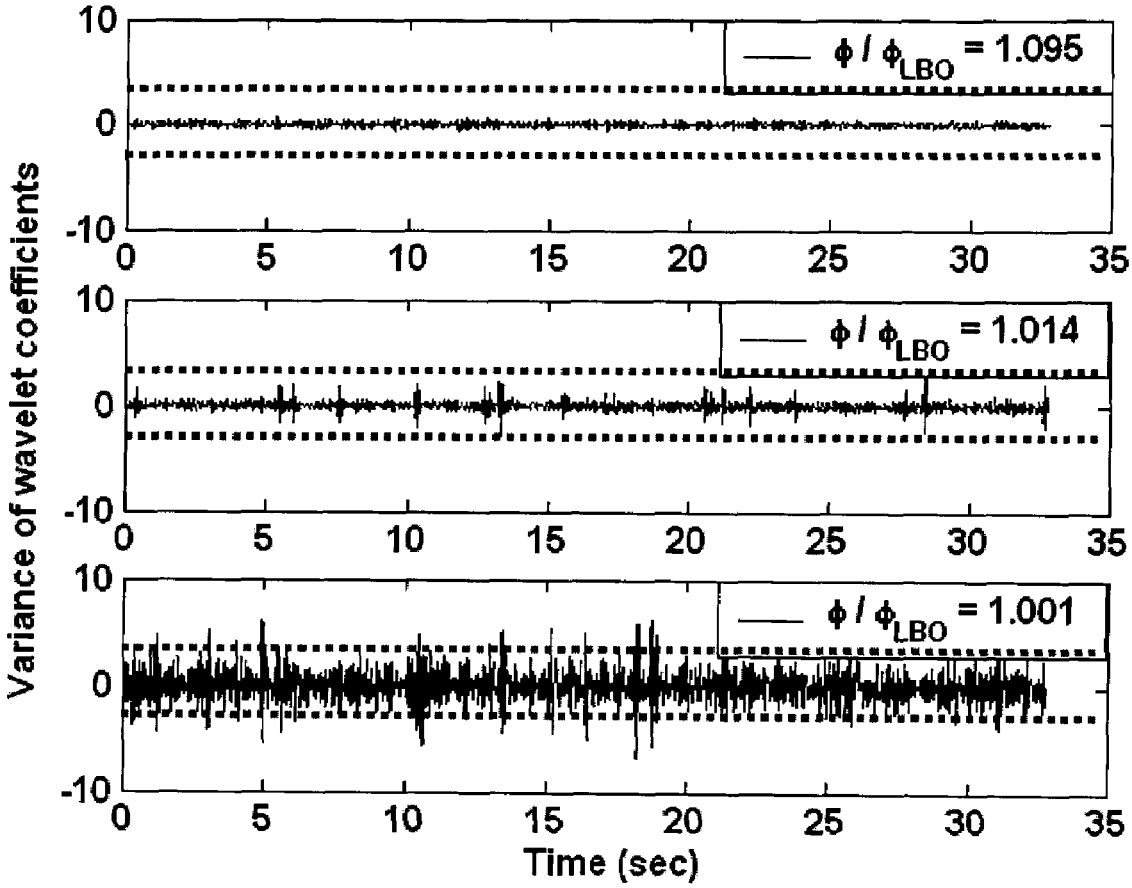

FIG. 17 is a plot of the magnitude of the wavelet transformed pressure data as analyzed in the second sub-method of the wavelet analysis, according to one aspect of the present invention.

Figure 18:
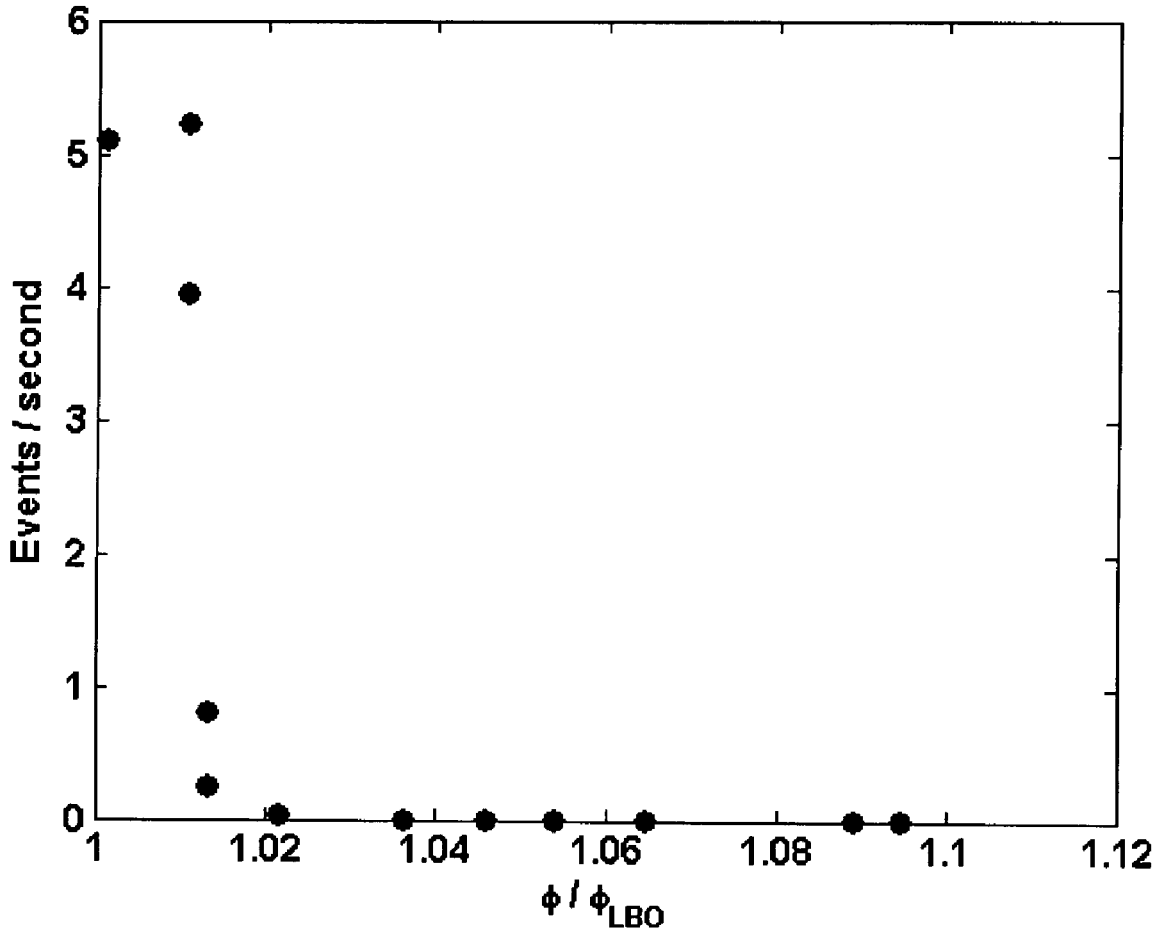

FIG. 18 is a plot of the magnitude of the wavelet transformed pressure data as analyzed in the second sub-method of the wavelet analysis, according to one aspect of the present invention.

Figure 19:
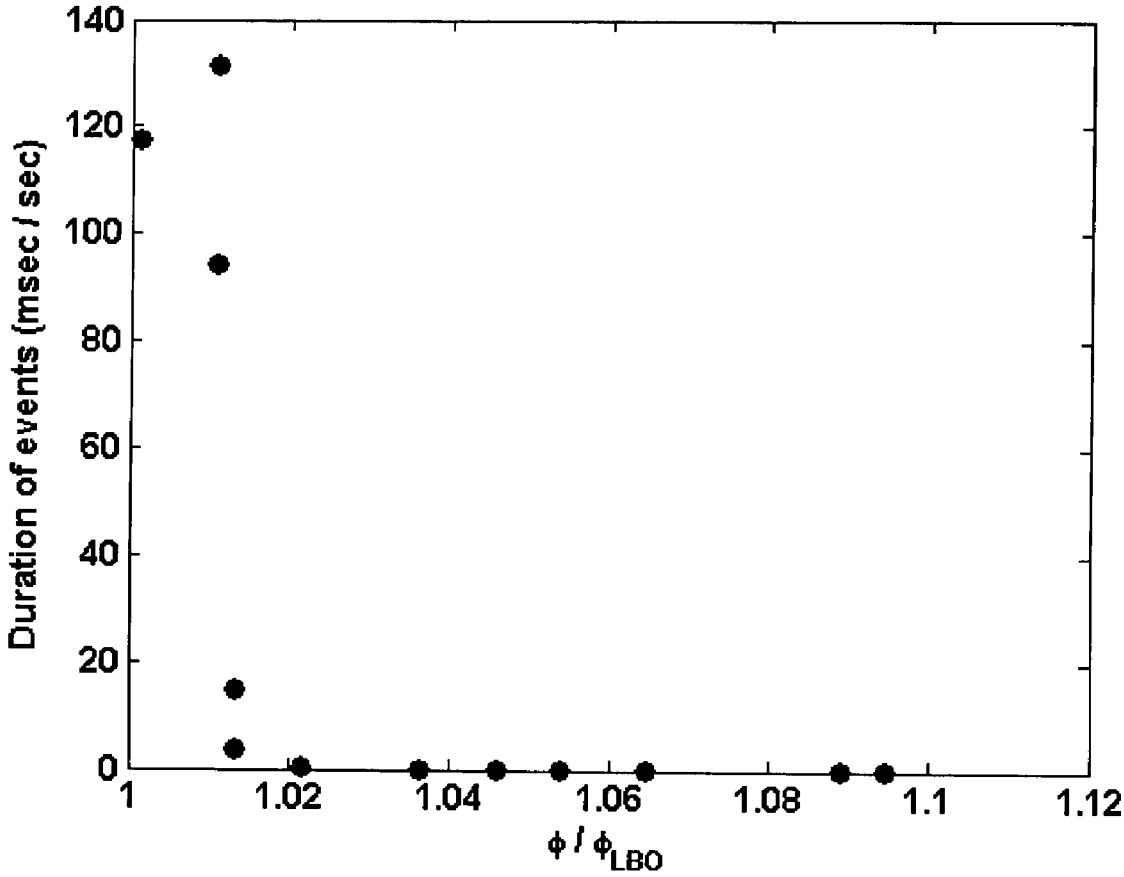

FIG. 19 is a plot of the magnitude of the wavelet transformed pressure data as analyzed in the third sub-method of the wavelet analysis, according to one aspect of the present invention.

Figure 20:
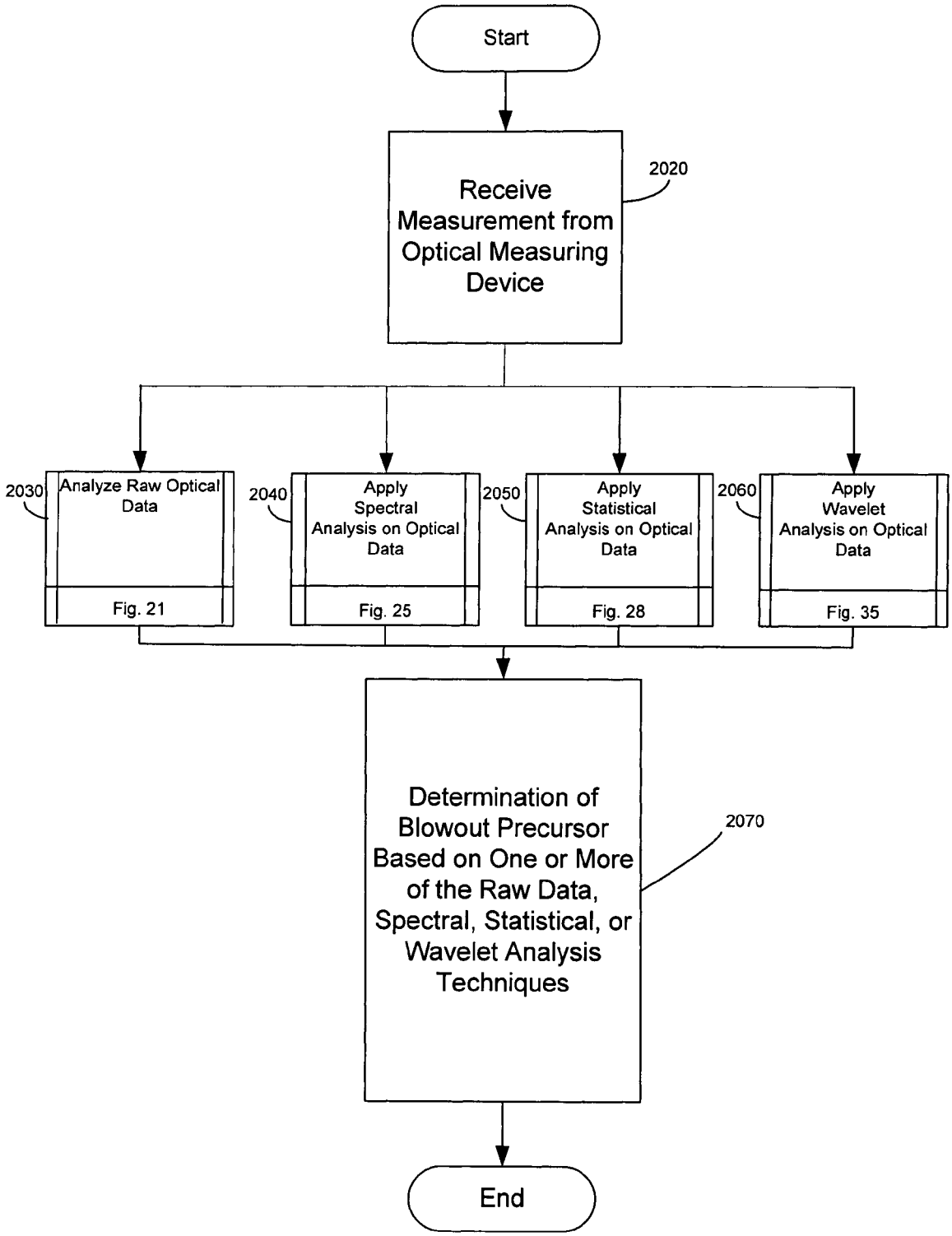

FIG. 20 is a block diagram of a method of detecting blowout precursors, according to one aspect of the present invention.

Figure 21:
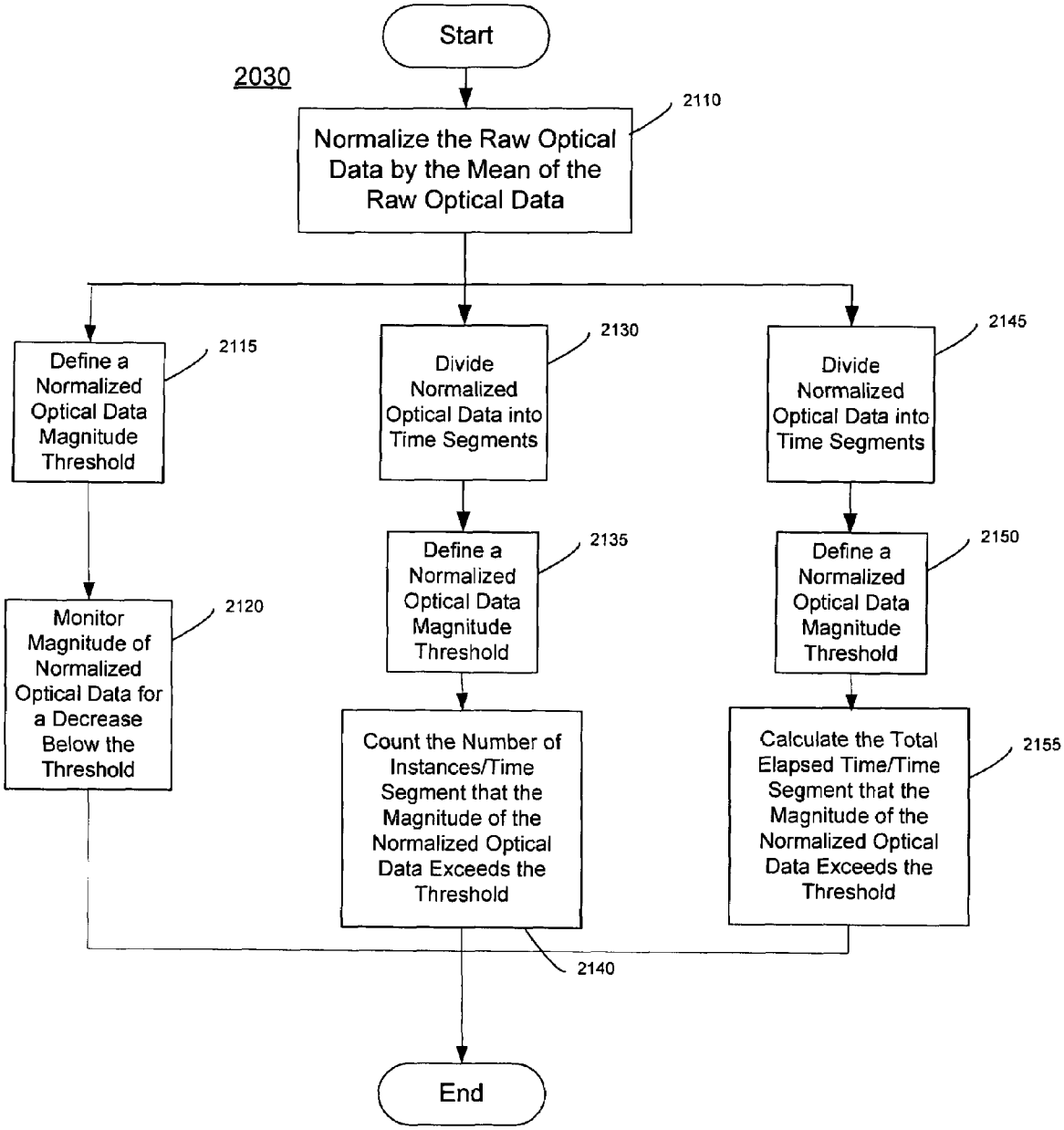

FIG. 21 is a block diagram of a method of detecting blowout precursors using raw data analysis, according to one aspect of the present invention.

Figure 22:
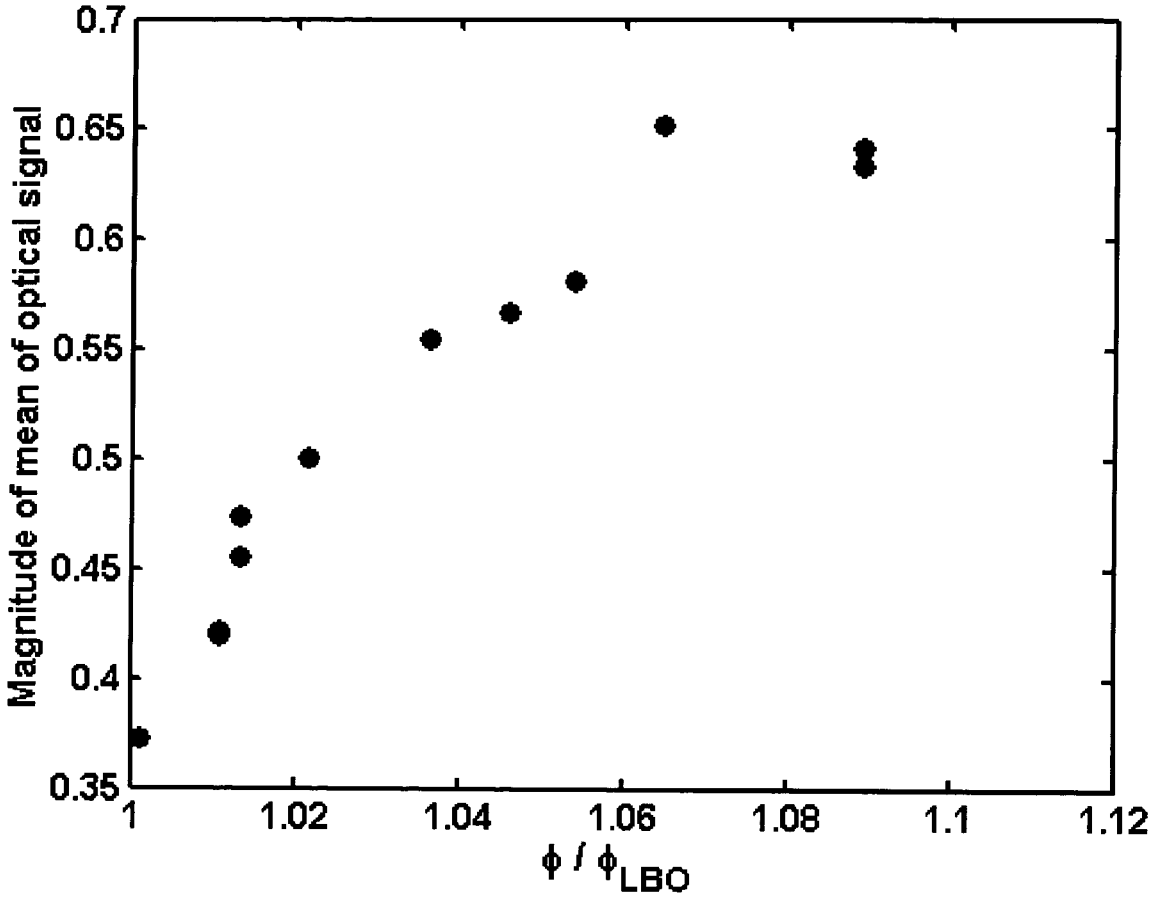

FIG. 22 is a plot of the raw optical data as analyzed in the first sub-method of the raw data analysis.

Figure 23:
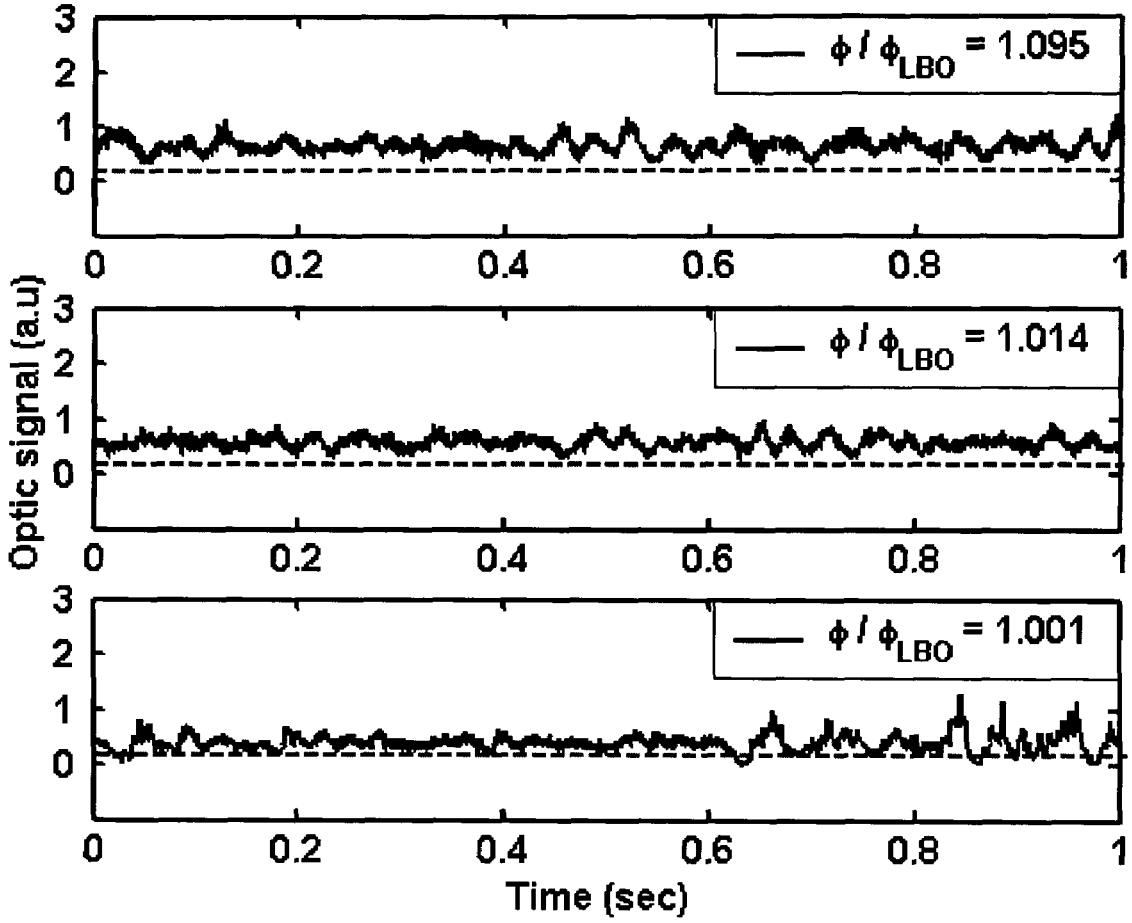

FIG. 23 is a plot of the raw optical data as analyzed in the second sub-method of the raw data analysis.

Figure 24:
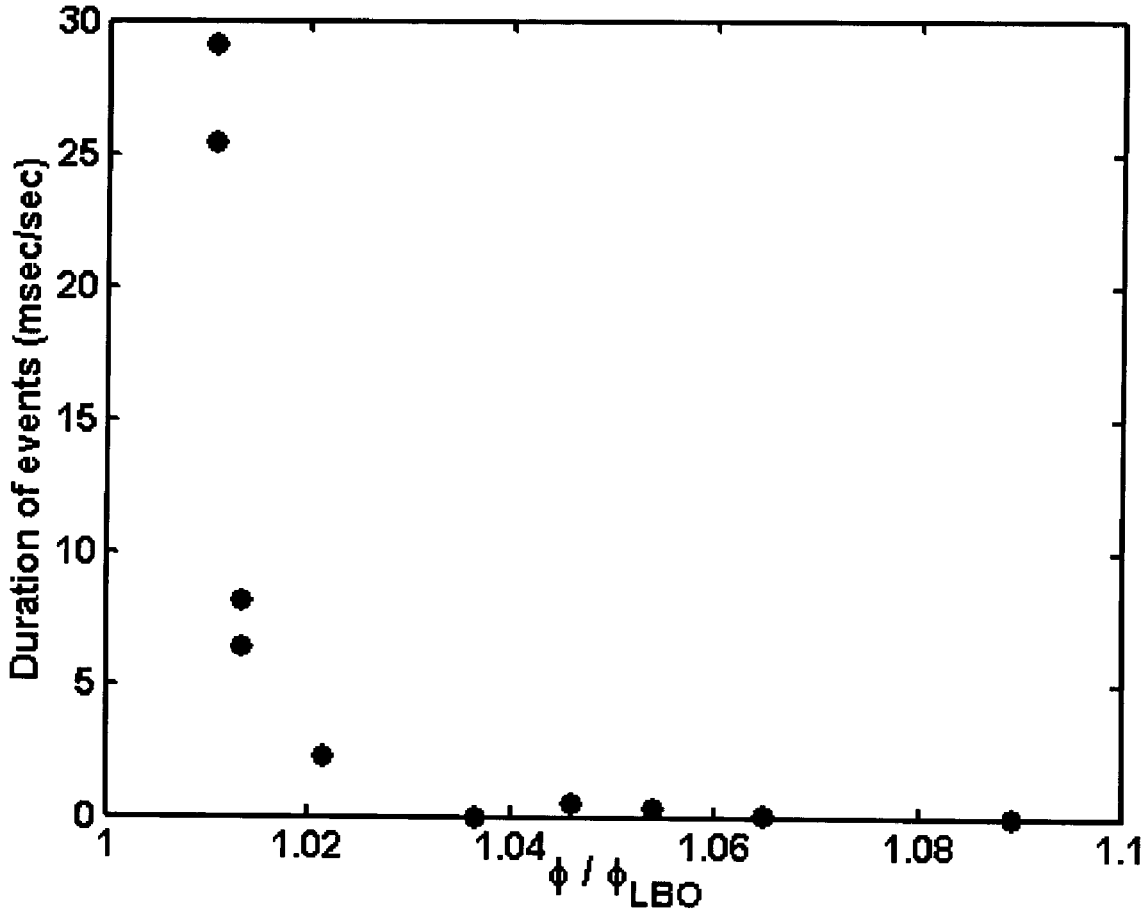

FIG. 24 is a plot of the raw optical data as analyzed in the third sub-method of the raw data analysis.

Figure 25:
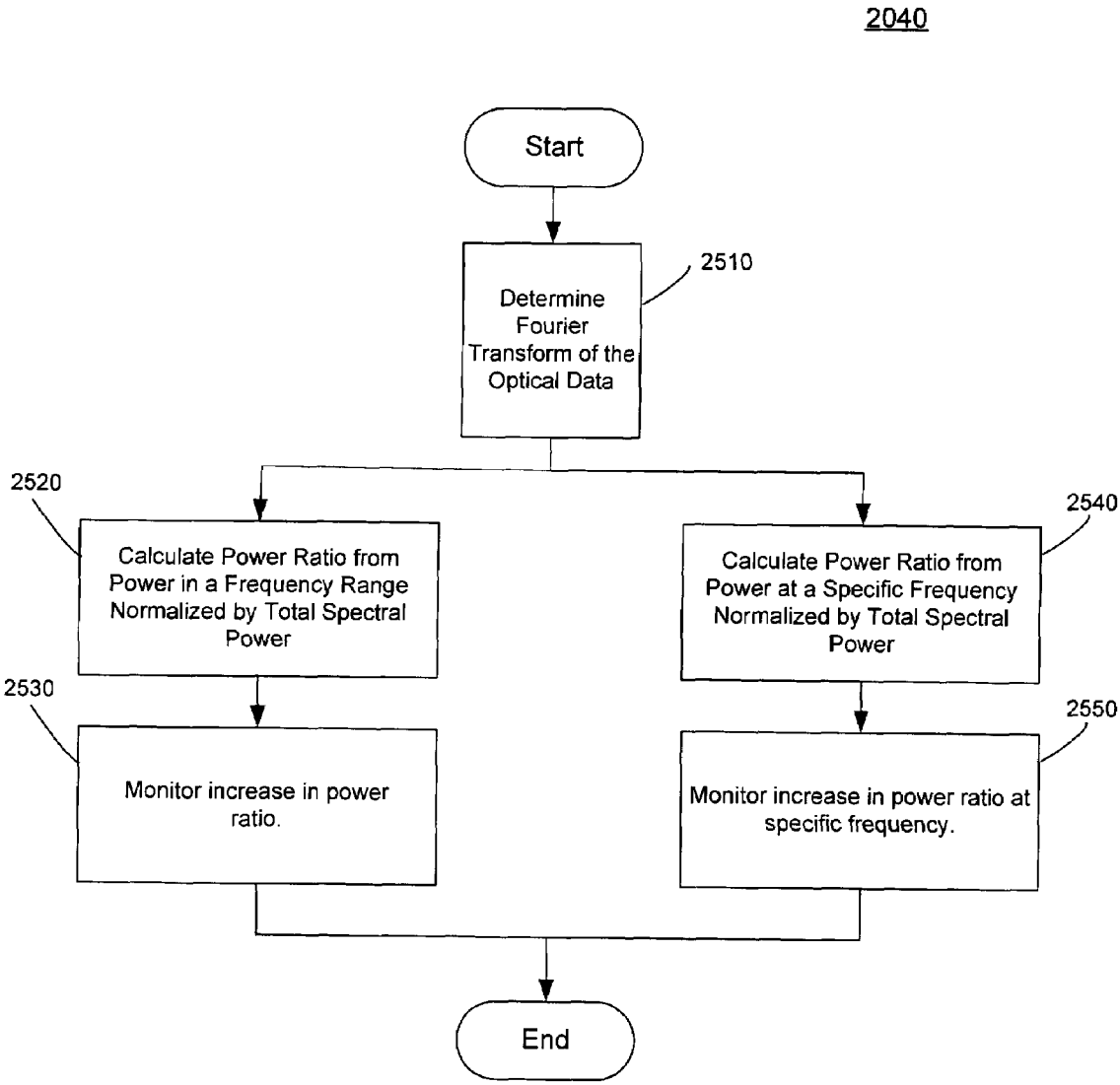

FIG. 25 is a block diagram of a method of detecting blowout precursors using spectral analysis on the optical data, according to one aspect of the present invention.

Figure 26:
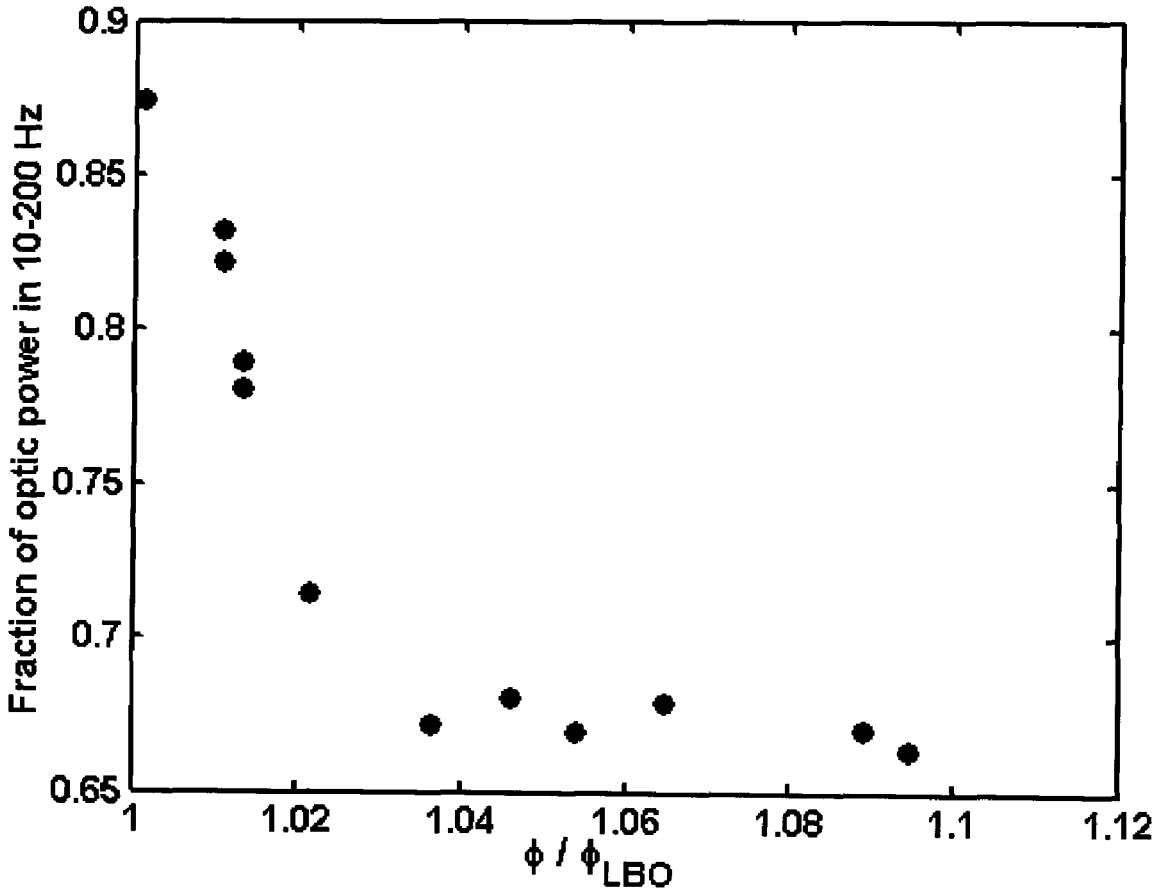

FIG. 26 is a plot of Fourier Transformed optical data as analyzed in the first sub-method of the spectral analysis.

Figure 27:
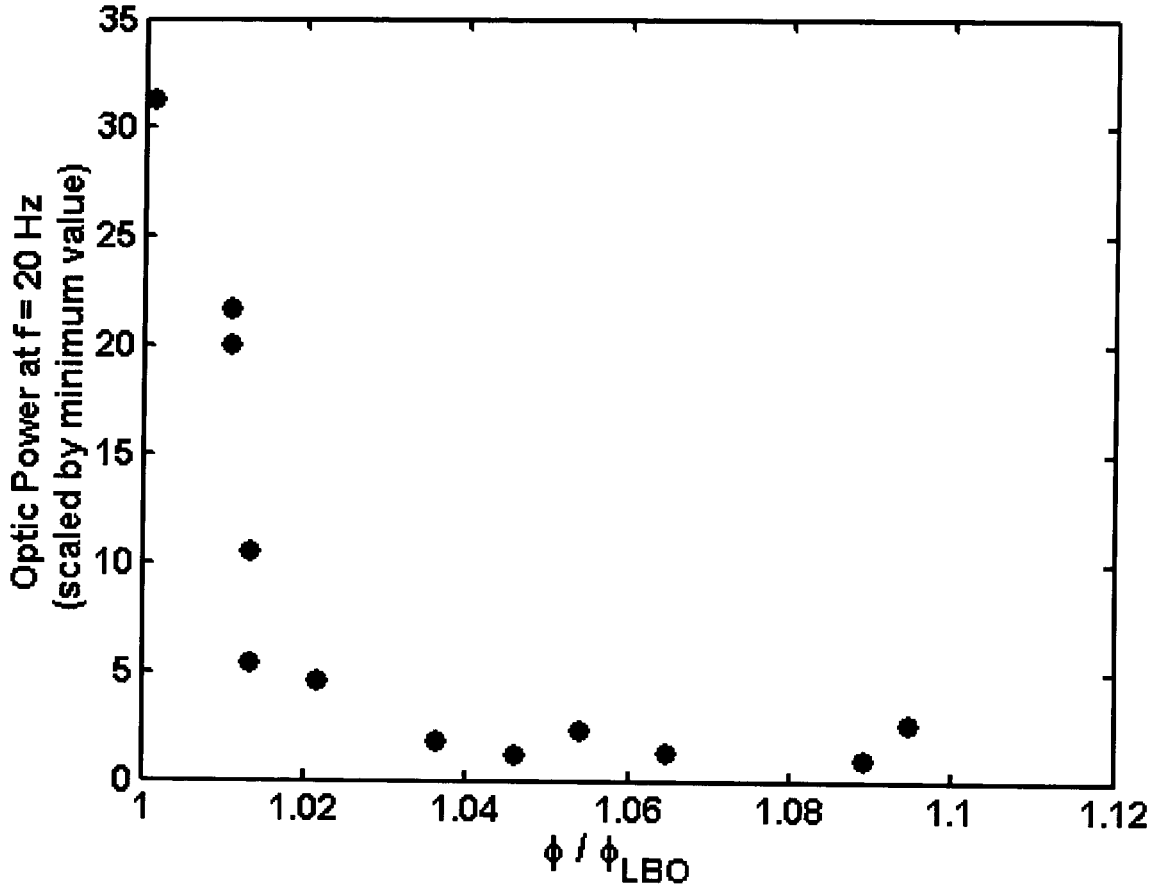

FIG. 27 is a plot of Fourier Transformed optical data as analyzed in the second sub-method of the spectral analysis.

Figure 28:
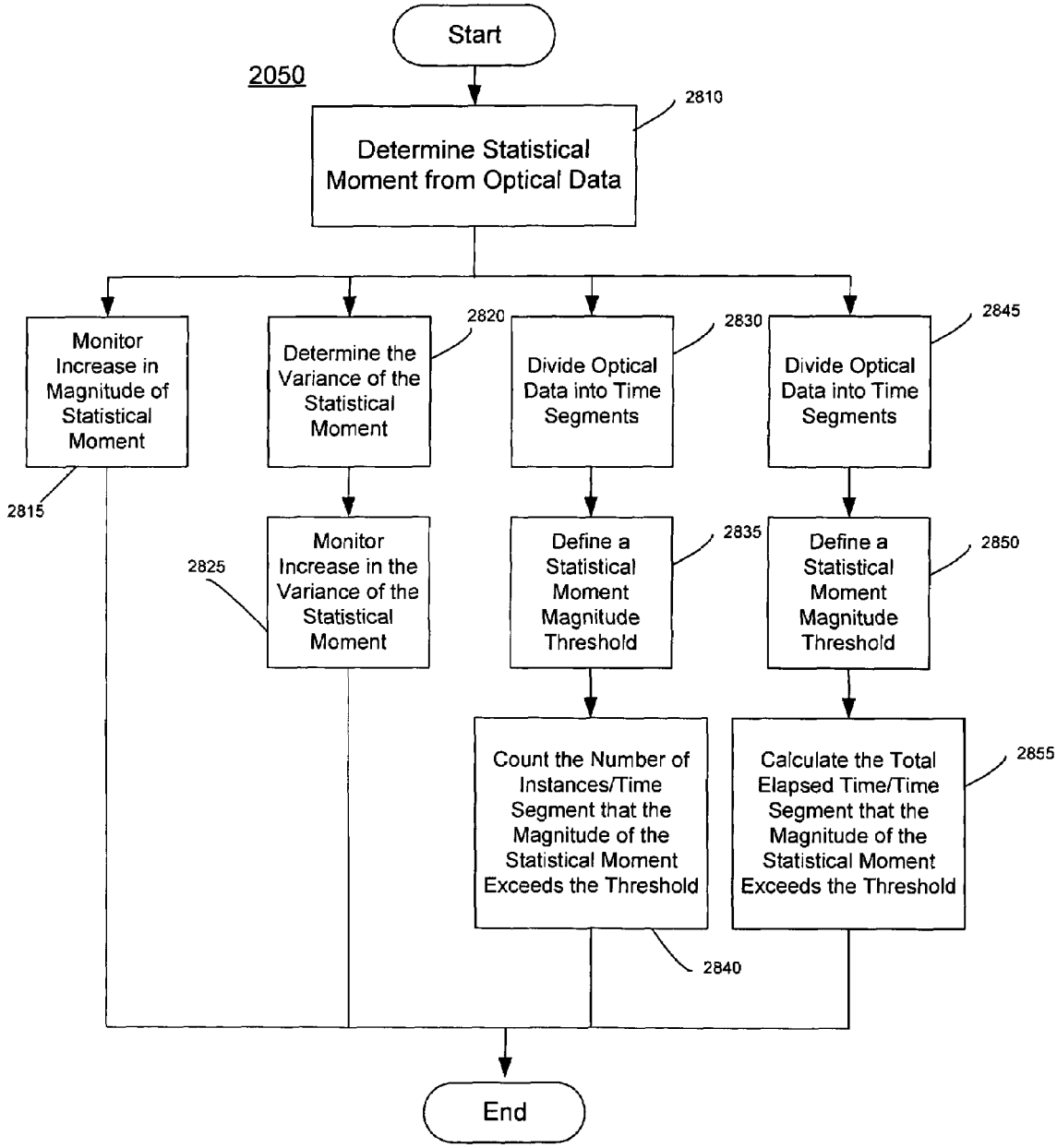

FIG. 28 is a block diagram of a method of detecting blowout precursors using statistical analysis on the optical data, according to one aspect of the present invention.

Figure 29:
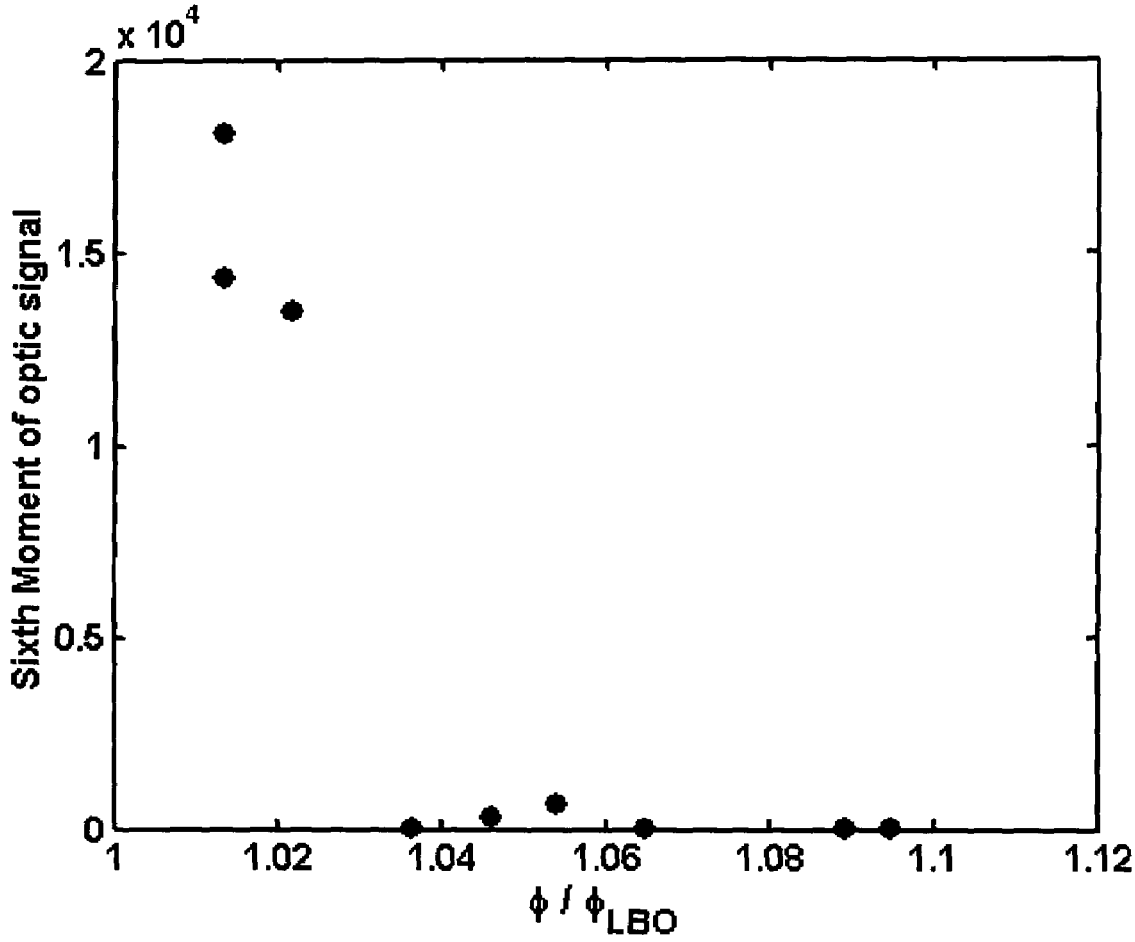

FIG. 29 is a plot of the $6^{th}$ statistical moment of the optical data.

Figure 30:
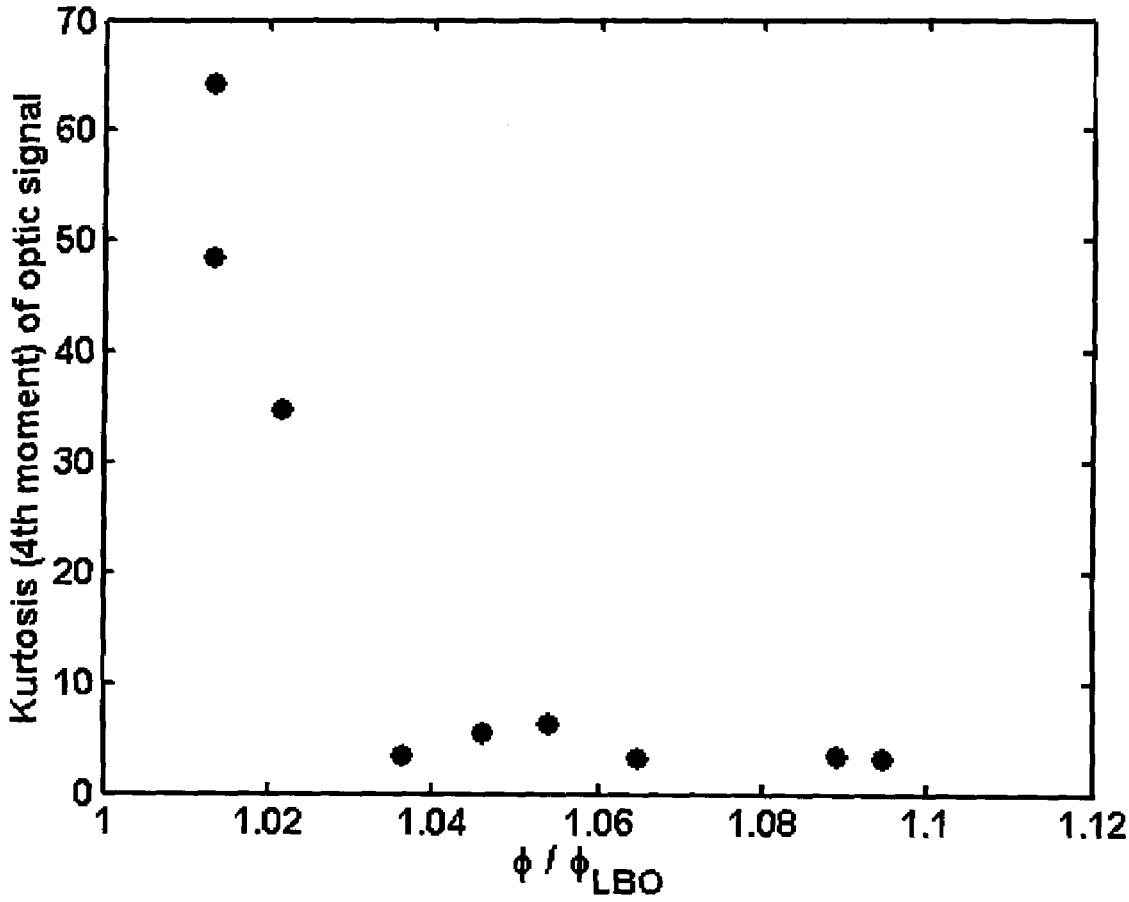

FIG. 30 is a plot of a statistical moment of the optical data as analyzed in the first sub-method of the statistical analysis.

Figure 31:
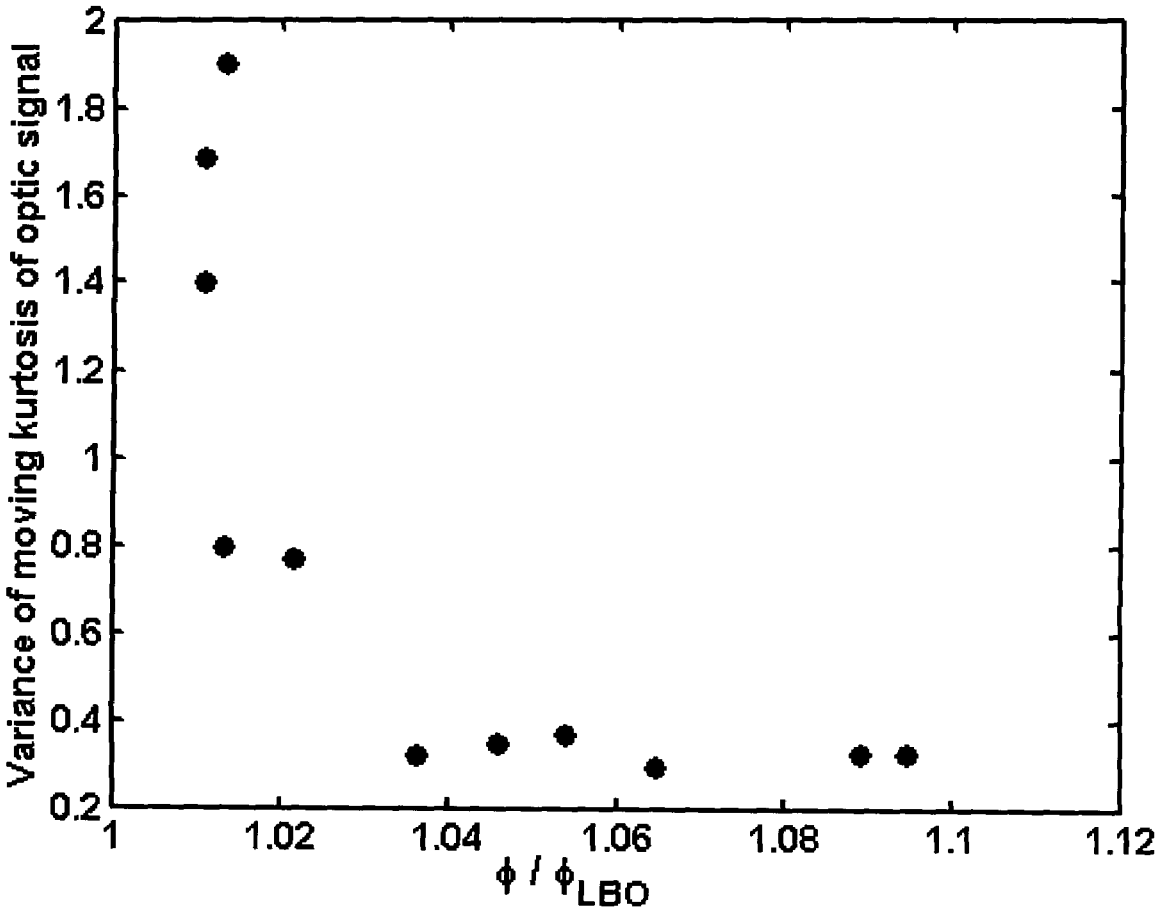

FIG. 31 is a plot of a statistical moment of the optical data as analyzed in the second sub-method of the statistical analysis.

Figure 32:
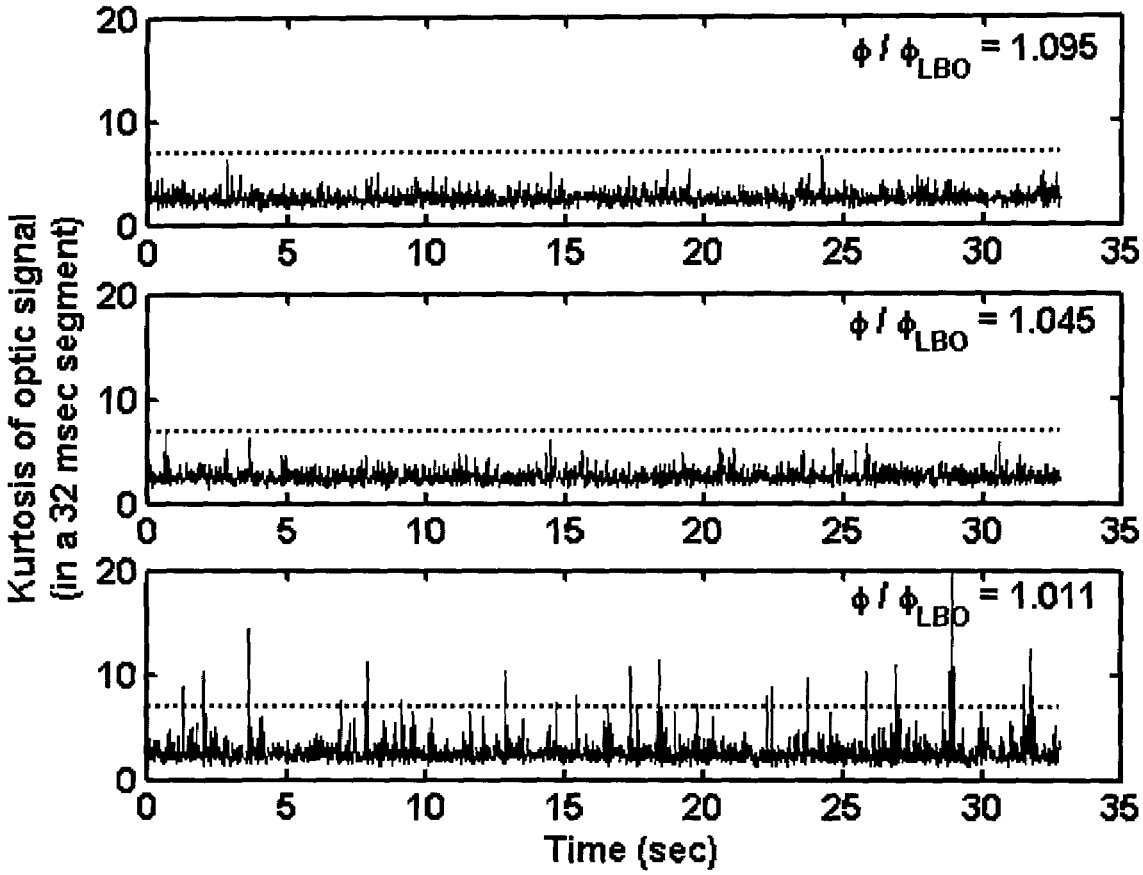

FIG. 32 is a plot of a statistical moment of the optical data as analyzed in the third sub-method of the statistical analysis.

Figure 33:
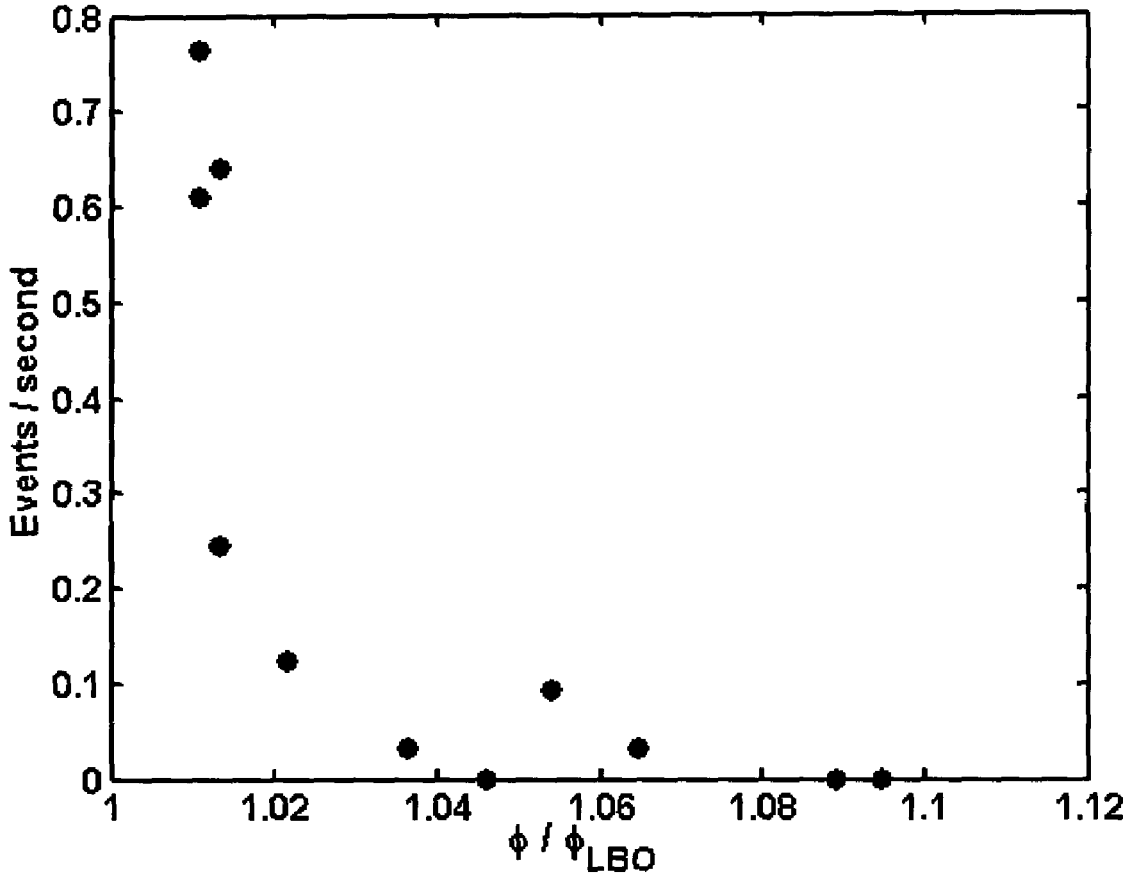

FIG. 33 is a plot of a statistical moment of the optical data as analyzed in the fourth sub-method of the statistical analysis.

Figure 34:
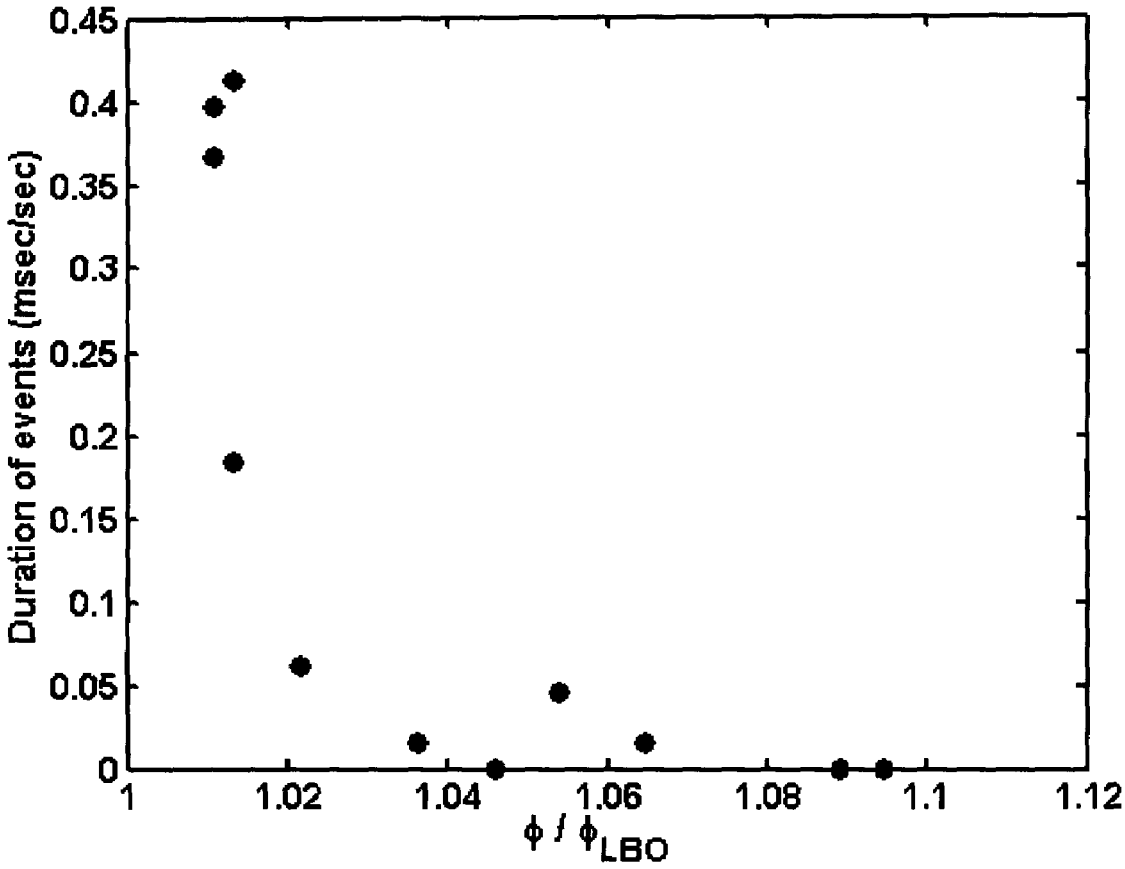

FIG. 34 is a plot of a statistical moment of the optical data as analyzed in the fifth sub-method of the statistical analysis.

Figure 35:
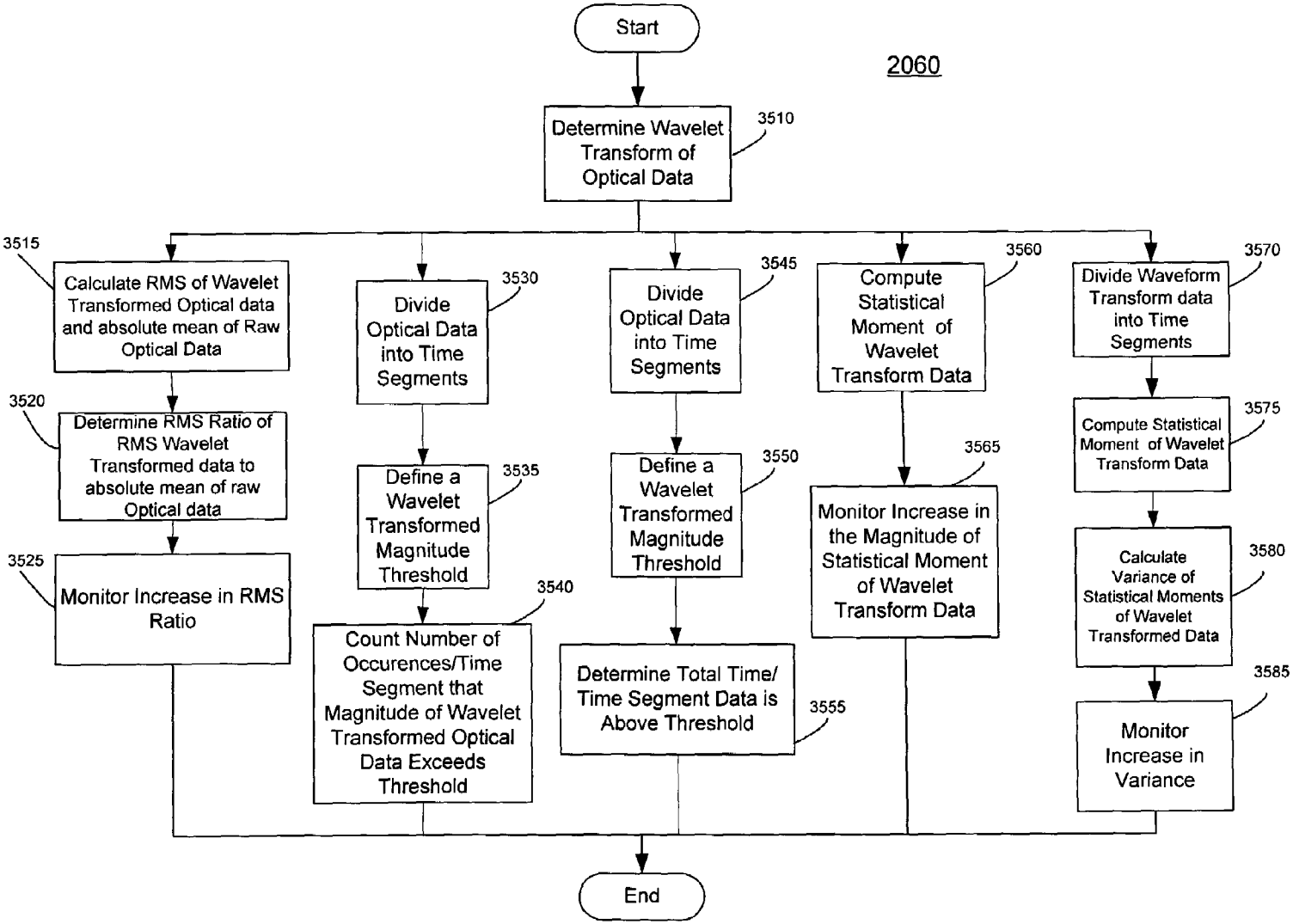

FIG. 35 is a block diagram of a method of detecting blowout precursors using wavelet analysis on the optical data, according to one aspect of the present invention.

Figure 36:
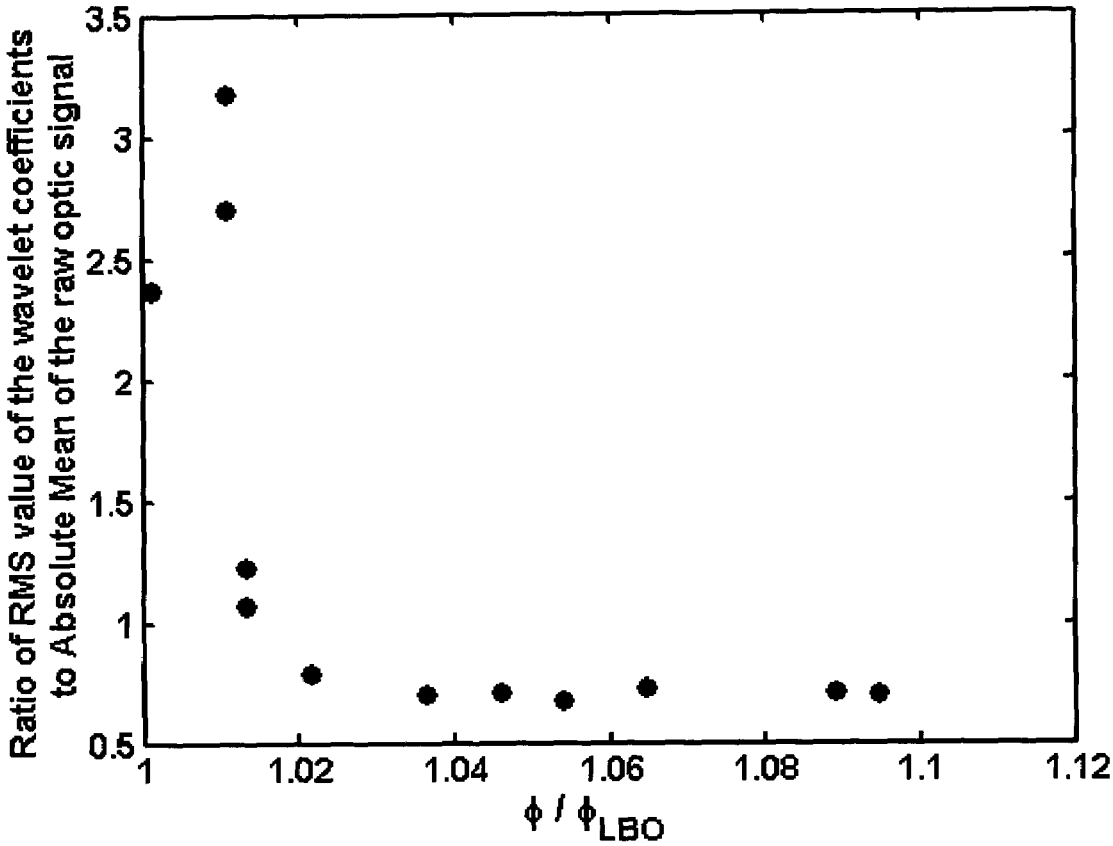

FIG. 36 is a plot of the RMS ratio of the optical data as analyzed in the first sub-method of the wavelet analysis, according to one aspect of the present invention.

Figure 37:
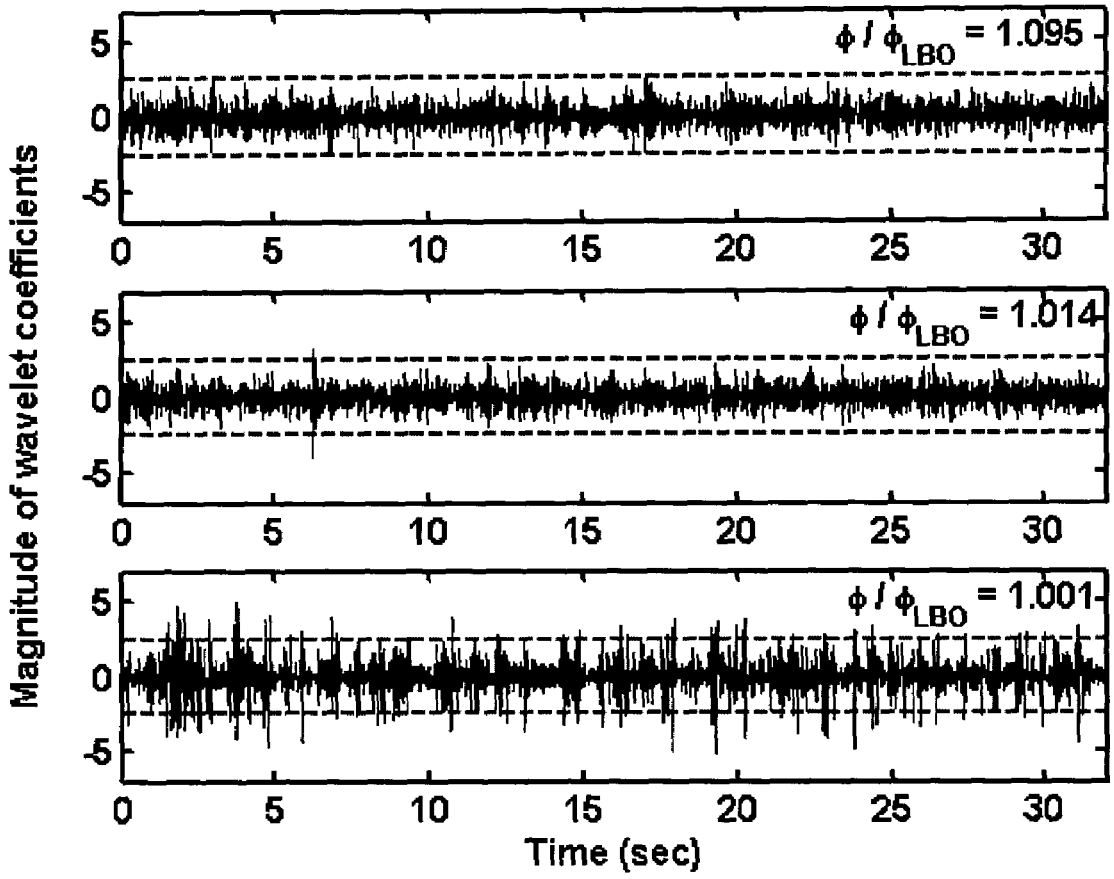

FIG. 37 is a plot of the magnitude of the wavelet transformed optical data as analyzed in the second sub-method of the wavelet analysis, according to one aspect of the present invention.

Figure 38:
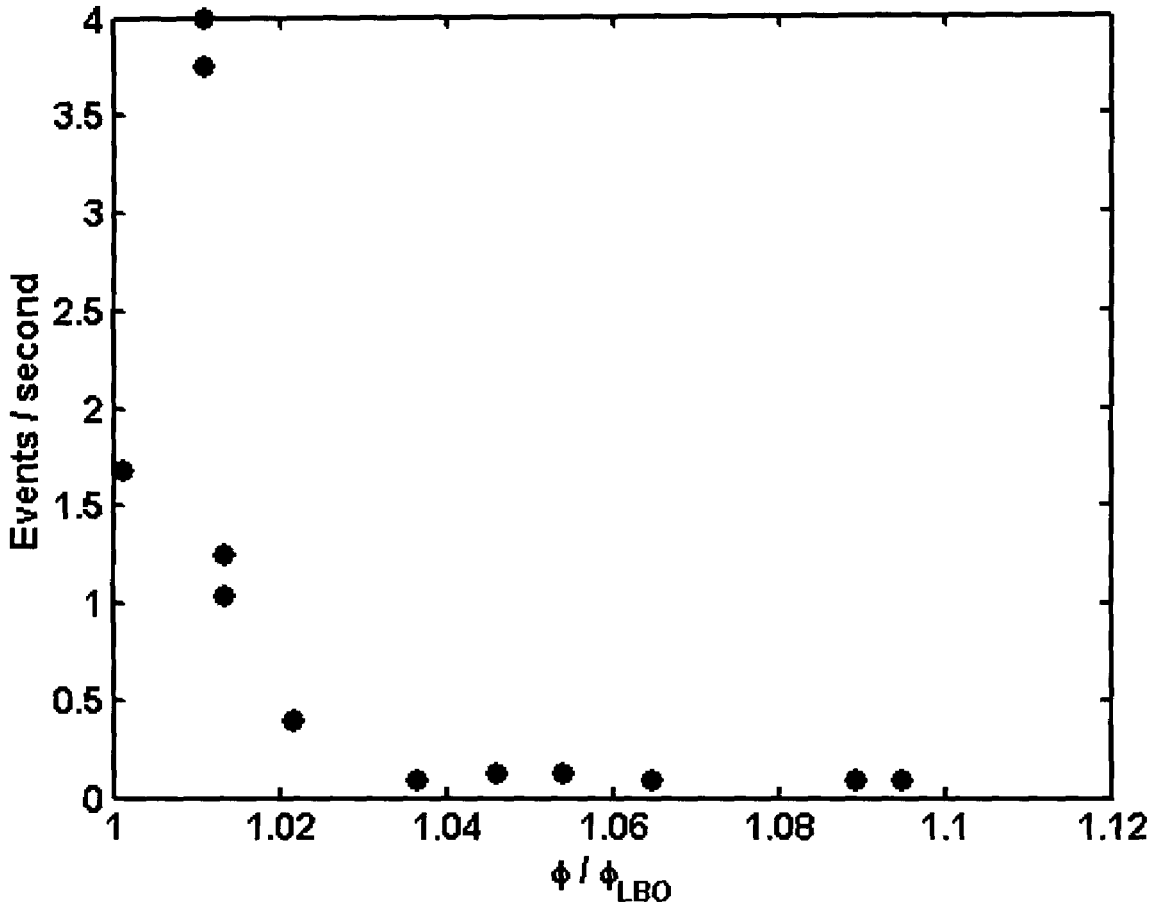

FIG. 38 is a plot of the magnitude of the wavelet transformed optical data as analyzed in the third sub-method of the wavelet analysis, according to one aspect of the present invention.

Figure 39:
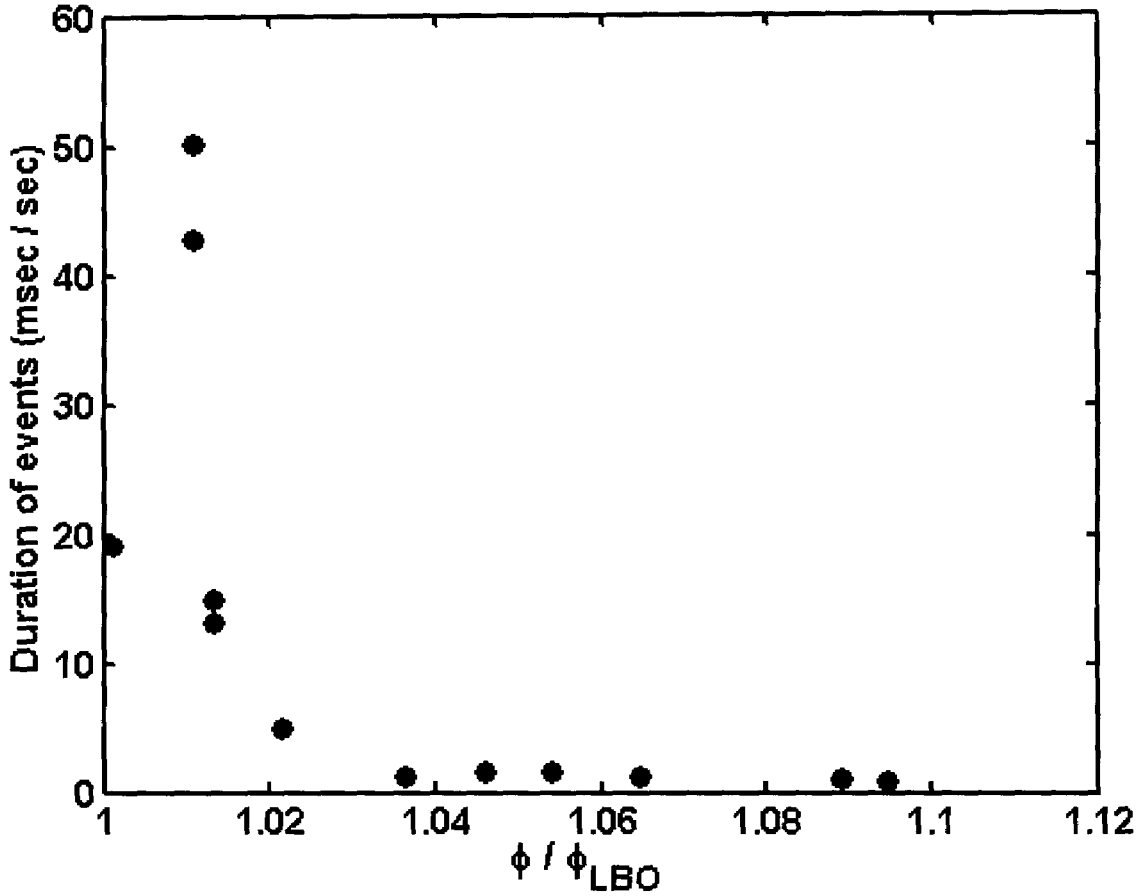

FIG. 39 is a plot of the magnitude of the wavelet transformed optical data as analyzed in the fourth sub-method of the wavelet analysis, according to one aspect of the present invention.

Figure 40:
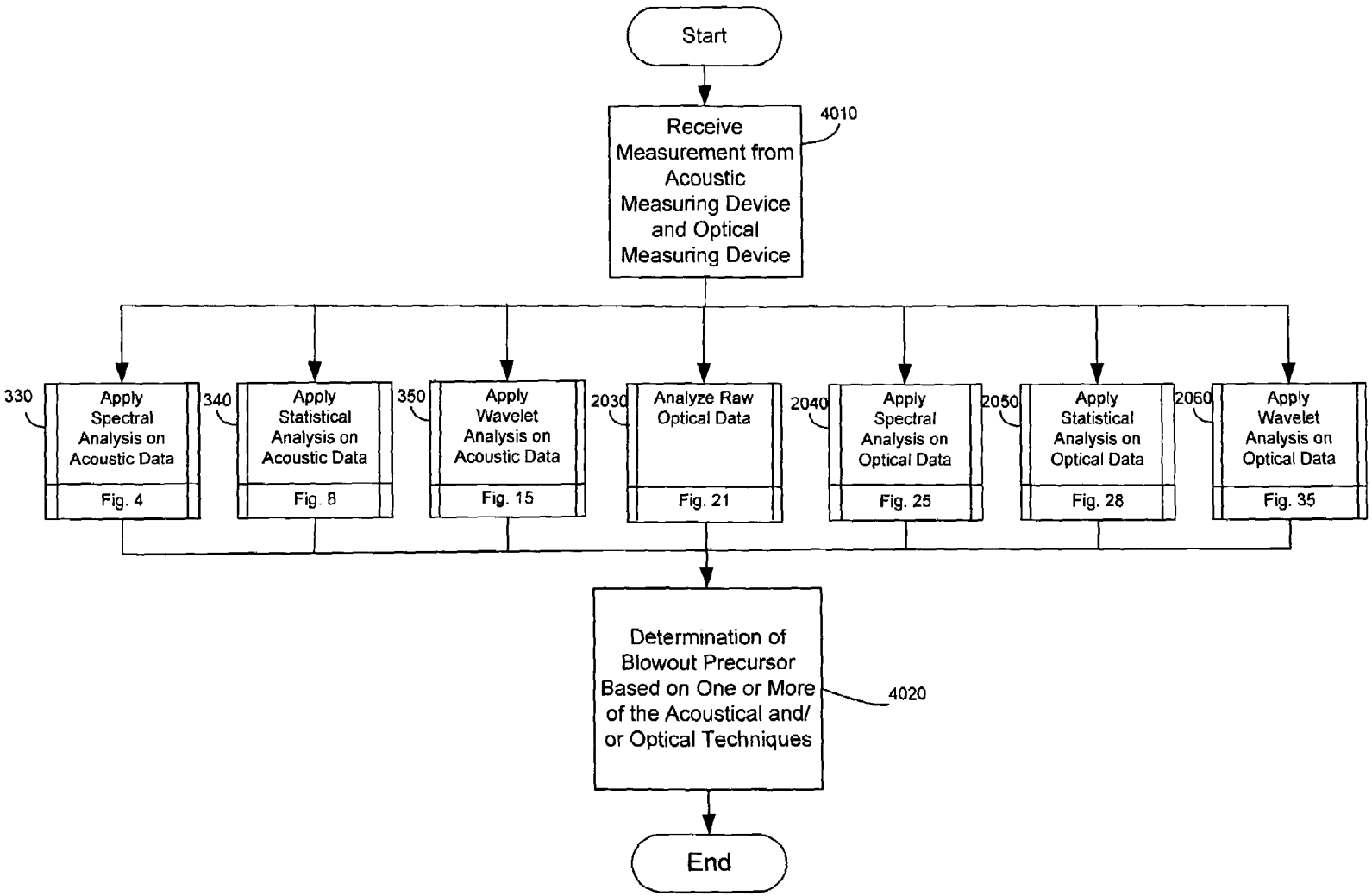

FIG. 40 is a block diagram of a method of detecting blowout precursors using acoustical and/or optical sensing approaches, according to one aspect of the present invention.

Figure 41:
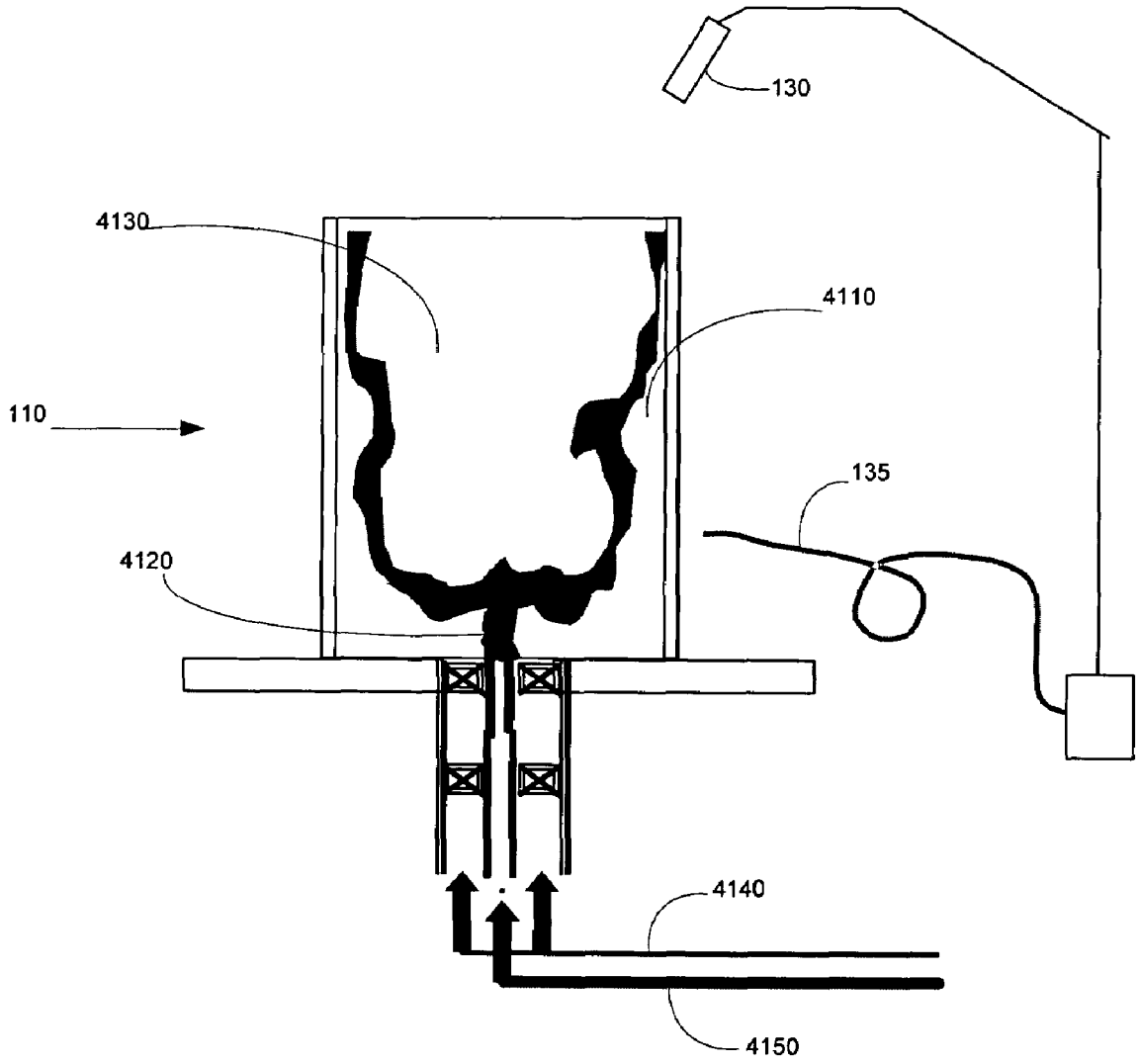

FIG. 41 is a cross-sectional view of an embodiment of a combustor used in an closed-loop control system for preventing flame blowout, according to one aspect of the invention.

Figure 42:
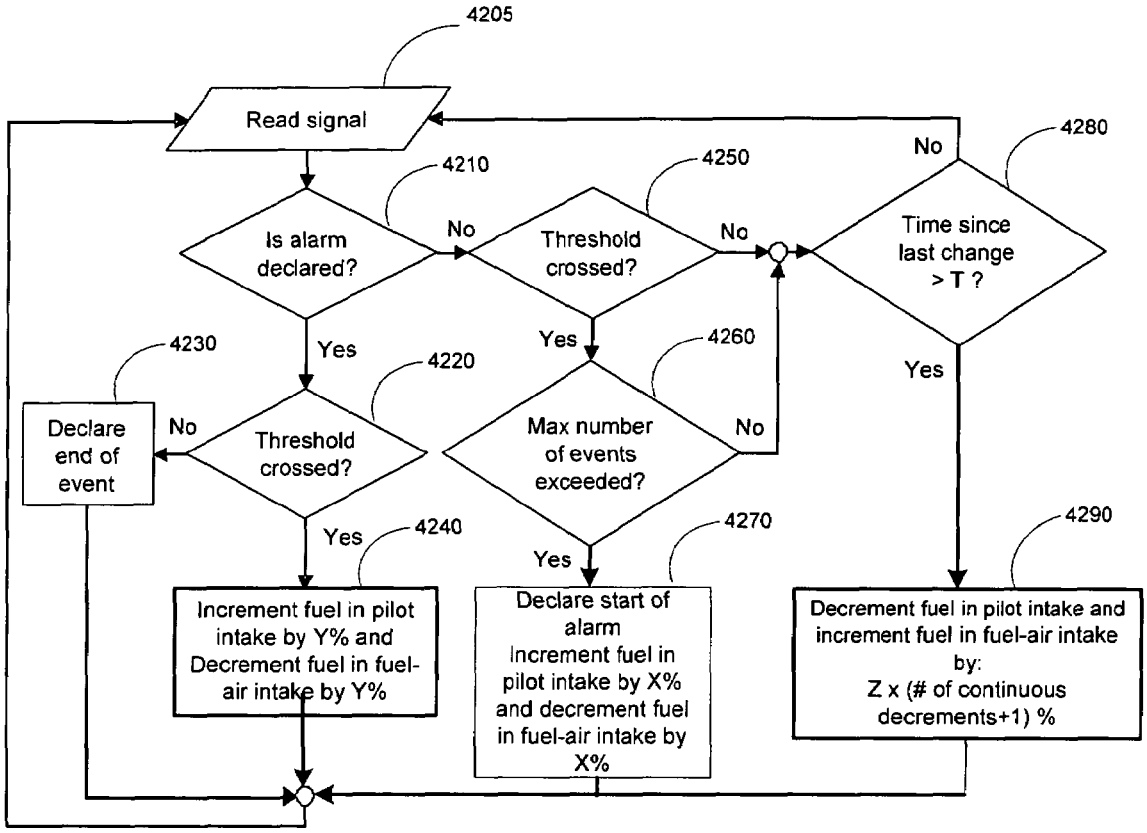

FIG. 42 is a block diagram of a redistribution control system, according to one aspect of the invention.

Figure 43:
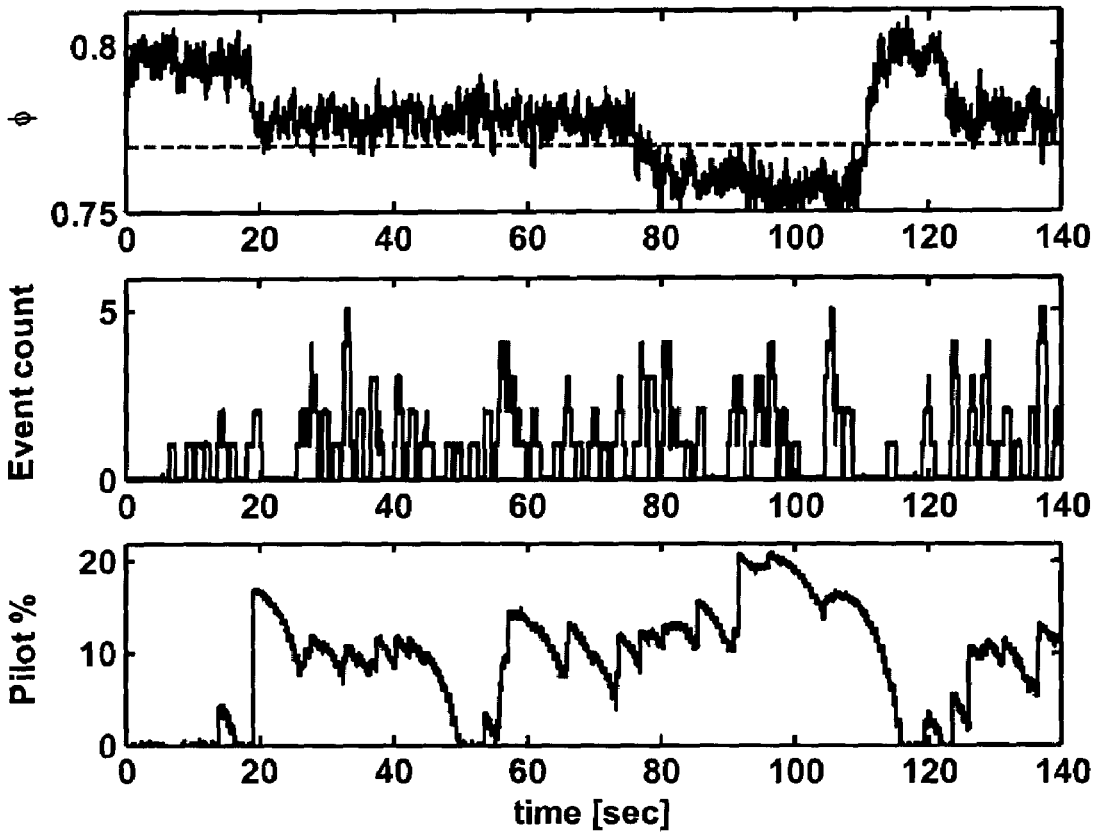

FIG. 43 is three plots of the results from the redistribution control system to prevent flame blowout, according to one aspect of the invention.

Figure 44:
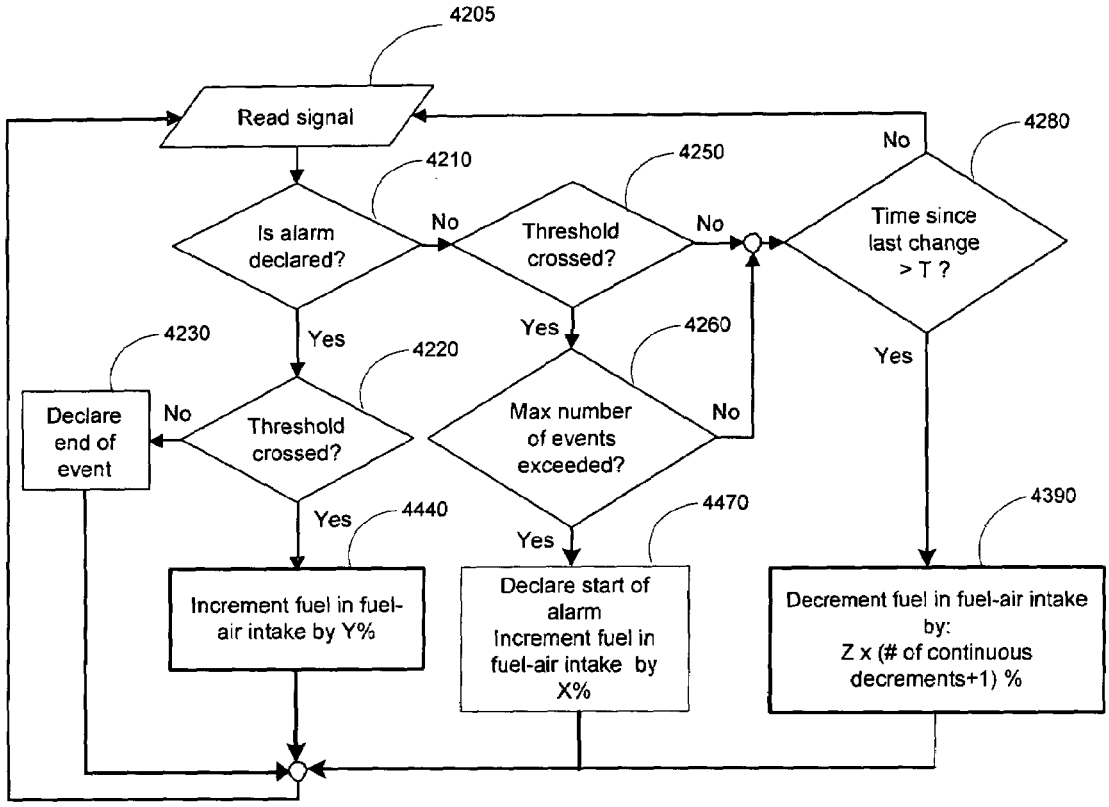

FIG. 44 is a block diagram of a control system that alters total fuel flow to prevent flame blowout, according to one aspect of the present invention.

Figure 45:
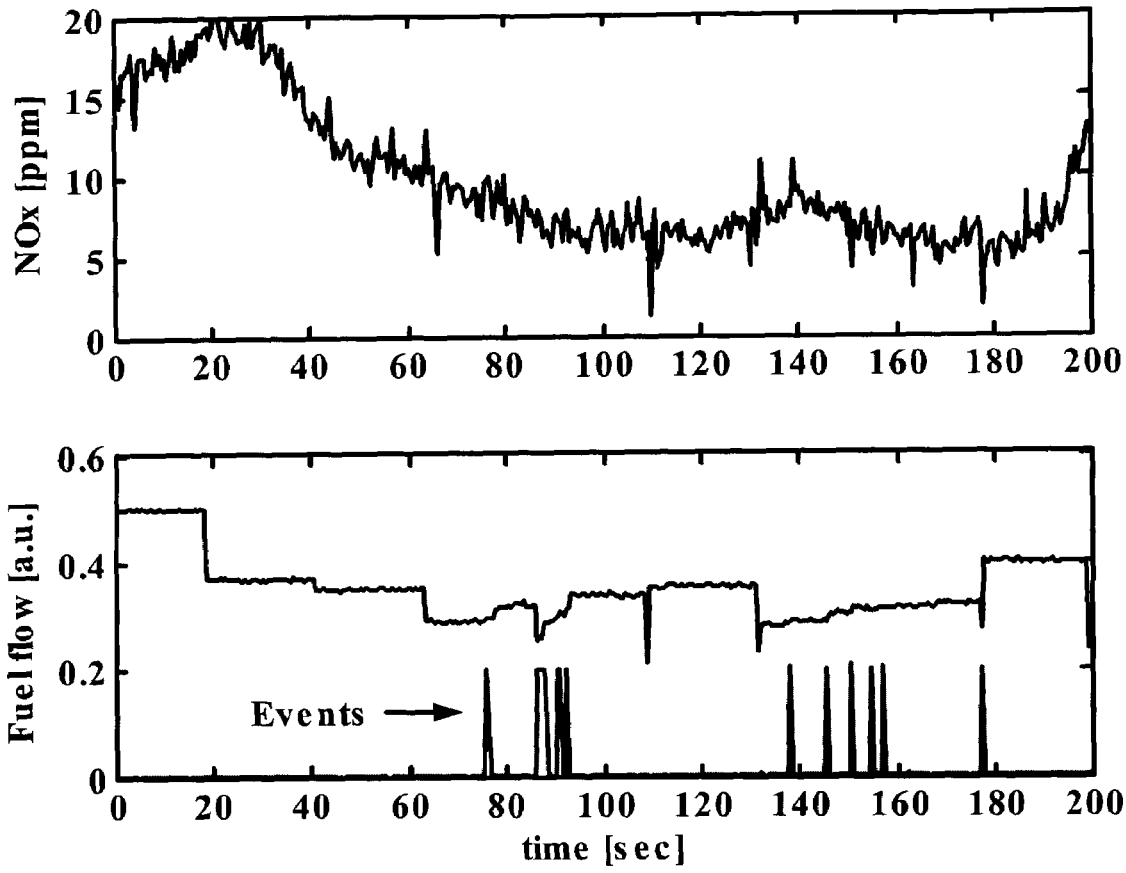

FIG. 45 is two plots of the results from the percentage fuel flow control system to prevent flame blowout, according to one aspect of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is described below with reference to block diagrams and flowchart illustrations of systems, methods, apparatuses and computer program products according to an embodiment of the invention. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

The present invention comprises systems and methods for accurately and robustly predicting flame blowout precursors for combustors. The present invention is applicable to all types of combustors and is designed to operate over a diverse range of environmental condition, including varying temperatures, humidity, air compositions, and fuel compositions.

Exemplary embodiments of the present invention will hereinafter be described with reference to the figures, in which like numerals indicate like elements throughout the several drawings. FIG. 1 illustrates a combination system 100 in accordance with the present invention. Advantageously, the present invention can be utilized with different types of combustors. Combustors applicable to this invention include but are not limited to combustors such as those found in industrial systems, land based or aeronautical gas turbine engines, afterburners, or ramjets. The design of the combustor and its disposition in an engine casing is well known to those skilled in the art and is in no way limited to the examples enumerated herein.

For purposes of illustrating the present invention, the combustion system 100 comprises a combustor 110 that is generally designed to receive air or some other oxidizer from a delivery system and fuel from fuel nozzles. The oxidizer and the fuel mix and burn and release energy. Combustors can be of any shape or configuration.

The combustion system further includes a blowout precursor detection unit 120, a combustor controller 140, and either an acoustic pressure measuring device 130 or an optical measuring device 135, or both. The blowout precursor detection unit 120 identifies precursors that indicate that the flame in a combustor 100 is near blowout. By identifying the blowout precursors one can prevent the flame from actually blowing out by making appropriate adjustments.

Acoustical Sensing Techniques

In an embodiment including the pressure measuring device 130, the pressure measuring device 130 is coupled to the combustor 110 and configured to detect the pressure in the combustor 110. The pressure measuring device 110 may be a pressure transducer or any other suitable device that accurately measures pressure and may be either analog or digital. In an exemplary embodiment, the pressure measuring device 130 is a pressure transducer capable of measuring pressure oscillations up to roughly 5 KHz. The pressure measuring device 130 may be mounted in the combustor, tangential to the combustor, or any other acoustically acceptable location that sufficiently measures the combustor pressure. The pressure measuring device 130 also may be attached to a stand-off tube that may be mounted into the combustor 110 and extend out of the combustor 110.

The blowout precursor detection unit 120 is connected with the pressure measuring device 130. FIG. 2 shows a block diagram illustrating components comprising a blowout precursor detection unit 120 of the combustion system 100, according to one aspect of the present invention. The blowout precursor detection unit 120 is preferably configured with operator interface for enabling the blowout precursor detection unit 120 to accept system setup information, input threshold settings and additional information applicable to blowout precursor detection. Alternatively, such information may be inputted by other suitable means, such as the combustion controller 140. The blowout precursor detection unit 120 is designed to receive pressure data from the pressure measuring device 130 and based thereon detect the existence of blowout precursors through one or more of the signal analysis methods described in FIGS. 3-19 and the accompanying text.

According to an exemplary embodiment of the present invention, the blowout precursor detection unit 120 comprises software running on a microprocessor or other suitable computing device. The blowout precursor detection unit 120 may be embodied as a method, a data processing system, or a computer program product. Accordingly, the blowout precursor detection unit 120 may take the form of an entirely hardware embodiment, an entirely software embodiment or an embodiment combining software and hardware aspects. Furthermore, the blowout precursor detection unit 120 may take the form of a computer program product on a computer-readable storage medium having computer-readable program code means embodied in the storage medium. Any suitable computer-readable storage medium may be utilized including hard disks, CD-ROMs, optical storage devices, or magnetic storage devices.

As shown in FIG. 2, the blowout precursor detection unit 120 comprises a processor 215, a memory 220, an operating system 225, an input/output interface 230 and a database 235, all in communication via a local interface 240. Briefly, the processor 215 executes the operating system 220, which controls the execution of other program code such as that comprising the signal processing logic 235 for implementing the functionality described herein. The local interface 240 may be, for example but not limited to, one or more buses or other wired or wireless connections. The local interface 240 may have additional elements, which are omitted for simplicity, such as controllers, buffers (caches), drivers, repeaters, and receivers, to enable communications. Furthermore, the local interface 240 may include address, control, and/or data connections to enable appropriate communications among the aforementioned components.

The processor 215 is a hardware device for executing software, particularly that stored on memory 220. The processor 215 may be any custom-made or commercially-available processor, a central processing unit (CPU), and auxiliary processor among several processors associated with the system 100 a semi-conductor based microprocessor (in the form of a microchip or chip set), a macroprocessor, or generally any device for executing software instructions.

The memory 220 may comprise an operating system 225 and the signal processing logic 235. The architecture, operation, and/or functionality of signal processing logic 235 will be described in detail below. The memory 220 may include any one or combination of volatile memory elements (e.g., random access memory (RAM), such as DRAM, SRAM, SDRAM, etc.) and non-volatile memory elements (e.g., ROM, hard drive, tape, CD-ROM, etc.). The memory 220 may incorporate electronic, magnetic, optical and/or other types of storage media. Furthermore, memory 220 may have a distributed architecture, in which various components are situated remote from one another, but can be accessed by processor 215.

The software in memory 220 may include one or more separate programs, each of which comprising executable instructions for implementing logical functions. In the example of FIG. 2, a software in memory 220 includes the signal processing logic 235 according to the present invention. The memory 220 may further comprise a suitable operating system 225 that controls the execution of other computer programs, such as the signal processing logic 235, and provides scheduling, in-output control file and data management, memory management, and communication control and related services.

The input/output interfaces 230 may be any device or devices configured to facilitate communication with the blowout precursor detection unit 120. The communications can be with a communication network, such as a public or private packet-switched or other data network including the Internet, a circuit switched network, such as the public switch telephone network, a wireless network, an optical network, or any other desired communication infrastructure. Alternatively, the input/output interfaces may also include any one of the following or other devices for facilitating communication with local interface 240: a user interface device such as a keyboard or mouse, a display device such as a computer monitor, a serial port, a parallel port, a printer, speakers, a microphone, etc. During operation of the blowout precursor detection unit 120, a user may interact with the signal processing logic 235 via such user interface and display devices.

The signal processing logic 235 may be a source program, executable program (object code), script, or any other entity comprising a set of instructions to be performed. When implemented as a source program, then the program needs to be translated via a compiler, assembler, interpreter, or like, which may or not be included within the memory 220, so as to operate properly in connection with the operating system 225. Furthermore, the signal processing logic 235 may be written as an object oriented program language, which has classes of data and methods, or a procedure program language, which has routines, sub-routines, and/or functions, for example but not limited to, C++, Pascal, Basic, Fortran, Cobol, Perl, Java, and Ada.

It will be appreciated by one of ordinary skill in the art that one or more of the blowout precursor detection unit 120 components may be located geographically remotely from other blowout precursor detection unit 120 components. Furthermore, one or more of the components may be combined, and additional components performing functions described herein may be included in the blowout precursor detection unit 120. In addition, one or more, if not all, of the components of the blowout precursor detection unit 120 may be incorporated into the combustor controller 140.

The blowout precursor detection unit 120 is configured to receive through the input/output interface 230 pressure data captured by the pressure measuring device 130. As discussed in regards to FIGS. 3-19, the signal processing logic 235 utilizes one or more signal processing methods to analyze the pressure data for the detection of a blowout precursor. The signal processing logic 235 may include hard-coded threshold values for blowout precursor detection or may use input threshold values inputted into the memory 220 through the input/output interface 230. The detection of a blowout precursor results in a signal being communicated to the combustion controller 140 that indicates that the flame is near blowout conditions.

The combustion controller 140 controls the operation of the combustor 110 and is in communication with the blowout precursor detection unit 130. Such controllers controlling the operation of a combustor are well known, and therefore are not described in detail as a part of this disclosure. Upon receiving a signal indicating the detection of a blowout precursor by the signal processing logic 235, the combustion controller 140 will make appropriate adjustments to the operating parameters of the combustor 110 to prevent blowout.

FIG. 3 is a flow chart illustrating the architecture, functionality and/or operation of the signal processing logic 235 for an acoustic sensing approach to the detection of blowout precursors. As illustrated in FIG. 3, the method begins by receiving pressure data from the pressure measuring device 320. The data may be received from either a digital or analog pressure measuring device 120. If the pressure measuring device 120 is analog, one of ordinary skill in the art would appreciate the step of sampling the data and performing known signal processing techniques to ensure an accurate and quality digital representation of the analog signal, such as implementing anti-aliasing filters.

The received pressure data may be analyzed by one or more of three different signal analysis techniques: spectral analysis 330, statistical analysis 340, and wavelet analysis 350. The spectral analysis, statistical analysis, and wavelet analysis techniques may be based on the pressure data in its entirety or any smaller subset of the pressure data. For instance, the subset of the pressure data may consist of a sample of a quarter of a second, although any subset of data may be used in this technique.

FIGS. 4-19 describe in more detail the specific signal processing techniques involved with the three analysis techniques. As described below, each of the three analysis techniques involve multiple sub-methods of analysis. When implementing this method, it is contemplated that any combination of the spectral analysis 330, statistical analysis 340, and wavelet analysis 350 techniques may be used. That is, the method may use one, two, or all three of the analysis techniques and any combination of their respective sub-methods to analyze the pressure data.

After the pressure data is analyzed by one or more of the steps 330, 340, and 350, the existence of a blowout precursor is determined at step 360. As described in more detail in FIGS. 4-19, the results of the analysis steps 330, 340, 350 may indicate that a flame is nearing blowout conditions, such as in the form of a binary output (e.g., a "1" represents the detection of a blowout precursor and "0" represents no detection of a blowout precursor). A positive indication of the flame nearing blowout conditions is known as a blowout precursor. Determination of a blowout precursor may be based on any combination of the results of the analysis techniques and their respective sub-methods described below. For example, the results of spectral analysis (step 330) on the pressure data may indicate that the flame is nearing blowout conditions, but the statistical analysis (step 340) and wavelet analysis (step 350) results may not indicate a proximity to blowout conditions based on the same data. In such a situation, the blowout precursor determination step 360 may include the determination that the indication from a single analysis technique, the spectral analysis in this illustrative example, is sufficient to indicate blowout conditions, and thus positively identify the existence of a blowout precursor.

Thus, it is contemplated that the results of the spectral analysis, statistical analysis, and wavelet analysis can be combined in any manner to detect blowout precursors. That is, the results of the spectral analysis, statistical analysis, and wavelet analysis may be used individually or in combination to identify blowout precursors 360. The combination may be defined by any logical or mathematical relationship suitable for such determination, including but not limited to a specific weighting scheme wherein the results of one analysis technique is weighed more heavily in the determination than the others. The combination of such analysis techniques also may be user dependent. The user may decide how close to flame blowout the combustor is desired to operate. For instance, if the operator of the turbine engine wants the combustor to operate extremely close to blowout conditions to reduce emissions, the blowout precursor determination logic may require all three of the analysis techniques to indicate, or even strongly indicate, that the flame is near blowout to positively identify the existence of a blowout precursor. The method for determining blowout precursors may end after the blowout precursor detection step 360, or alternatively, the method may continuously operate on the pressure data as it is received from the combustor.

FIG. 4 illustrates an exemplary embodiment of the spectral analysis technique that may be implemented to identify blowout precursors. The first substantive step in performing spectral analysis is to take the Fourier Transform of the pressure data received from the pressure measuring device 120. The Fourier Transform is well known to those skilled in the art to be a technique of separating the pressure data into its frequency components. Separation of the pressure data in the frequency domain allows the pressure data to be more precisely analyzed by identifying signal characterizations on a per frequency basis. Certain frequencies and frequency ranges have been identified as a part of the present invention as being strong indicators to blowout precursor detection. As shown in FIG. 5, the power spectral density (PSD) of the raw pressure data changes shape with frequency. $\Phi$ is the equivalence ratio, which is defined as the fuel/air ratio normalized by its stoichiometric value. $\Phi_{LBO}$ is the equivalence ratio at blowout conditions. A "$\Phi/\Phi_{LBO}$" value equal to one represents blowout. Thus, FIG. 5 shows that the shape of the PSD changes as the equivalence ratio approaches blowout conditions.

As further shown in FIG. 4, the spectral analysis technique may be subdivided into two separate analysis sub-methods as further embodiments of the present invention. The results of each sub-method may individually or in combination with other sub-methods identify the existence of a blowout precursor. The combination of sub-method results may be defined by any suitable logic or mathematical relationship.

The first spectral analysis sub-method involves determining the power of the pressure data between a first frequency and a second frequency and calculating a power ratio by normalizing the power by the total spectral power of the pressure data, as indicated in step 420. The normalization of the power allows this sub-method to not be turbine specific nor be dependent on operating conditions such as temperature, atmospheric pressure, humidity, fuel composition, etc. At step 430, the power ratio is monitored to detect a predetermined increase.

In an exemplary embodiment, a first frequency of between 10 Hz and 100 Hz and a second frequency of between 100 Hz and 500 Hz have been proven effective. However, this invention is not limited to those specific ranges. Any frequency ranges that can be used to determine the existence of a blowout precursor is contemplated by this invention.

The second sub-method of the spectral analysis technique involves determining the power of the pressure data at a specific frequency and calculating a power ratio by normalizing the power at a given frequency by the total spectral power of the pressure data as indicated in step 440. The normalization of the power at a specific frequency also allows this sub-method to not be device specific nor be dependent on operating conditions such as temperature, atmospheric pressure, humidity, fuel composition, etc.

In an exemplary embodiment, the power ratio of the second sub-method will be determined using a power at a single frequency between 10 Hz and 500 Hz. However, this invention is not limited to the power within that specific frequency range. Any frequency that can be used to determine the existence of a blowout precursor is contemplated by this invention.

Increases in the power ratios determined by steps 420 and 440 may be monitored to indicate that the flame is nearing blowout conditions as indicated by steps 430 and 450. Each power ratio calculated in step 420, 440 may be analyzed separately to determine a flame's proximity to blowout conditions. FIG. 6 illustrates that the magnitude of the power ratio of step 420 dramatically increases near blowout conditions. FIG. 7 shows that a similar phenomenon exists for the power ratio calculated in step 440. The detection of a blowout precursor based on the increase in the respective power ratios may be identified in several ways.

One manner of determining a blowout precursor based on an increase in the power ratio, such as in steps 430 and 450, is to set a predetermined threshold for the power ratio. The predetermined threshold value may vary between the power ratios identified in steps 420 and 440. Each power ratio may be monitored to determine if the power ratio exceeds the predetermined threshold. If the power ratio exceeds the threshold, a blowout precursor may be detected. For instance, if the power ratio in step 420 exceeds a threshold of 0.02, the blowout precursor determination logic 360 may indicate that the combustor is near blowout. However, any threshold value that indicates that blowout conditions are nearing is contemplated for steps 430 and 450.

A second manner for determining blowout precursors from monitoring an increase in the power ratio involves monitoring the rate of increase of the power ratio. For instance, a blowout precursor may be identified if the rate of increase exceeds a predetermined slope. It is also contemplated that a more complex analysis of the rate of increase of the power ratio may be used to identify a blowout precursor.

FIG. 8 illustrates the exemplary embodiment of the statistical analysis techniques of step 340 in FIG. 3 for determining the existence of a blowout precursor. Under this approach, the statistical moment of the pressure data or at least a subset of the pressure data received from the pressure measuring device 130 is calculated at step 810. While the statistical moment calculation is well known to those of ordinary skill in the art, it is noted that the n'th statistical moment of the pressure data, $M_n$, is defined here as:

$$M_n = \frac{\int_{t=0}^{T} (p'(t) - \overline{p})^n \, dt}{\left[\int_{t=0}^{T} (p'(t) - \overline{p})^2 \, dt\right]^{n/2}}$$

The statistical moment may be calculated for an "n" of any value to determine the nth statistical moment. In one embodiment, the fourth statistical moment, better known as the Kurtosis (the kurtosis is usually defined as $M_4-3$, rather than just $M_4$ as we define it here. For the purposes of this invention, all references to the kurtosis refer to $M_4$; all methods described here apply equally well if the more conventional definition is used) is used to detect the existence of blowout precursors. The Kurtosis provides a sufficient balance between calculation speed and value sensitivity related to blowout conditions. Analysis of any moment, $M_n$, where n>2 can also be used for blowout precursor detection. For example, as shown in FIG. 9, a higher moment, in this case the $6^{th}$ moment, may be used.

Similar to the spectral analysis technique, the statistical analysis technique includes four sub-methods as further embodiments of the present invention. Each sub-method may be used individually or in combination with another sub-method to determine the existence of a blowout precursor. The combination of sub-method results may be defined by any suitable logic or mathematical relationship.

The first sub-method involves the step of monitoring the magnitude of the statistical moment values 815 that were determined in step 810. Increases in the magnitude may be monitored to indicate that the flame is nearing blowout conditions. As the plot in FIG. 10 illustrates, the magnitude of the statistical moment data will substantially increase when blowout conditions are neared. The detection of a blowout precursor based on the increase in the magnitude of the statistical moment data may be identified in several ways.

One manner of determining a blowout precursor based on an increase in the magnitude of the statistical moment data would be to set a predetermined threshold for the magnitude of the statistical moment data. The magnitude of the statistical moment data may then be monitored to determine if the magnitude exceeds the predetermined threshold. If the magnitude exceeds the threshold, a blowout precursor may be detected. For instance, if the magnitude in step 815 exceeds a threshold of 3.2, the blowout precursor determination of step 360 in FIG. 3 may indicate that a blowout precursor exists. However, any threshold value that indicates that blowout conditions are nearing is contemplated in this invention.

A second manner for determining blowout precursors from monitoring an increase in the magnitude of the statistical moment data involves monitoring the rate of increase of the magnitude of the statistical moment data. A blowout precursor may be identified if the rate of increase exceeds a predetermined slope. As previously stated, it is also contemplated that a more complex analysis of the rate of increase of the magnitude of the statistical moment data may be used to identify a blowout precursor.

The second sub-method involves the step of determining the variance of the statistical moment values 820 that were determined in step 810. Calculation of the variance of a data set is well known in the art and therefore need not be discussed herein. The variance of the statistical moment data will then be monitored for sufficient increases to indicate a blowout precursor at step 825. As FIG. 11 illustrates, the variance of the statistical moment data increases significantly near blowout conditions, that is, when $\Phi/\Phi_{LBO}$ equal to one. Methods for determining the existence of a blowout precursor based on step 825 are similar to those described above for step 815. For example, one can examine the increase based on a threshold variance value or a rate of increase in the variance. An applicable variance threshold for the Kurtosis, for example, has been determined to be 0.35. However, any variance threshold value that indicates a blowout condition is contemplated and can be applied to any order statistical moment calculation.

The third sub-method under statistical analysis involves determining the existence of a blowout condition based on the repetitiveness of the magnitude of the statistical moment exceeding a predefined threshold over a given time segment, as indicated by steps 830, 835, 840. The sub-method initially divides the pressure data into time segments at step 830. The time segments can span any conceivable length of time. In the exemplary embodiment, the time segment is 32 millisecond long. Next, a statistical moment threshold is defined at step 835. The technique then involves counting the number of instances in the given time segment that the statistical moment exceeds the predefined statistical moment threshold, as indicated by step 840. An increase in the occurrence of the statistical moment magnitude exceeding the predefined threshold value indicates that blowout conditions are being encountered. FIG. 12 illustrates a plot of the Kurtosis over a time segment. The dotted line in each graph of the FIG. 12 represents a predefined threshold value, which may be subjectively or objectively defined. As can be seen from the plots, the Kurtosis value exceeds the threshold more frequently when $\Phi/\Phi_{LBO}$ approaches one, that is, approaches blowout conditions. FIG. 13 demonstrates the same phenomenon by plotting the alarms (each occurrence of the magnitude exceeding the threshold) per second versus $\Phi/\Phi_{LBO}$.

The fourth sub-method of statistical analysis involves determining the existence of a blowout condition based on total elapsed time that the magnitude of the statistical moment exceeds a predefined threshold over a given time segment, as indicated by steps 845, 850, and 855. The fourth sub-method begins by dividing the pressure data into time segments at step 845. The time segments can span any conceivable length of time. In the exemplary embodiment, the time segment is 32 millisecond long. Next, a statistical moment threshold is defined as indicated by step 850. The sub-method then involves calculating the total elapsed time in the given time segment that the magnitude of the statistical moment exceeds the predefined statistical moment threshold, as indicated by step 855. An increase in the total time per time segment that the magnitude of the statistical moment data exceeds the predefined threshold value indicates that blowout conditions are being encountered. FIG. 14 illustrates that the duration of elapsed time that the magnitude of the statistical moment data resides above the given threshold increases when blowout conditions are neared.

It is also contemplated that the statistical analysis technique 340 and all of its sub-methods, e.g., steps 810-855, may be applied to only a frequency subset of the raw data. To that end, a bandpass filter may be used on the raw pressure data to filter out unwanted frequency ranges before the pressure data is subjected to statistical moment calculations. The methods described above for the statistical analysis of step 340 will be similarly applied to the bandpass filtered data.

FIG. 15 illustrates another embodiment of the present invention which implements wavelet analysis techniques for determining the existence of a blowout precursor. The method for detecting blowout precursors using the wavelet transform begins by taking the wavelet transform of the pressure data, as indicated by step 1510. The wavelet transform is well known to those of ordinary skill in the art and may be defined as:

$$f_\psi(t) = \int_{t'} W((t'-t)/\psi)p(t')\,dt'$$

where p(t) is the raw time series data, v is a scaling parameter, and W(t) is the wavelet basis function. Time localized bursting events may be noticed after the pressure data is transformed by the wavelet transform. The present invention contemplates developing customized wavelet shapes that closely resemble these empirically observed bursting events to better identify blowout conditions. The resulting wavelet transformed data may then be optimized for zeroing in on these bursting events as they occur. Conventional wavelet basis functions, such as the Morlet or Mexican Hat wavelets may also be used in the detection of blowout precursors.

After the wavelet transform of the pressure data has been taken at step 1510, the wavelet analysis technique may be subdivided into at least five wavelet analysis sub-methods as further embodiments of the present invention. Each wavelet sub-method may be analyzed individually or in combination with other analysis methods to determine the existence of a blowout precursor. The combination of sub-method results may be defined by any suitable logic or mathematical relationship.

The first wavelet sub-method begins by determining the Root Mean Square (RMS) value of the wavelet transformed pressure data at some scale, ψ, and the RMS value of the raw pressure data as indicated in step 1515. The RMS calculation is well known to those of ordinary skill in the art, and therefore, need not be described herein. A RMS ratio is then calculated by dividing the RMS value of the wavelet transformed pressure data by the RMS value of the raw pressure data as indicated in step 1520. The normalization of the power allows this sub-method to not be device specific nor be dependent on operating conditions such as temperature, atmospheric pressure, humidity, fuel composition, etc.

As shown in FIG. 16, the RMS ratio increases as blowout approaches, and thus, monitoring the increase in the RMS ratio indicate blowout conditions may exist, as indicated by step 1525. One manner of determining a blowout precursor based on an increase in the RMS ratio would be to set a predetermined threshold for the RMS ratio. The amount of increase of the RMS Ratio depends upon the value of the scaling parameter, ψ. In an exemplary embodiment, ψ values that roughly correspond to wavelet time scales of 1/500 to 1/20 seconds have worked well. However, the present invention is in no way limited to time scales of between 1/500 and 1/20. Any time scale value may be used to predict the onset of flame blowout. The RMS ratio may then be monitored to determine if the RMS ratio exceeds the predetermined threshold, as indicated by step 1525. If the RMS ratio exceeds the threshold, a blowout precursor may be detected. For instance, if the RMS ratio in step 1525 exceeds a threshold of 0.1, the blowout precursor determination at step 360 may indicate that a blowout precursor exists. However, any threshold value that indicates that blowout conditions are nearing is contemplated in this invention.

A second manner for determining blowout precursors from monitoring an increase in the RMS ratio at step 1525 involves monitoring the rate of increase of the RMS ratio. A blowout precursor may be identified if the rate of increase exceeds a predetermined slope. As previously stated, it is also contemplated that a more complex analysis of the rate of increase of the RMS ratio may be used to identify a blowout precursor.

The second wavelet sub-method involves determining the existence of a blowout condition based on the repetitiveness of the magnitude of the wavelet transformed data exceeding a predefined threshold over a given time segment, as indicated by steps 1530, 1535 and 1540. The second wavelet sub-method begins by dividing the pressure data into time segments at step 1535. An exemplary embodiment of the present invention utilized a time segment of a second. However, the time segments can span any conceivable length of time that may be used to identify a blowout precursor.

Next, a magnitude of the wavelet transformed pressure data threshold is defined at step 1535. In an exemplary embodiment, the magnitude threshold value may be approximately four to seven times the RMS value of the wavelet transformed pressure data. However, any magnitude threshold value is contemplated that may be used to identify a blowout precursor. The sub-method then involves counting the number of instances in the given time segment that the wavelet transformed data exceeds the predefined magnitude threshold, as indicated by step 1540. Referring to FIG. 17, the dotted line in each graph of the figure represents a predefined threshold value, which may be subjectively or objectively defined. As can be seen from FIG. 17, the magnitude of the wavelet coefficient value exceeds the threshold more frequently when $\Phi/\Phi_{LBO}$ approaches one, that is, approaches blowout conditions. FIG. 18 demonstrates the same phenomenon by plotting the alarms (each occurrence of the magnitude exceeding the threshold) per second versus $\Phi/\Phi_{LBO}$. As shown in FIG. 18, an increase in the occurrences of the magnitude of the wavelet transformed data exceeding the predefined threshold value indicates that blowout conditions are being encountered.

The third wavelet sub-method involves determining the existence of a blowout condition based on the total elapsed time that the magnitude of the wavelet transformed data exceeds a predefined threshold over a given time segment, as indicated by steps 1545, 1550 and 1555. The third wavelet sub-method begins by dividing the pressure data into time segments 1545. An exemplary embodiment of the present invention utilized a time segment of a second. However, the time segment can span any conceivable length of time that may be used to identify a blowout precursor.

Next, a magnitude of the wavelet transformed pressure data threshold is defined at step 1550. The third wavelet sub method then involves calculating the total elapsed time in the given time segment that the magnitude of the wavelet transformed data exceeds the predefined magnitude threshold, as indicated by step 1555. As shown in FIG. 19, an increase in the total time per time segment that the magnitude of the wavelet transformed data exceeds the predefined magnitude threshold value indicates that blowout conditions are being encountered.

The fourth wavelet sub-method involves determining the existence of a blowout condition by performing statistical analysis on the wavelet transformed data as indicated by steps 1560 and 1565. This sub-method begins by calculating the statistical moment of the wavelet transformed data using the statistical moment equation defined above at step 1560. The exemplary embodiment of this method utilizes the fourth moment, but any order of moment may be used by this method.

Increases in the magnitude may be monitored to indicate that the flame is nearing blowout conditions, as indicated by step 1565. The detection of a blowout precursor based on the increase in the magnitude of the statistical moment of the wavelet transformed data may be identified in several ways. One manner of determining a blowout precursor based on an increase in the magnitude of the statistical moment of the wavelet transformed data would be to set a predetermined threshold for the magnitude of the statistical moment of the wavelet transformed data. The magnitude of the statistical moment of the wavelet transformed data may then be monitored to determine if the magnitude exceeds the predetermined threshold. If the magnitude exceeds the threshold, a blowout precursor may be detected. Any threshold value that indicates that blow conditions are nearing is contemplated in this invention.

A second manner for determining blowout precursors from monitoring an increase in the magnitude of the statistical moment of the wavelet transformed data involves monitoring the rate of increase of the magnitude of the statistical moment of the wavelet transformed data. A blowout precursor may be identified if the rate of increase exceeds a predetermined slope. As previously stated, it is also contemplated that a more complex analysis of the rate of increase of the magnitude of the statistical moment of the wavelet transformed data may be used to identify a blowout precursor.

The fifth wavelet sub-method begins by dividing the wavelet transformed pressure data into time segments at step 1570. The time segments can span any conceivable length of time. In the exemplary embodiment, the time segment is a second. Similar to the fourth wavelet sub-method, the statistical moment of the wavelet transformed pressure data in the given time segment may be calculated at step 1575.

The variance of the statistical moment of the wavelet transformed data may then be calculated at step 1580. Calculation of the variance of a data set is well known in the art. The variance will then be monitored for sufficient increases to indicate a blowout precursor, as indicated by step 1585. Methods for determining the existence of a blowout precursor are similar to those described above for step 1565, that is, by monitoring the increase based on a threshold variance value or a rate of increase in the variance. Any variance threshold value that indicates a blowout condition is contemplated.

Referring back to FIG. 3, results of the various sub-methods of the spectral analysis step 330, statistical analysis step 340, and wavelet analysis step 350 are then analyzed to determine if an ultimate blowout precursor exists 360. This blowout precursor determination logic 360 may be as simple as looking for any one sub-method to indicate that blowout conditions are imminent. Alternatively, the blowout precursor determination logic 360 may be as sophisticated as to including weighting of the multitude of analysis sub-methods based on suitable factors, such as environmental operating conditions, fuel composition, combustor type, to determine if a blowout precursor exists. In addition, the results of the analysis sub-methods may be other than a binary indication (e.g., a slope or the number of times a threshold is exceeded), but may be indicative of the likelihood of the existence of a blowout precursor. Thus, the sub-methods may result in values indicative of the likelihood (or strength) that a blowout precursor exists, which may be normalized and combined. Thus, any combination of the analytical results from methods identified in FIGS. 4, 8, and 15 may be used to determine if a blowout precursor exists and if action should be taken to prevent flame blowout.

Optical Sensing Techniques

Another approach to detecting blowout precursors is using optical sensing analysis. The optical analysis approach monitors optical emissions that are the results of the combustion reactions to identify blowout precursor events. The source most directly connected to the combustion reactions is chemiluminescence, which is the generation of electromagnetic radiation by chemical reactions. The radiation is from excited molecules that are produced by chemical reactions and which generate light when relaxing to lower energy states. Since the intensity of emission is proportional, in part, to the chemical production rate of a particular molecule, the chemiluminescence intensity can be related to chemical reaction rates. Thus, chemiluminescence may provide information on the presence and strength of the combustion process in a specific region of the combustor, making it well suited for monitoring flame stability and blowout precursors.

The primary chemiluminescence species of interest are excited OH, CH, and $C_2$ radicals and the $CO_2$ molecule. OH radical chemiluminescence is in the ultraviolet region of the spectrum near 308 nm. The CH radical has its strongest emission around 430 nm and the $C_2$ radical has its strongest emission around 519 nm. In lean hydrocarbon flames, OH tends to be the strongest emitter. Any of these or other chemiluminescence species may be monitored for blowout detection. In addition, other wavelengths of the electromagnetic spectrum, including those not necessarily associated with chemiluminescing species, such as thermal emissions, may also be used for blowout detection.

An optical measuring device 135 may be included in the combustion system 120 similarly to the pressure measuring device 130, as discussed above. The optical measuring device 135 may be any optical sensor known to one of ordinary skill in the art, including but not limited to photomultiplier tubes and photodiodes. These may be situated either directly viewing some region of the combustion zone, or remotely located and viewing the combustion zone through some optical fiber, mirror, waveguide, or any other method of optically communicating the light to the sensor configuration. The optical measuring device 135 may be mounted either inside or outside the combustor. If mounted outside the combustor, the optical measuring device may sense the optical emissions inside the combustor through some port in the combustor, fuel nozzle, or downstream area. The optical measuring device 135 may be mounted with respect to the combustor such that the light emitted from the entire flame or the light from any local region of the flame may be measured. That is, any portion of the flame may be monitored in the optical analysis to determine if a blowout precursor exists. In an exemplary embodiment for instance, the light emitted from the bottom portion of the flame is measured.

FIG. 20 is a flow chart illustrating an architecture, functionality and/or operation of the signal processing logic 235 of FIG. 2 for the optical sensing approach to the detection of blowout precursors. As illustrated in FIG. 20, the method begins by receiving optical data which includes the intensity of the light emitted from the flame, from the optical measuring device 2020. The received optical data may be analyzed by one or more of four different signal techniques: raw data analysis 2030, spectral analysis 2040, statistical analysis 2050, and wavelet analysis 2050. The four analysis techniques 2030, 2040, 2050, 2060 may be based on the optical data in its entirety or any smaller subset of the optical data. For instance, the subset of the optical data may consist of a sample of a 25 quarter of a second, although any subset of data may be used in this technique.

FIGS. 21-39 describe in more detail the specific signal processing techniques involved with the four analysis techniques. As described below, each of the four analysis techniques involve multiple sub-methods of analysis. When implementing this method, it is contemplated that any combination of the raw data analysis 2030, spectral analysis 2040, statistical analysis 2050, and wavelet analysis 2060 techniques may be used. That is, the method may use one, two, three, or all four of the analysis techniques and any combination of their respective sub-methods to analyze the pressure data.

After the optical data is analyzed by one or more of the steps 2030, 2040, 2050, 2060, the existence of a blowout precursor is determined at step 2070. As described in more detail in FIGS. 21-39, the results of the analysis steps 2030, 2040, 2050, 2060 may indicate that a flame is nearing blowout conditions, such as in the form of a binary output (e.g., a "1" represents the detection of a blowout precursor and "0" represents no detection of a blowout precursor). Similar to the acoustic analysis techniques, determination of a blowout precursor may be based on any combination of the results of the analysis techniques and their respective sub-methods described below. Thus, it is contemplated that the results of the raw data analysis, spectral analysis, statistical analysis, and wavelet analysis can be combined in any manner to detect blowout precursors. That is, the results of the raw data analysis, spectral analysis, statistical analysis, and wavelet analysis may be used individually or in combination to identify blowout precursors 2070. The combination may be defined by any logical or mathematical relationship suitable for such determination, including but not limited to a specific weighting scheme wherein the results of one analysis technique is weighed more heavily in the determination than the others. The combination of such analysis techniques also may be user dependent. The user may decide how close to flame blowout the combustor is desired to operate. The method for determining blowout precursors may end after the blowout precursor detection step 2070, or alternatively, the method may continuously operate on the data as it is received from the combustor.

FIG. 21 illustrates an exemplary embodiment of a raw data analysis techniques of step 2030 in FIG. 20 for determining the existence of a blowout precursor in accordance with the present invention. Under this approach, the raw optical data collected by the optical measuring device 135 or at least a subset of the optical data received from the optical measuring device 135 is normalized by the mean of the raw optical data at step 2110. Normalizing the raw data allows this technique to be more robust in that it is not combustor specific. That is, the technique monitors changes in the light emitted relative to the mean light emissions.

The raw data analysis technique includes three sub-methods as further embodiments of the present invention. Each sub-method may be used individually or in combination with another sub-method to determine the existence of a blowout precursor. The combination of sub-method results may be defined by any suitable logic or mathematical relationship.

The first sub-method 2115, 2120 involves the step of monitoring the magnitude of the normalized optical data that was calculated in step 2110. Blowout precursors may be characterized by short duration flame loss events followed by reignition, occurring at random times in the combustor prior to blowout. Thus, decreases in the magnitude of the optical data may be monitored to indicate that the flame is nearing blowout conditions. As the plot in FIG. 22 illustrates, the magnitude of the normalized optical data will substantially decrease when blowout conditions are neared, i.e. when the $\Phi/\Phi_{LBO}$ approaches 1. The detection of a blowout precursor based on the decrease in the magnitude of the normalized data may be identified in several ways.

One manner of determining a blowout precursor based on a decrease in the magnitude of the normalized optical data would be to set a predetermined threshold for the magnitude of the normalized optical data at step 2115. The magnitude of the normalized optical data may then be monitored to determine if the magnitude decreases below the predetermined threshold at step 2120. If the magnitude decreases below the threshold, a blowout precursor may be detected. For instance, if the magnitude decreases below a threshold of one quarter of the mean optical data, the blowout precursor determination of step 2030 in FIG. 20 may indicate that a blowout precursor exists. However, any threshold value that indicates that blowout conditions are nearing is contemplated in this invention.

A second manner for determining blowout precursors from monitoring a decrease in the magnitude of the normalized optical data involves monitoring the rate of decrease of the magnitude of the normalized optical data. A blowout precursor may be identified if the rate of decrease exceeds a predetermined slope. As previously stated, it is also contemplated that a more complex analysis of the rate of decrease of the magnitude of the normalized optical data may be used to identify a blowout precursor.

This second sub-method involves the step of determining the existence of a blowout condition based on the repetitiveness of the magnitude of the normalized optical data decreasing below a predefined threshold over a give time segment, as indicated by steps 2130, 2135 and 2140. The sub-method initially divides the normalized optical data into time segments at step 2130. The time segments can span any conceivable length of time. In the exemplary embodiment, the time segments are one second. Next, a normalized optical data threshold is defined at step 2135. The technique then involves counting the number of instances in the given time segment that the statistical moment decreases below the normalized optical data threshold, as indicated by step 2140. An increase in the occurrence of the normalized optical data magnitude decreasing below the threshold value indicates that blowout conditions are being encountered. FIG. 23 illustrates a plot of the normalized optical data over a time segment. The dotted line in FIG. 23 represents a predefined threshold value, which may be subjectively or objectively defined. As can be seen from the plot, the normalized optical data decreases below the threshold more frequently when $\Phi/\Phi_{LBO}$ approaches one, that is, approaches blowout conditions.

The third sub-method of raw data analysis involves determining the existence of a blowout condition based on total elapsed time that the magnitude of the statistical moment remains below a predefined threshold over a given time segment, as indicated by steps 2145, 2150, and 2155. The third sub-method begins by dividing the normalized optical data into time segments at step 2145. The time segments can span any conceivable length of time. In the exemplary embodiment, the time segment is a second. Next, a normalized optical data threshold is defined as indicated by step 2150. The sub-method then involves calculating the total elapsed time in the given time segment that the magnitude of the normalized optical data remains below the predefined normalized optical data threshold, as indicated by step 2155. An increase in the total time per time segment that the magnitude of the normalized optical data remains below the predefined threshold value indicates that blowout conditions are being encountered. FIG. 24 illustrates that the duration of elapsed time that the magnitude of the normalized optical data resides below the given threshold increases when blowout conditions are neared.

FIG. 25 illustrates another embodiment of the present invention which implements a spectral analysis technique 2040 that may be implemented to identify blowout precursors. The spectral analysis technique 2040 illustrated in FIG. 25 for the optical sensing approach operates similarly to the spectral analysis technique for the acoustic sensing approach illustrated in FIG. 4. The purpose, function, and/or operation of the statistical analysis methods of FIG. 4 equally apply to the statistical analysis methods of FIG. 25.

The first substantive step 2510 in performing the spectral analysis is to take the Fourier Transform of the optical data received from the optical measuring device 135. As further shown in FIG. 25, the spectral analysis technique may be subdivided into two separate analysis sub-methods as further embodiments of the present invention. The results of each sub-method may individually or in combination with other sub-methods identify the existence of a blowout precursor. The combination of sub-method results may be defined by any suitable logic or mathematical relationship.

The first spectral analysis sub-method involves determining the power of the optical data between a first frequency and a second frequency and calculating a power ratio by normalizing the power by the total spectral power of the optical data, as indicated in step 2520. The normalization of the power allows this sub-method to not be turbine specific nor be dependent on operating conditions such as temperature, atmospheric pressure, humidity, fuel composition, etc. At step 2530, the power ratio is monitored to detect a predetermined increase.

In an exemplary embodiment, a first frequency of between 10 Hz and 100 Hz and a second frequency of between 100 Hz and 500 Hz have been proven effective. However, this invention is not limited to those specific ranges. Any frequency ranges that can be used to determine the existence of a blowout precursor is contemplated by this invention.

The second sub-method of the spectral analysis technique involves determining the power of the optical data at a specific frequency and calculating a power ratio by normalizing the power at a given frequency by the total spectral power of the optical data as indicated in step 2540. The normalization of the power at a specific frequency also allows this sub-method to not be device specific nor be dependent on operating conditions such as temperature, atmospheric pressure, humidity, fuel composition, etc.

In an exemplary embodiment, the power ratio of the second sub-method will be determined using a power at a single frequency between 10 Hz and 500 Hz. However, this invention is not limited to the power within that specific frequency range. Any frequency that can be used to determine the existence of a blowout precursor is contemplated by this invention.

Increases in the power ratios determined by steps 2520 and 2540 may be monitored to indicate that the flame is nearing blowout conditions as indicated by steps 2530 and 2550. Each power ratio calculated in step 2520, 2540 may be analyzed separately to determine a flame's proximity to blowout conditions. FIG. 26 illustrates that the magnitude of the power ratio of step 2520 dramatically increases near blowout conditions. FIG. 27 shows that a similar phenomenon exists for the power ratio calculated in step 2540. The detection of a blowout precursor based on the increase in the respective power ratios may be identified in several ways.

One manner of determining a blowout precursor based on an increase in the power ratio, such as in steps 2530 and 2550, is to set a predetermined threshold for the power ratio. The predetermined threshold value may vary between the power ratios identified in steps 2520 and 2540. Each power ratio may be monitored to determine if the power ratio exceeds the predetermined threshold. If the power ratio exceeds the threshold, a blowout precursor may be detected. For instance, if the power ratio in step 2520 exceeds a threshold of 0.7, the blowout precursor determination logic 2070 may indicate that the combustor is near blowout. However, any threshold value that indicates that blowout conditions are nearing is contemplated for steps 2530 and 2550.

A second manner for determining blowout precursors from monitoring an increase in the power ratio involves monitoring the rate of increase of the power ratio. For instance, a blowout precursor may be identified if the rate of increase exceeds a predetermined slope. It is also contemplated that a more complex analysis of the rate of increase of the power ratio may be used to identify a blowout precursor.

FIG. 28 illustrates the exemplary embodiment of the statistical analysis techniques of step 2050 in FIG. 20 for determining the existence of a blowout precursor. Under this approach, the statistical moment of the optical data or at least a subset of the optical data received from the optical measuring device 135 is calculated at step 2810. Analysis of any moment, $M_n$, where n>2 can also be used for blowout precursor detection. For example, as shown in FIG. 29, the $6^{th}$ moment may be used.

Similar to the spectral analysis technique, the statistical analysis technique includes four sub-methods as further embodiments of the present invention. Each sub-method may be used individually or in combination with another sub-method to determine the existence of a blowout precursor. The combination of sub-method results may be defined by any suitable logic or mathematical relationship.

The first sub-method involves the step of monitoring the magnitude of the statistical moment values 2815 that were determined in step 2810. Increases in the magnitude may be monitored to indicate that the flame is nearing blowout conditions. As the plot in FIG. 30 illustrates, the magnitude of the statistical moment data will substantially increase when blowout conditions are neared. The detection of a blowout precursor based on the increase in the magnitude of the statistical moment data may be identified in several ways.

One manner of determining a blowout precursor based on an increase in the magnitude of the statistical moment data would be to set a predetermined threshold for the magnitude of the statistical moment data. The magnitude of the statistical moment data may then be monitored to determine if the magnitude exceeds the predetermined threshold. If the magnitude exceeds the threshold, a blowout precursor may be detected. For instance, if the magnitude in step 2815 exceeds a threshold of 7, the blowout precursor determination of step 2070 in FIG. 20 may indicate that a blowout precursor exists. However, any threshold value that indicates that blowout conditions are nearing is contemplated in this invention.

A second manner for determining blowout precursors from monitoring an increase in the magnitude of the statistical moment data involves monitoring the rate of increase of the magnitude of the statistical moment data. A blowout precursor may be identified if the rate of increase exceeds a predetermined slope. As previously stated, it is also contemplated that a more complex analysis of the rate of increase of the magnitude of the statistical moment data may be used to identify a blowout precursor.

The second sub-method involves the step of determining the variance of the statistical moment values 2820 that were determined in step 2810. Calculation of the variance of a data set is well known in the art and therefore need not be discussed herein. The variance of the statistical moment data will then be monitored for sufficient increases to indicate a blowout precursor at step 2825. As FIG. 31 illustrates, the variance of the statistical moment data increases significantly near blowout conditions, that is, when $\Phi/\Phi_{LBO}$ equal to one. Methods for determining the existence of a blowout precursor based on step 2825 are similar to those described above for step 2815. For example, one can examine the increase based on a threshold variance value or a rate of increase in the variance. An applicable variance threshold for the Kurtosis, for example, has been determined to be 0.7. However, any variance threshold value that indicates a blowout condition is contemplated and can be applied to any order statistical moment calculation.

The third sub-method under statistical analysis involves determining the existence of a blowout condition based on the repetitiveness of the magnitude of the statistical moment exceeding a predefined threshold over a given time segment, as indicated by steps 2830, 2835, 2840. The sub-method initially divides the optical data into time segments at step 2830. The time segments can span any conceivable length of time. In the exemplary embodiment, the time segment is 32 millisecond long. Next, a statistical moment threshold is defined at step 2835. The technique then involves counting the number of instances in the given time segment that the statistical moment exceeds the predefined statistical moment threshold, as indicated by step 2840. An increase in the occurrence of the statistical moment magnitude exceeding the predefined threshold value indicates that blowout conditions are being encountered. FIG. 32 illustrates a plot of the Kurtosis over a time segment. The dotted line in each graph of the FIG. 32 represents a predefined threshold value, which may be subjectively or objectively defined. As can be seen from the plots, the Kurtosis value exceeds the threshold more frequently when $\Phi/\Phi_{LBO}$ approaches one, that is, approaches blowout conditions. FIG. 33 demonstrates the same phenomenon by plotting the events per second versus $\Phi/\Phi_{LBO}$.

The fourth sub-method of statistical analysis involves determining the existence of a blowout condition based on total elapsed time that the magnitude of the statistical moment exceeds a predefined threshold over a given time segment, as indicated by steps 2845, 2850, and 2855. The fourth sub-method begins by dividing the optical data into time segments at step 2845. The time segments can span any conceivable length of time. In the exemplary embodiment, the time segment is 32 millisecond long. Next, a statistical moment threshold is defined as indicated by step 2850. The sub-method then involves calculating the total elapsed time in the given time segment that the magnitude of the statistical moment exceeds the predefined statistical moment threshold, as indicated by step 2855. An increase in the total time per time segment that the magnitude of the statistical moment data exceeds the predefined threshold value indicates that blowout conditions are being encountered. FIG. 34 illustrates that the duration of elapsed time that the magnitude of the statistical moment data resides above the given threshold increases when blowout conditions are neared.

It is also contemplated that the statistical analysis technique 2050 and all of its sub-methods, e.g., steps 2810-2855, may be applied to only a frequency subset of the raw data. To that end, a bandpass filter may be used on the raw optical data to filter out unwanted frequency ranges before the optical data is subjected to statistical moment calculations. The methods described above for the statistical analysis of step 2050 will be similarly applied to the bandpass filtered data.

FIG. 35 illustrates another embodiment of the present invention which implements wavelet analysis techniques 2060 for determining the existence of a blowout precursor. The method for detecting blowout precursors using the wavelet transform begins by taking the wavelet transform of the optical data, as indicated by step 3510. Time localized bursting events may be noticed after the optical data is transformed by the wavelet transform. The present invention contemplates developing customized wavelet shapes that closely resemble these empirically observed bursting events to better identify blowout conditions. The resulting wavelet transformed data may then be optimized for zeroing in on these bursting events as they occur. Conventional wavelet basis functions, such as the Morlet or Mexican Hat wavelets may also be used in the detection of blowout precursors.

After the wavelet transform of the optical data has been taken at step 3510, the wavelet analysis technique may be subdivided into at least five wavelet analysis sub-methods as further embodiments of the present invention. Each wavelet sub-method may be analyzed individually or in combination with other analysis methods to determine the existence of a blowout precursor. The combination of sub-method results may be defined by any suitable logic or mathematical relationship.

The first wavelet sub-method begins by determining the Root Mean Square (RMS) value of the wavelet transformed optical data at some scale, $\psi$, and the Absolute Mean value of the raw optical data as indicated in step 3515. The RMS calculation is well known to those of ordinary skill in the art, and therefore, need not be described herein. A RMS ratio is then calculated by dividing the RMS value of the wavelet transformed optical data by the absolute mean of the raw optical data as indicated in step 3520. The normalization of the power allows this sub-method to not be device specific nor be dependent on operating conditions such as temperature, atmospheric pressure, humidity, fuel composition, etc.

As shown in FIG. 36, the RMS ratio increases as blowout approaches, and thus, monitoring the increase in the RMS ratio indicate blowout conditions may exist, as indicated by step 3525. One manner of determining a blowout precursor based on an increase in the RMS ratio would be to set a predetermined threshold for the RMS ratio. The amount of increase of the RMS Ratio depends upon the value of the scaling parameter, A. In an exemplary embodiment, v values that roughly correspond to wavelet time scales of 1/500 to 1/20 seconds have worked well. However, the present invention is in no way limited to time scales of between 1/500 and 1/20. Any time scale value may be used to predict the onset of flame blowout. The RMS ratio may then be monitored to determine if the RMS ratio exceeds the predetermined threshold, as indicated by step 3525. If the RMS ratio exceeds the threshold, a blowout precursor may be detected. For instance, if the RMS ratio in step 3525 exceeds a threshold of 1.0, the blowout precursor determination at step 2070 may indicate that a blowout precursor exists. However, any threshold value that indicates that blowout conditions are nearing is contemplated in this invention.

A second manner for determining blowout precursors from monitoring an increase in the RMS ratio at step 3525 involves monitoring the rate of increase of the RMS ratio. A blowout precursor may be identified if the rate of increase exceeds a predetermined slope. As previously stated, it is also contemplated that a more complex analysis of the rate of increase of the RMS ratio may be used to identify a blowout precursor.

The second wavelet sub-method involves determining the existence of a blowout condition based on the repetitiveness of the magnitude of the wavelet transformed data exceeding a predefined threshold over a given time segment, as indicated by steps 3530, 3535 and 3540. The second wavelet sub-method begins by dividing the optical data into time segments at step 3535. An exemplary embodiment of the present invention utilized a time segment of a second. However, the time segments can span any conceivable length of time that may be used to identify a blowout precursor.

Next, a magnitude of the wavelet transformed optical data threshold is defined at step 3535. In an exemplary embodiment, the magnitude threshold value may be approximately four to seven times the RMS value of the wavelet transformed optical data. However, any magnitude threshold value is contemplated that may be used to identify a blowout precursor. The sub-method then involves counting the number of instances in the given time segment that the wavelet transformed data exceeds the predefined magnitude threshold, as indicated by step 3540. Referring to FIG. 37, the dotted line in each graph of the figure represents a predefined threshold value, which may be subjectively or objectively defined. As can be seen from FIG. 37, the magnitude of the wavelet coefficient value exceeds the threshold more frequently when $\Phi/\Phi_{LBO}$ approaches one, that is, approaches blowout conditions. FIG. 38 demonstrates the same phenomenon by plotting the alarms (each occurrence of the magnitude exceeding the threshold) per second versus $\Phi/\Phi_{LBO}$. As shown in FIG. 38, an increase in the occurrences of the magnitude of the wavelet transformed data exceeding the predefined threshold value indicates that blowout conditions are being encountered.

The third wavelet sub-method involves determining the existence of a blowout condition based on the total elapsed time that the magnitude of the wavelet transformed data exceeds a predefined threshold over a given time segment, as indicated by steps 3545, 3550 and 3555. The third wavelet sub-method begins by dividing the optical data into time segments 3545. An exemplary embodiment of the present invention utilized a time segment of a second. However, the time segment can span any conceivable length of time that may be used to identify a blowout precursor.

Next, a magnitude of the wavelet transformed optical data threshold is defined at step 3550. The third wavelet sub method then involves calculating the total elapsed time in the given time segment that the magnitude of the wavelet transformed data exceeds the predefined magnitude threshold, as indicated by step 3555. As shown in FIG. 39, an increase in the total time per time segment that the magnitude of the wavelet transformed data exceeds the predefined magnitude threshold value indicates that blowout conditions are being encountered.

The fourth wavelet sub-method involves determining the existence of a blowout condition by performing statistical analysis on the wavelet transformed data as indicated by steps 3560 and 3565. This sub-method begins by calculating the statistical moment of the wavelet transformed data using the statistical moment equation defined above at step 3560. The exemplary embodiment of this method utilizes the fourth moment, but any order of moment may be used by this method.

Increases in the magnitude may be monitored to indicate that the flame is nearing blowout conditions, as indicated by step 3565. The detection of a blowout precursor based on the increase in the magnitude of the statistical moment of the wavelet transformed data may be identified in several ways. One manner of determining a blowout precursor based on an increase in the magnitude of the statistical moment of the wavelet transformed data would be to set a predetermined threshold for the magnitude of the statistical moment of the wavelet transformed data. The magnitude of the statistical moment of the wavelet transformed data may then be monitored to determine if the magnitude exceeds the predetermined threshold. If the magnitude exceeds the threshold, a blowout precursor may be detected. Any threshold value that indicates that blow conditions are nearing is contemplated in this invention.

A second manner for determining blowout precursors from monitoring an increase in the magnitude of the statistical moment of the wavelet transformed data involves monitoring the rate of increase of the magnitude of the statistical moment of the wavelet transformed data. A blowout precursor may be identified if the rate of increase exceeds a predetermined slope. As previously stated, it is also contemplated that a more complex analysis of the rate of increase of the magnitude of the statistical moment of the wavelet transformed data may be used to identify a blowout precursor.

The fifth wavelet sub-method begins by dividing the wavelet transformed optical data into time segments at step 3570. The time segments can span any conceivable length of time. In the exemplary embodiment, the time segment is a second. Similar to the fourth wavelet sub-method, the statistical moment of the wavelet transformed optical data in the given time segment may be calculated at step 3575.

The variance of the statistical moment of the wavelet transformed data may then be calculated at step 3580. Calculation of the variance of a data set is well known in the art. The variance will then be monitored for sufficient increases to indicate a blowout precursor, as indicated by step 3585. Methods for determining the existence of a blowout precursor are similar to those described above for step 3565, that is, by monitoring the increase based on a threshold variance value or a rate of increase in the variance. Any variance threshold value that indicates a blowout condition is contemplated.

Referring back to FIG. 20, results of the various sub-methods of the raw data analysis 2030, spectral analysis step 2040, statistical analysis step 2050, and wavelet analysis step 2060 are then analyzed to determine if an ultimate blowout precursor exists 2070. This blowout precursor determination logic 2070 may be as simple as looking for any one sub-method to indicate that blowout conditions are imminent. Alternatively, the blowout precursor determination logic 2070 may be as sophisticated as to including weighting of the multitude of analysis sub-methods based on suitable factors, such as environmental operating conditions, fuel composition, combustor type, to determine if a blowout precursor exists. In addition, the results of the analysis sub-methods may be other than a binary indication (e.g., a slope or the number of times a threshold is exceeded), but may be indicative of the likelihood of the existence of a blowout precursor. Thus, the sub-methods may result in values indicative of the likelihood (or strength) that a blowout precursor exists, which may be normalized and combined. Thus, any combination of the analytical results from methods identified in FIGS. 21, 25, 28, and 35 may be used to determine if a blowout precursor exists and if action should be taken to prevent flame blowout.

Combining the Acoustical and Optical Analysis Techniques

As shown in FIG. 40, the acoustical analysis techniques (e.g., FIGS. 4, 8, 15) and the optical analysis techniques (e.g., FIGS. 21, 25, 28, 35) also may be combined to determine the existence of a blowout precursor. The combustor system 120 would include both a pressure measuring device 130 and an optical measuring device 135 to facilitate implementation of the acoustical analysis and the optical analysis techniques. Similar to the blowout determination logics 360 and 2070, a combination blowout determination logic 4020 may look for only one sub-method to indicate that blowout conditions are imminent or may combine the acoustical and optical sub-methods in any manner, such as in a weighting scheme, to determine that blowout conditions are proximate. The combined blowout determination logic 4020 also may look at coincidence of events in the acoustical and optical methods. That is, if sub-methods similar to both the acoustical and optical analysis techniques indicate a blowout precursor, the blowout determination logic 4020 may be confident that blowout conditions are imminent and declare that a blowout precursor exists such that combustor should be controlled to avoid blowout. Other methods that are contemplated for combining the acoustic and optical data are analysis of their cross-correlation, cross-spectrum, and any other method of fusing multiple data streams.

Analysis of Data from Other Sensors

The methods and sub-methods described in FIGS. 3 and 20 for detecting blowout precursors using data acquired from an optical and/or acoustic device are also applicable to data acquired from other parameters of the combustor acquired from a number of other sensors. The particular sensor used in a specific application may vary depending upon a variety of factors, most notably convenience and cost. As such, the use of any of the above described methods on data obtained from other sensors, such as ion, temperature, gas composition, velocity, density, internal energy, heat flux, or other sensors which can be used to interpret characteristics of the combustion process, which may be located upstream, inside, outside or downstream of the combustor is contemplated.

Controlling the Combustor to Prevent Blowout

After identifying blowout precursors, the combustor 110 may be controlled in real-time to prevent a blowout condition. A flame can be stabilized by the control system by altering one or more of a plurality of parameters including but not limited to flow velocity, swirl number, droplet size distribution, turbulence intensity, flame holder geometry, fuel-air ratio, temperature, and pressure. Of these parameters, the total fuel rate, the fuel-air ratio, fuel distribution, or droplet size characteristics, are known to be amenable to real time control. In addition, any device which can be used to stabilize a flame, such as an external ignitor that uses a spark or plasma discharge, is contemplated in this control methodology.

FIG. 41 is a schematic of a combustor that incorporates both an acoustical measuring device 130 and an optical measuring device 135, although one of ordinary skill in the art would appreciate that the combustor control methodology is not dependent on the method used to identify a blowout precursor and any method for detecting blowout precursors is contemplated in this control methodology. The combustor 110 includes a combustion chamber 4110, a pilot flame 4120, a main flame 4130, a fuel-air intake 4140, and a pilot fuel intake 4150. The fuel-air intake 4140 is a conduit for a fuel-air mixture to enter the combustion chamber and fuel the pilot flame 4120 for creation or continuation of the main flame 4130.

One exemplary embodiment of the control method redistributes the fuel inside the combustor without changing the overall fuel flow rate. Referring to FIG. 41, the redistributing control system stabilizes the flame 4130 by redirecting a portion of the fuel from the main fuel-air intake 4140 into the pilot fuel intake 4150. The redistribution technique allows the flame 4130 to be stabilized by increasing the fuel-air ratio at the pilot flame 4120 or the base of the main flame 4130 without changing the overall power to the combustor because the total fuel flow remains unchanged. The redistributing control system may employ model based or rule based algorithms. FIG. 42 illustrates an embodiment of a rule based control algorithm for redistributing the fuel flow in a closed-loop system. One of ordinary skill in the art would appreciate that any rule based algorithm that redistributes fuel to and from the pilot intake to stabilize the combustor is contemplated.

The rule based redistribution method of FIG. 42 begins at step 4205 by reading combustor conditions. Any combustor condition that can be utilized to determine a blowout precursor event may be used at step 4205, such as the optical or acoustic techniques described above, electro-static probes for ion sensing, average or instantaneous temperature, velocity, density, spatial temperature distribution, fuel/air ratio—either a local value or its distribution, gas concentration (such as Carbon Monoxide (CO) or unburned hydrocarbons)—either a local value or its distribution, and static pressure—either a local value or its distribution. In an exemplary embodiment, step 4205 reads either the acoustical signal, optical signal, or both. The remainder of the steps of FIG. 42 are described using the exemplary embodiment of using the acoustical signal, optical signal, or both to determine proximity to blowout conditions, but it should be understood that the method is not in any way limited to the acoustical signal, optical signal, or both. Any method of predicting blowout based on combustor conditions is contemplated in this method.

Step 4210 determines if an alarm signifying the identification of a blowout precursor event has already been declared. If an alarm has not already been declared at step 4210, the algorithm proceeds to step 4250 to determine if a blowout precursor event has been identified. One such event, for example, may be identified by a threshold being crossed as disclosed in step 2120 of FIG. 21. As described previously, several techniques may be used to identify a blowout precursor event in the methods and sub-methods of FIGS. 3 and 20. Step 4250 is not limited to checking for threshold crossings but may be based on any of the blowout precursor identification techniques.

If a blowout precursor event has been identified, the algorithm may proceed to step 4260 to determine if a maximum number of events has been exceeded. That is, the algorithm may require multiple events to be identified before an alarm is declared. The multiple events may be from the different sub-methods of the acoustical and optical techniques or may be from multiple events identified over a given time frame. For example, step 4260 may be configured to declare that a maximum number of events has been exceeded if more than two blowout precursor events are identified in a one second window. One of ordinary skill in the art would understand that any number of events and any time window may be chosen to practice the control algorithm. The maximum events verification of step 4260 also may include logic for combining the acoustical and optical analysis techniques as discussed above. Thus, the maximum number of events may be exceeded at any given discrete time instant if a number of the acoustical and/or optical sensing techniques identify blowout precursor events. Under any method of determining the maximum number of events, if the maximum number of events has been exceeded, step 4270 declares the start of a blowout alarm and increments the fuel in the pilot intake by a percentage signified by X % and decrements the fuel in the fuel-air intake by the same percentage signified by X %. The percentage may be preset or may be determined mathematically in real time.

If a blowout precursor event was not identified at step 4250, the algorithm may decrease the fuel in the pilot intake at regular time intervals. Step 4280 checks the time since the last decrease in fuel to determine if it is greater than the selected time interval, T. For example, if a ½ second time interval is selected for T, every ½ of a second, if no alarm has been identified, step 4280 will result in a "Yes" and proceed to step 4290. The time interval may be arbitrarily chosen and is no way limited to ½ second. If the current time is within the selected time interval, the control algorithm returns back to step 4210 to read the acoustical and/or optical signals.

Step 4290 decreases the fuel in the pilot intake and increases the fuel in the fuel-air intake by the same amount. For example, the percentage decrement may be an arbitrary percentage of the fuel flow Z multiplied by the number of continuous decrements plus 1. This mathematical equation would increase the removal rate of the fuel from the pilot intake if blowout precursor events are continuously not being identified. However, any mathematical equation may be used to determine the decrement of the fuel from the pilot intake. After decreasing the fuel in the pilot intake and increasing the fuel in the fuel-air intake, the control algorithm returns back to step 4210 to read the acoustical and/or optical signals.

If an alarm has already been declared at step 4210, the algorithm proceeds to step 4220 to determine if a blowout precursor event has been identified. One such event may be identified by a threshold being crossed as disclosed in FIG. 21. As described previously, several techniques may be used to identify a blowout precursor event. Step 4220 is not limited to checking for threshold crossings but may be based on any of the blowout precursor identification techniques. If a blowout precursor event has been identified at step 4220, the algorithm proceeds to step 4240 to increment the fuel in the pilot intake by a percentage signified by Y % and decrement the fuel in the fuel-air intake by the same percentage signified by Y %. The percentage may be preset or may be determined mathematically in real time. The control algorithm then returns back to step 4210 to read the acoustical and/or optical signals. If a blowout precursor event is not determined in step 4220, the algorithm proceeds to step 4230 to declare the end of an event and the control algorithm returns back to step 4210 to read the acoustical and/or optical signals.

The responsiveness of the redistribution control system to prevent flame blowout is illustrated in the plots of FIG. 43. The top plot of FIG. 43 is a graph of the equivalence ratio, Φ, versus time. The dotted line in the top plot of FIG. 43 represents unpiloted blowout limit. The middle plot represents events determined at steps 4220 and 4250 of FIG. 42 versus time. The bottom plot represents the percentage of fuel diverted to the pilot intake 4150 versus time. As illustrated by the three plots of FIG. 43, the percentage of fuel diverted to the pilot intake 4150 is proportional to the amount of blowout precursor events identified. As the equivalence ratio decreases to the lean blowout line, the amount of events determined increases causing more fuel to be diverted to the pilot intake to stabilize the flame. As the equivalence ratio increases, the number of events decrease and the amount of fuel to the pilot intake is decreased.

Another exemplary embodiment of the control method stabilizes the flame 4130 by increasing the percentage of fuel in the fuel-air mixture. Flame blowout may occur as a result of the fuel-air mixture being lean, i.e. not enough fuel in the mixture. Increasing the fuel in the fuel-air mixture provides the flame 4130 more fuel to stabilize and thus prevents blowout. In this embodiment, the amount of fuel flow into the combustor is controlled in a closed-loop control system. The closed-loop control system may employ model based or rule based algorithms. The rule based algorithm adds or subtracts fuel from the fuel flow at set incremental levels. In one embodiment, the acoustical and/or optical measuring devices 130, 135 are inputs to the control system and from such measuring devices, blowout precursor events may be identified as discussed previously. However, any combustor condition that can be utilized to determine a blowout precursor event may be used, such as average or instantaneous temperature, spatial temperature distribution, fuel/air ratio—either a local value or its distribution, gas concentration (such as Carbon Monoxide (CO) or unburned hydrocarbons)—either a local value or its distribution, or static pressure—either a local value or its distribution. When events are identified, the fuel flowrate is rapidly increased by a set amount in the fuel-air intake 4140. The increase in the fuel flowrate causes an increase in gaseous emissions such as NOx. When events are no longer identified, the control system will decrease the fuel flowrate in order to reduce emissions until blowout precursor events are detected again. The control system responds to the blowout precursor events by incrementally increasing the fuel flowrate in the fuel-air intake 4140. The control system will balance itself between minimizing NOx and preventing blowout.

FIG. 44 illustrates an embodiment of the method stabilizing the flame 4130 by increasing the percentage of fuel in the fuel-air mixture. Like numerals in FIG. 44 represent like numerals in FIG. 42, and therefore, the corresponding explanations of the like steps of FIG. 42 are equally applicable to the like steps of FIG. 43.

The method of FIG. 44 begins at step 4205 by reading the signals representing the combustor conditions. Step 4210 determines if an alarm signifying the identification of a blowout precursor event has already been declared. If an alarm has not already been declared at step 4210, the algorithm proceeds to step 4250 to determine if a blowout precursor event has been identified.

If a blowout precursor event has been identified, the algorithm may proceed to step 4260 to determine if a maximum number of events has been exceeded. If the maximum number of events has been exceeded, step 4470 declares the start of a blowout alarm and increments the fuel in the fuel-air intake by a percentage signified by X %.

If a blowout precursor event was not identified at step 4250, the algorithm may decrease the fuel in the fuel-air intake at regular time intervals. Step 4280 checks the time since the last decrease in fuel to determine if it is greater than the selected time interval, T. For example, if a ½ second time interval is selected for T, every ½ of a second, if no alarm has been identified, step 4280 will result in a "Yes" and proceed to step 4290. The time interval may be arbitrarily chosen and is no way limited to ½ second. If the current time is within the selected time interval, the control algorithm returns back to step 4210 to read combustor condition signals.

Step 4490 decreases the fuel in the fuel-air intake. For example, the percentage decrement may be an arbitrary percentage of the fuel flow Z multiplied by the number of continuous decrements plus 1. This mathematical equation would increase the removal rate of the fuel from the fuel-air intake if blowout precursor events are continuously not being identified. However, any mathematical equation may be used to determine the decrement of the fuel from the pilot intake. After decreasing the fuel in the fuel-air intake, the control algorithm returns back to step 4210 to read the combustor condition signals.

If an alarm has already been declared at step 4210, the algorithm proceeds to step 4220 to determine if a blowout precursor event has been identified. If a blowout precursor event has been identified at step 4220, the algorithm proceeds to step 4240 to increment the fuel in the fuel-air intake by a percentage signified by Y %. The percentage may be preset or may be determined mathematically in real time. The control algorithm then returns back to step 4210 to read the combustor condition signals. If a blowout precursor event is not determined in step 4220, the algorithm proceeds to step 4230 to declare the end of an event and the control algorithm returns back to step 4210 to read the combustor condition signals.

The responsiveness of the emission control method described in FIG. 44 is illustrated in the two plots on FIG. 45. The top plot represents the NOx gas emissions versus time. The bottom plot represents the amount of fuel flow versus time. Superimposed on the bottom plot are event indications that illustrate the occurrence of blowout precursor events detected. As can be seen from FIG. 45, at time 0, the NOx emissions and the fuel flow are both high and no blowout precursor events are detected. The control system, in an effort to lower NOx gas emissions, lowers the fuel flow, as is seen in times 0 through approximately 70 seconds. Just prior to 80 seconds, blowout precursor events are detected. The control system begins to raise fuel flow, which consequently raises NOx emissions, until the events disappear. When events are no longer detected, the fuel flow begins to decrease in an effort to lower NOx gas emissions, as seen around the 120 second mark. Thus, it becomes apparent from FIG. 45 that the control system allows the combustor system to operate near lean blowout conditions, which minimizes NOx gas emissions, with no a priori knowledge of where the lean blowout conditions reside.

It should be understood that the closed-loop control systems described above are not limited to changes in fuel low or redistribution of fuel flow to stabilize the flame. Other exemplary embodiments of this invention may use a similar feedback control system, as described above, to control blowout by any other method of stabilizing the flame, such as by turning on an external spark or plasma discharge, changing the fuel droplet distribution, or adjusting the inlet gas temperature.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in generic and descriptive sense only and not for purposes of limitation.

That which is claimed:

1. A method for detecting blowout precursors in combustors comprising:

receiving optical data measured by an optical measuring device associated with the combustor;

performing raw data analysis on the optical data normalized by the mean of the optical data;

performing spectral analysis on the optical data using Fourier transform analysis;

performing statistical analysis on the optical data using statistical moments;

performing wavelet analysis on the optical data using wavelet transform analysis; and determining the existence of a blowout precursor based at least in part on one or more of the raw data analysis, spectral analysis, statistical analysis, and wavelet analysis.

2. The method of claim 1, further comprising determining the existence of a blowout precursor based on a predefined change in a magnitude of the normalized optical data.

3. The method of claim 1, wherein performing raw data analysis comprises:

dividing the normalized optical data into a plurality of time segments; and defining a normalized optical data threshold.

4. The method of claim 3, further comprising determining the existence of a blowout precursor based on a number of instances in a given time segment that the normalized optical data exceeds the normalized optical data threshold.

5. The method of claim 1, wherein performing spectral analysis further comprises:

determining a power ratio of power in a frequency range normalized by total spectral power.

6. The method of claim 5, further comprising determining the existence of a blowout precursor based on a predefined change in the power ratio.

7. The method of claim 1, further comprising determining the existence of a blowout precursor based on a predefined change in a magnitude of the statistical moment.

8. The method of claim 1, further comprising determining the variance of the statistical moment.

9. The method of claim 8, further comprising determining the existence of a blowout precursor based on a predefined change in the variance of the statistical moment.

10. The method of claim 1, wherein performing statistical analysis further comprises:

dividing the statistical moment optical data into a plurality of time segments;

defining a statistical moment threshold; and determining the existence of a blowout precursor based on a number of instances in a given time segment that the statistical moment exceeds the statistical moment threshold or based on a total time in a given time segment that the statistical moment exceeds the statistical moment threshold.

11. The method of claim 1, wherein performing wavelet analysis comprises:

determining the wavelet transform of at least part of the optical data; and defining a wavelet transform threshold.

12. The method of claim 11, further comprising determining the existence of a blowout precursor based on a number of instances in a given time segment that the wavelet transform of the optical data exceeds the wavelet transform threshold or based on a total time in a given time segment that the wavelet transform of the optical data exceeds the wavelet transform threshold.

13. The method of claim 11, further comprising determining the existence of a blowout precursor based on a predefined change in magnitude of the statistical moment data.

14. The method of claim 1, wherein performing wavelet analysis comprises:

defining a time segment;

determining the variance of the statistical moment data for each time segment; and determining the existence of a blowout precursor based on a predefined change in the variance of the statistical moment data.

15. The method of claim 1 further comprising:

determining a wavelet transform of at least part of the optical data;

defining a root mean square of the wavelet transform threshold;

determining a ratio of the root mean square of the wavelet transform of the optical data to the root mean square of optical data; and determining the existence of a blowout precursor based on a predefined change in the ratio.

16. A method for detecting a blowout precursor in a combustor comprising:

receiving optical data measured by an optical measuring device associated with the combustor;

performing raw data analysis on the optical data normalized by the mean of the optical data;

performing spectral analysis on the optical data using Fourier transform analysis;

performing statistical analysis on the optical data using statistical moments;

performing wavelet analysis on the optical data using wavelet transform analysis;

receiving pressure data measured by an acoustic pressure device associated with the combustor;

performing spectral analysis on the pressure data using Fourier transform analysis;

performing statistical analysis on the pressure data using statistical moments;

performing wavelet analysis on the pressure data using wavelet transform analysis; and determining the existence of a blowout precursor based at least in part on one or more of the raw data analysis of the optical data, spectral analysis of the optical data, statistical analysis of the optical data, wavelet analysis of the optical data, spectral analysis of the pressure data, statistical analysis of the pressure data, and wavelet analysis of the pressure data.

* * * * *